US010071850B2

(12) United States Patent
Sugawara et al.

(10) Patent No.: US 10,071,850 B2
(45) Date of Patent: Sep. 11, 2018

(54) DISCHARGE CONTAINER

(71) Applicant: DAIZO CORPORATION, Osaka-shi, Osaka (JP)

(72) Inventors: Shinya Sugawara, Kyoto (JP); Kazuhiro Yamaguchi, Kyoto (JP); Kimio Kataoka, Kyoto (JP); Hidetoshi Miyamoto, Kyoto (JP); Satoshi Mekata, Osaka (JP)

(73) Assignee: DAIZO CORPORATION, Osaka (JP)

( * ) Notice: Subject to any disclaimer, the term of this patent is extended or adjusted under 35 U.S.C. 154(b) by 0 days.

(21) Appl. No.: 15/300,530

(22) PCT Filed: Apr. 3, 2015

(86) PCT No.: PCT/JP2015/060673
§ 371 (c)(1),
(2) Date: Sep. 29, 2016

(87) PCT Pub. No.: WO2015/152415
PCT Pub. Date: Oct. 8, 2015

(65) Prior Publication Data

US 2017/0129690 A1 May 11, 2017

(30) Foreign Application Priority Data

Apr. 4, 2014 (JP) ..... 2014-077612
Jul. 10, 2014 (JP) ..... 2014-142087
(Continued)

(51) Int. Cl.
*B65D 83/00* (2006.01)
*B65D 83/60* (2006.01)
(Continued)

(52) U.S. Cl.
CPC ..... *B65D 83/60* (2013.01); *B65D 83/384* (2013.01); *B65D 83/42* (2013.01); *B65D 83/48* (2013.01); *B65D 83/7532* (2013.01)

(58) Field of Classification Search
CPC ..... B65D 83/48; B65D 83/60; B65D 83/684; B65D 83/7532
(Continued)

(56) References Cited

U.S. PATENT DOCUMENTS 3,581,942 A * 6/1971 Thornton ..... B05B 7/2427 222/95
4,089,443 A * 5/1978 Zrinyi ..... B65D 83/62 222/386.5
(Continued)

FOREIGN PATENT DOCUMENTS

JP S62-109762 U 7/1987
JP H04-050683 U 4/1992
(Continued)

OTHER PUBLICATIONS

Search Report issued in corresponding International Application No. PCT/JP2015/060673, dated Jun. 9, 2015.
(Continued)

*Primary Examiner* — Vishal Pancholi
(74) *Attorney, Agent, or Firm* — McDermott Will & Emery LLP

(57) ABSTRACT

Provided is a multilayer-structured discharge container having a simple structure, capable of facilitating the loading of a substance to be contained and a pressurizing agent, and capable of facilitating the ejection of the pressurizing agent after use. A discharge container in which a valve mechanism is provided with a stem having two independent in-stem paths, one in-stem path communicates with an in-holder discharge path, the other in-stem path communicates with an
(Continued)

in-holder gas path, a contained substance is discharged by closing the other in-stem path, and the pressurizing agent is ejected by opening the other in-stem path. The discharge container is capable of causing a pressurization chamber and the atmosphere to communicate by removing a push-button from a valve assembly and pressing down a stem of a valve mechanism (switching operation).

12 Claims, 44 Drawing Sheets

(30) Foreign Application Priority Data

| | | |
|---|---|---|
| Jul. 25, 2014 | (JP) | 2014-152125 |
| Jul. 31, 2014 | (JP) | 2014-156703 |
| Feb. 13, 2015 | (JP) | 2015-026805 |

(51) Int. Cl.

| | |
|---|---|
| ***B65D 83/48*** | (2006.01) |
| ***B65D 83/38*** | (2006.01) |
| ***B65D 83/42*** | (2006.01) |
| ***B65D 83/14*** | (2006.01) |

(58) Field of Classification Search
USPC ..... 222/95, 105, 402.1, 402.11, 402.13, 222/402.18, 402.19
See application file for complete search history.

(56) References Cited

U.S. PATENT DOCUMENTS

| | | | | |
|---|---|---|---|---|
| 5,219,005 | A * | 6/1993 | Stoffel | B65D 83/62 141/20 |
| 7,267,248 | B2 * | 9/2007 | Yerby | B65D 83/38 222/136 |
| 2005/0163721 | A1 * | 7/2005 | Harman | A61K 9/12 424/45 |
| 2006/0124663 | A1 * | 6/2006 | Salemme | B65D 83/62 222/95 |
| 2014/0361038 | A1 | 12/2014 | Mekata | |

FOREIGN PATENT DOCUMENTS

| | | | |
|---|---|---|---|
| JP | H10-236554 | A | 9/1998 |
| JP | H11-100083 | A | 4/1999 |
| JP | 2005-206158 | A | 8/2005 |
| JP | 2007-261632 | A | 10/2007 |
| JP | 2012-224376 | A | 11/2012 |
| JP | 2013-129459 | A | 7/2013 |
| JP | 5487011 | B2 | 5/2014 |
| WO | 03/099681 | A1 | 12/2003 |
| WO | 2013/084996 | A1 | 6/2013 |

OTHER PUBLICATIONS

Extended European Search Report issued in corresponding European Patent Application No. 15774311.3, dated Oct. 18, 2017.
Office Action issued in corresponding Japanese Patent Application No. 2014-077612, dated Apr. 24, 2018.

* cited by examiner

FIG. 41A
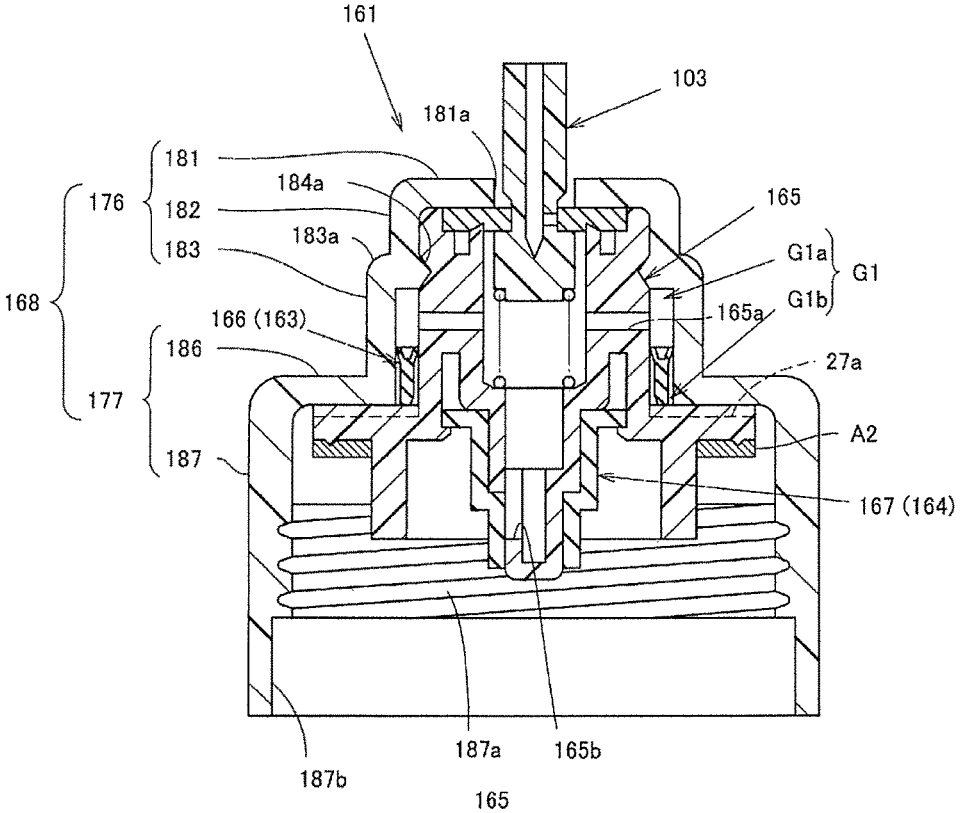
FIG. 41B
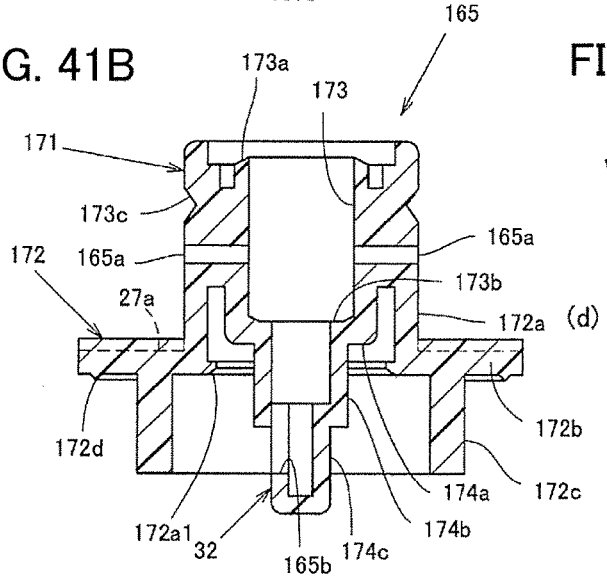
FIG. 41C
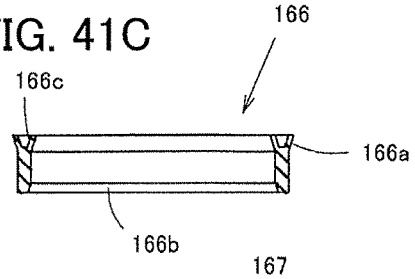
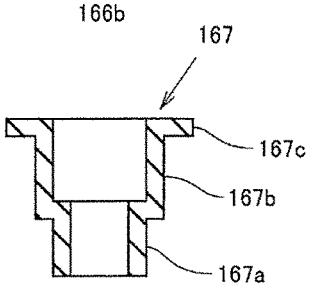
FIG. 41D

DISCHARGE CONTAINER

CROSS REFERENCE

This application is the U.S. National Phase under 35 U.S.C. § 371 of International Application No. PCT/JP2015/060673, filed on Apr. 3, 2015, which claims the benefit of Japanese Application No. 2014-077612, filed on Apr. 4, 2014, Japanese Application No. 2014-142087, filed on Jul. 10, 2014, Japanese Application No 2014-152125, filed on Jul. 25, 2014, Japanese Application No. 2014-156703, filed on Jul. 31, 2014, and Japanese Application No. 2015-026805, filed on Feb. 13, 2015, the entire contents of each are hereby incorporated by reference.

FIELD OF THE INVENTION

The present invention relates to a discharge container. For details, it relates to a multilayer-structured discharge container.

DESCRIPTION OF BACKGROUND ART

A double structure aerosol container is publicly known, which is provided with an outer container, an inner container accommodated in the outer container, a valve assembly closing the outer container and the inner container, a concentrate filled in the inner container, and a pressurizing agent filled in a space between the outer container and the inner container.

Meanwhile, the applicant has proposed a multilayer-structured discharge container, which is, as shown in Patent Document 1, provided with an outer bottle (outer container), an inner bottle (inner container), a lid body (valve assembly) closing the mouth portion of the outer bottle and the mouth portion of the inner bottle, a content filled in a space between the outer bottle and the inner bottle, and a pressurizing agent filled in the inner bottle.

Further, the applicant has proposed a two-fluid discharge container, which is, as shown in Patent Document 2, provided with a pressure resistant container (outer container), an intermediate container (inner container) accommodated in the pressure resistant container, a pouch (innermost container) accommodated in the intermediate container, a valve assembly closing the pressure resistant container, the intermediate container, and the pouch, a first content filled in the pouch, a second content filled between the pressure resistant container and the intermediate container, and a pressurizing agent filled between the intermediate container and the pouch.

PRIOR ART DOCUMENTS

Patent Documents

Patent Document 1: JP5487011B2
Patent Document 2: WO2013084996A1

DESCRIPTION OF THE INVENTION

Problems to be Solved

The present invention is intended to provide an improved multilayer-structured discharge container.

Means to Solve Problems

The first aspect of the present invention is intended to provide a multilayer-structured discharge container, where the structure is simple, the filling of a content and a pressurizing agent can be done easily, and the exhaust of the pressurizing agent after use can be done easily.

The first aspect of discharge container of the present invention is characterized in that it comprises an outer container, an inner container accommodated in the outer container, and a valve assembly fixed by engaging with the outer periphery of the outer container, closing the outer container and the inner container, in which a content is accommodated in an accommodating chamber between the outer container and the inner container, and a pressurizing agent is filled in a pressurizing chamber in the inner container, in which the valve assembly is provided with a valve mechanism communicating/shutting off a discharge passage of the content which communicates the accommodating chamber and atmospheric air, a valve holder which accommodates the valve mechanism, and a cap which fixes the valve holder to the outer container so as to cover the valve holder and the outer container, and in which it is possible to make the pressurizing chamber and atmospheric air communicated by applying a switching operation to the valve assembly.

In the first aspect of discharge container of the present invention, it is possible to exhaust the pressurizing agent after use when the whole amount of the content is discharged, by applying the switching operation to the valve assembly.

In any of the discharge container of the first aspect of the present invention, it is preferable that the valve holder has a housing to accommodate the valve mechanism and an annular flange arranged above the outer container, and that the accommodating chamber and atmospheric air are communicated through the housing and the annular flange. In this case, the structure of the valve assembly can be simplified.

In any of the discharge container of the first aspect of the present invention, it is preferable that by applying the switching operation to the valve assembly, it is possible to make the pressurizing chamber and atmospheric air communicated through the valve mechanism. In this case, since the pressurizing agent is exhausted through the valve mechanism, the amount of exhaust can be controlled, which is safe.

In any of the discharge container of the first aspect of the present invention, it is preferable that the valve mechanism is provided with a stem having two independent intra-stem passages, that the valve holder has an intra-holder discharge passage which communicates the accommodating chamber and atmospheric air, and an intra-holder gas passage which communicates the pressurizing chamber and atmospheric air, that the one intra-stem passage communicates with the intra-holder discharge passage, the other intra-stem passage communicates with the intra-holder gas passage, the other intra-stem passage is closed to discharge the content, and that the switching operation is the operation to make the other intra-stem passage open and to make the valve mechanism open. In this case, the pressurizing agent can be exhausted from the other intra-stem passage. And, since the pressurizing agent can be exhausted by performing the pushing down operation of the stem after the switching operation of the valve assembly, this is safe for a user.

In the discharge container of the first aspect of the present invention, where the switching operation is the operation to open the intra-stem passage, it is preferable that a push button is attached to the stem detachably, the push button having a stem engaging portion to engage with the stem, a discharge hole to discharge the content, and an intra-button passage to connect the stem engaging portion and the discharge hole, that the stem engaging portion communicates the one intra-stem passage with the discharge hole, and shuts off the other intra-stem passage from atmospheric air, and that the switching operation is the operation to detach the push button and to open the valve mechanism. In this case, it is possible to perform the switching operation by detaching the push button, which is simple.

In any of the discharge container of the first aspect of the present invention, it is preferable that the cap is made so as to be movable vertically to the outer container, an inner seal material being provided between the valve holder and the inner container, an outer seal material of circular cross section being provided between the outer cylindrical surface of the outer container and the inner cylindrical surface of the inner container, the cap being fixed to the fixed position of the outer container, a seal structure being made to be formed by the outer seal material and the inner seal material respectively to discharge the content, and that the switching operation includes to release the seal structure of the inner seal material, while the cap is moved to the temporary position upper than the fixed position to make the seal structure of the outer seal material maintained. In this case, since the switching operation is the operation to move the cap upward, the operation is easy, it is possible to prevent the wrong operation by a user while in use.

In the discharge container of the first aspect of the present invention, where the switching operation is the operation to move the cap upward, it is preferable that the valve holder and the cap are connected integrally. In this case, the valve holder does not close the outer container and the inner container during filling.

In the discharge container of the first aspect of the present invention, where the switching operation is the operation to move the cap upward, it is preferable that when the cap is moved to the temporary position and the seal structure of the inner seal material is released, the pressurizing chamber and the discharge passage of the content are communicated, and that the switching operation is the operation to move the cap to the temporary position and to release the valve mechanism. In this case, since the pressurizing agent is exhausted through the valve mechanism, the amount of exhaust can be controlled, which is safe.

In the discharge container of the first aspect of the present invention, where the switching operation is the operation to move the cap upward, it is preferable that the inner seal material is compressed vertically. In this case, the inner seal material is released together with the ascending of the cap.

In the discharge container of the first aspect of the present invention, where the switching operation is the operation to move the cap upward, it is preferable that the inner seal material is compressed horizontally. In this case, even if the cap is moved upward, since the seal structure is not released unless the inner seal material is released from the compression from the valve holder or the inner container, the switching operation can be done safely.

The second aspect of the present invention is intended to provide a multilayer-structured discharge container of high productivity, being easy to fill a concentrate and a pressurizing agent.

The second aspect of the discharge container of the present invention is characterized in that it is provided with an outer container, an inner container accommodated in the outer container, and a valve assembly closing the outer container and the inner container, the valve assembly has a concentrate passage which communicates a concentrate accommodating portion between the outer container and the inner container, and the exterior, and a gas passage which communicates the interior of the inner container and the exterior, and is provided with a check valve for concentrate which shuts off the concentrate passage to a fluid going toward the concentrate accommodating portion from the exterior, and communicates the concentrate passage to the fluid going toward the exterior from the concentrate accommodating portion.

In the second aspect of the discharge container of the present invention, when the pressuring agent is filled through the valve assembly, the concentrate passage can be shut off by the check valve, the pressurizing agent does not enter into the concentrate accommodating portion. Hence, the pressuring agent can be filled after filling the concentrate in the concentrate accommodating portion and sealing the discharge container by attaching the valve assembly, the filling process of the concentrate and the pressurizing agent can be simplified, thereby the filling accuracy of the pressurizing agent is high and the productivity is high. In addition, since the check valve for concentrate communicates the concentrate passage to the fluid going toward the exterior from the concentrate accommodating portion, the exhaust of the concentrate is not affected.

In any of the second aspect of the discharge container of the present invention, it is preferable that a check valve for gas is provided, which shuts off the gas passage to the fluid going toward the exterior from the gas accommodating portion in the inner container, and communicates the gas passage to the fluid going toward the gas accommodating portion from the exterior. In this case, the counter flow of the pressurizing agent after the filling of the pressurizing agent through the valve assembly can be prevented. Moreover, the pressurizing agent never leaks to the exterior during discharge of the concentrate.

In any of the second aspect of the discharge container of the present invention, it is preferable that the check valve for concentrate has the concentrate passage and an evacuation passage extending from the concentrate passage, and a moving valve which moves between the evacuation passage and the concentrate passage, where the moving valve shuts off the concentrate passage by moving toward the concentrate passage side to the fluid going toward the concentrate accommodating portion from the exterior, and communicates the concentrate passage by moving toward the evacuation passage side to the fluid going toward the exterior from the concentrate accommodating portion. In this case, the manufacture is easy and the productivity is high.

The third aspect of the present invention is intended to provide a multilayer-structured discharge container which can discharge safely a pressuring agent filled independently to a concentrate.

The third aspect of the discharge container of the present invention is characterized in that it is provided with an outer container, an inner container accommodated in the outer container, and a valve assembly detachable to the outer container closing the outer container and the inner container, in which a first seal material compressed radially and a second seal material compressed axially are provided between the outer container and the valve assembly.

The third aspect of the discharge container of the present invention is a discharge container provided with a new double seal structure, where after discharging the concentrate from the valve assembly, when discarding the product, the pressurizing agent can be exhausted safely by releasing the seal of the other seal material, while maintaining the seal of the one seal material.

For example, by loosening the valve assembly to the outer container, when the valve assembly moves vertically to the outer container, the seal of the second seal material can be released, while maintaining the seal of the first seal material. Moreover, by loosening the valve assembly to the outer container, when the valve assembly expands radially (horizontally), the seal of the first seal material can be released, while maintaining the seal of the second seal material.

As described above, the other seal is released by maintaining the one seal, without spouting the pressurizing agent to the exterior, the pressurizing agent is made to be communicated with the valve mechanism to make it possible to exhaust the pressurizing agent.

After that, by operating the stem of the valve assembly, the pressurizing agent can be exhausted to the exterior. Particularly, since the stem is designed so that its amount of the spout is controlled by the stem hole, it is safe. Moreover, even if the valve assembly is loosened in the state that the concentrate remains, since the one seal material is maintained, the concentrate is not spouted to the exterior. In this case, after loosening the valve assembly, by operating the stem, the mixture of the concentrate and the pressurizing agent can be exhausted from the stem safely.

In any of the third aspect of the discharge container of the present invention, it is preferable that the first seal material seals between the outer container and the exterior, the second seal material seals between the space between the outer container and the inner container. In this case, by releasing the seal of the second seal material, while maintaining the seal of the first seal material, two spaces can be communicated with each other without substantially opening the multilayer-structured discharge container.

In any of the third aspect of the discharge container of the present invention, it is preferable that the pressurizing agent is filled in the inner container, the concentrate is accommodated in the space between the outer container and the inner container.

In any of the third aspect of the discharge container of the present invention, it is preferable that the concentrate is accommodated in the inner container and the pressurizing agent is filled in the space between the outer container and the inner container.

In the case that the concentrate and the pressurizing agent are accommodated even in any of the space, after discharging the concentrate, the pressurizing agent can be exhausted safely.

In any of the third aspect of the discharge container of the present invention, it is preferable that the first seal material is provided between the outer periphery surface of the outer container and the inner periphery surface of the valve assembly. In this case, even if the valve assembly is loosened and the valve assembly moves vertically to the outer container, the seal is maintained.

Particularly, it is preferable that the valve assembly has a cylindrical cap covered on the outer container, that the first seal material is an O ring of circular cross section, and that the first seal material is provided between an outer cylindrical portion provided in the outer periphery of the outer container and an inner cylindrical portion provided in the inner periphery of the cap. In this case, the seal structure by the first seal material can be made strong.

In any of the third aspect of the discharge container of the present invention, it is preferable that the second seal material is provided between the outer container and the valve assembly. In this case, the seal can be released only by moving the valve assembly upward to the outer container.

Particularly, it is preferable that the valve assembly has the valve holder arranged in the upper end of the outer container, and that the second seal material is provided between the outer container and the valve holder. In this case, it can be made to be of a simple structure.

Further, it is preferable that the second seal material is provided between the outer container and the valve assembly through the inner container. In this case, by the second seal material, it is possible to seal between the outer container and the valve assembly, and between the inner container and the valve assembly.

In any of the third aspect of the discharge container of the present invention, it is preferable that a flange portion arranged in the upper end of the outer container is provided in the upper end of the inner container, that the valve assembly has the valve holder arranged in the upper surface of the flange portion so as to close the inner container, and a cylindrical cap covered so as to close the outer container, fixing the valve holder to the outer container, that the first seal material is provided between the outer periphery surface of the outer container, and the inner periphery surface of the cap, and that the second seal material is provided between the outer container and the valve holder through the flange portion of the inner container. In this case, by loosening the cap upward, the second seal material can be released, while maintaining the first seal material, making it possible to exhaust the pressurizing agent safely.

In any of the third aspect of the discharge container of the present invention, it is preferable that an innermost container accommodated in the inner container and closed by the valve assembly is further provided, In this case, after use, it becomes a two-fluid discharge container capable of exhausting the pressurizing agent safely.

In any of the third aspect of the discharge container of the present invention, it is preferable that the valve assembly is detached by moving vertically to the outer container. In this case, it is possible to release the seal of the second seal material, while maintaining the seal of the first seal material. Particularly, it is preferable that the valve assembly and the outer container is detachable by a screw. In this case, when the valve assembly is loosened to the outer container, since the valve assembly can be moved gradually vertically, it can be made to be of a simple structure.

The fourth aspect of the present invention is intended to provide a discharge container of double-layered structure, in which the discard of a pressurizing agent is easy. The fourth aspect of the discharge container of the present invention is characterized in that it has an outer container, an inner container accommodated in the outer container, a valve assembly closing the outer container and the inner container, and a discharge member attached to the stem of the valve assembly, that it is a double-layered discharge container partitioned into a first space between the outer container and the inner container and a second space inside the inner container, in the one space, the concentrate is filled, and in the other space, the pressurizing agent is filled, and that the valve assembly is provided with two independent passages; the concentrate passage which communicates the one space with the exterior, and a pressurizing agent passage which communicates the other space with the exterior, where the discharge member has a closing portion to close the pressurizing agent passage when being attached to the stem.

Particularly, it is preferable that the valve assembly is provided with two independent passages, each having a cylindrical stem opening in the upper end thereof, the closing portion closing the upper end opening of the one intra-stem passage composing the pressurizing agent passage.

In the fourth aspect of the discharge container of the present invention, the filling of the concentrate and the pressurizing agent is easy. Moreover, since it has the closing portion to close the pressurizing agent passage, when the discharge member is attached to the stem, the pressurizing agent is not exhausted to the exterior when the concentrate is discharged. And, when the concentrate is depleted and the double-layered discharge container is discarded, the discharge member is detached, and the pressurizing agent is exhausted to the exterior through the pressurizing agent passage.

In any of the fourth aspect of the discharge container of the present invention, it is preferable that the stem is that in which an inner cylindrical portion and an outer cylindrical portion are formed coaxially, that the inner cylindrical portion protrudes upper than the outer cylindrical portion, and the closing portion is that which closes the upper end opening of the inner cylindrical portion or the outer cylindrical portion. In this case, since the operation direction of the discharge member (downward direction), and the closing direction of the closing portion to close the upper end opening is the same, the pressurizing agent does not leak during the operation of the discharge member (during the concentrate discharge).

Particularly, it is preferable that the stem is that in which the inner cylindrical portion and the outer cylindrical portion are formed coaxially, the inner cylindrical portion protrudes upper than the outer cylindrical portion, and that the closing portion is that which closes the upper end opening of the inner cylindrical portion or the outer cylindrical portion.

In this case, since the upper end opening of the concentrate passage and the upper end opening of the pressurizing agent passage become different height, the closing portion closing the upper end opening of the pressurizing agent passage can be made to be a simple structure while securing the upper end opening of the concentrate passage. Hence when operating the discharge member (during concentrate discharge), the pressuring agent passage can be certainly sealed, while securing the concentrate passage.

In any of the fourth aspect of the discharge container of the present invention, it is preferable that an insertion hole is provided in the discharge member, which closes the upper end opening of the other intra-stem passage composing the concentrate passage, and is capable of inserting the inner cylindrical portion of the stem. In this case, when discarding the double discharge container, the pressurizing agent can be exhausted by detaching the discharge member, and by inserting the stem into the insertion hole of the discharge member so as to release the valve assembly.

In any of the fourth aspect of the discharge container of the present invention, it is preferable that it has a protection cap attached to the upper end of the valve assembly, and that the insertion hole is provided in the protection cap, which closes the upper end opening of the other intra-stem passage composing the concentrate passage, and is capable of inserting the inner cylindrical portion of the stem. In this case, when discarding the double discharge container, the pressurizing agent can be exhausted by detaching the discharge member, and by inserting the stem into the insertion hole of the protection cap so as to release the valve assembly.

The fifth aspect of the present invention is intended to provide a discharge container in which the sealability of the valve mechanism is stable, and the content can be discharged stably.

The fifth aspect of the discharge container of the present invention is characterized in that it has a container body and a valve assembly to close the container body, that the valve assembly has a valve unit arranged in the upper end of the container body and a cylindrical cap fixing the valve unit to the container body, that the valve unit is provided with a valve mechanism, a cylindrical valve holder in which a first flange portion arranged in the upper end of the container body is formed accommodating the valve mechanism, and a valve cover which covers the opening of the valve holder, fixing the valve mechanism to the valve holder, and in which a second flange portion arranged above the first flange portion is formed, that above the first flange portion of the valve holder, a communicating hole which communicates the inside and outside of the valve holder is formed, and that a passage which is communicated with the communicating hole, and communicated with the container body, is formed between the first flange portion of the valve holder and the second flange portion of the valve cover. In the fifth aspect of the discharge container of the present invention, the passage can be securely provided regardless of the attaching (tightening) state of the cap to the container body. In addition, when a plurality of the passages is radially provided, the position alignment of the passage between the flange portion and the container body becomes easy.

Further, it is particularly preferable when the passage is the concentrate passage to let through the concentrate. Further, when the cap is fixed to the container body by screwing, the valve unit is rotated along with the rotation of the cap, even if the above described passage and the passage between the flange portion and the container body are deviated from an initial setting, it is possible to make communication without being affected by the amount of spout, which is preferable.

In any of the fifth aspect of the discharge container of the present invention, it is preferable that the valve unit is integrated in the state that the valve holder and the valve cover accommodates the valve mechanism. In this case, the seal structure of the valve mechanism is stable regardless of the attached state of the cap, which makes the handling in a manufacturing process easy, allowing stable filling of the pressurizing agent and the content. Particularly, it is preferable when the pressurizing agent is filled from the upper end opening of the cap.

In any of the fifth aspect of the discharge container of the present invention, it is preferable that a temporary support portion supporting the flange portion of the valve unit at the position lower than the valve unit to the cap in the fixed state is provided in the inner surface of the cap.

In this case, when in manufacturing, by making the temporary support portion of the cap support the valve unit, the valve assembly can be handled as one body. Since the valve unit is made to be somewhat movable vertically to the cap, the fine adjustment of the seal between the flange of the valve unit and the upper end of the container body can be performed by the press-in quantity of the cap. Particularly, in the case that the cap and the container body are screwed, when the cap is rotated, since the cap can be idled to the valve unit, there never occurs such a problem that the seal materials sealing between the valve unit and the inner container and further between the valve unit and the inner container are twisted or teared, which is preferable because the stable sealability can be obtained.

In any of the fifth aspect of the discharge container of the present invention, it is preferable that it is provided with the inner container having flexibility accommodated in the container body, of which the opening is closed by the valve assembly, and that the passage communicates the communicating hole and the space between the container body and the inner container. In this case, it is possible to form two independent spaces (between the container body and the inner space, inside the inner space).

Particularly, when filling the concentrate between the container body and the inner container, the concentrate can be introduced in the valve holder through the passage and discharged to the exterior.

Particularly, it is preferable that beneath the first flange portion of the valve holder, a second communicating hole which communicates the inside and the outside of the valve holder, and is communicated with the inside of the inner container is formed. In this case, by filling the first concentrate between the container body and the inner container, further, the second concentrate and the pressurizing agent in the inner container, it can be made to be the two-fluid discharge container.

Further, it is preferable that it is provided with an innermost container having flexibility being closed by the valve assembly, and that the second communicating hole communicates the inside of the valve holder and the inside of the innermost container.

In this case, three independent spaces (between the container body and the inner space, between the inner space and the innermost space, inside the innermost space) can be formed. In each space, two kinds of concentrate and the pressurizing agent which pressurizes simultaneously the two concentrates can be filled, making it possible to produce a two-fluid discharge product.

The sixth aspect of the present invention is intended to provide a manufacturing method of a discharge product adopting a new filling method of the pressurizing agent.

The sixth aspect of the manufacturing method of the discharge product is characterized in that it is a manufacturing method of the discharge product to fill a content and a pressurizing agent in a container having a container body and a valve assembly to close the container body, the valve assembly having a valve unit provided with a flange portion arranged in the upper end of the container body and a cylindrical cap fixing the valve unit to the container body, where the cap is held upper than a fixed position, from the upper end opening of the cap, the pressurizing agent is filled in the container body through between the cap and the valve unit, and between the flange portion and the upper end of the container body, then the cap is fixed to the fixed position.

The sixth aspect of the manufacturing method of the discharge product is provided with a new filling method of the pressurizing agent being completely non-conventional. Particularly, since the filling of the pressurizing agent can be done from the upper end opening of the cap above the opening of the container body, a filling device can be made compact.

In any of the sixth aspect of the manufacturing method of the present invention, it is a method to be preferable that the valve unit is provided with the valve mechanism, the valve holder having the cylindrical housing accommodating the valve mechanism, and the valve cover covering the opening of the housing, fixing the valve mechanism to the housing, in which the flange portion is formed, and that the valve holder and the valve cover are integrated in the state that the valve mechanism is accommodated. In this case, unitization makes the seal structure of the valve mechanism stable, being not affected by the attached state of the valve unit by the cap, allowing easy handling in the manufacturing process, thereby allowing stable production of the discharge product.

In any of the sixth aspect of the manufacturing method of the present invention, it is a method to be preferable that the valve cover is provided in the opening of the housing, and is provided with a canopy portion in which a hole to let through the stem of the valve mechanism is formed, the cylindrical portion arranged in the outer periphery of the housing, and the flange portion protruding radially outward from the side surface of the cylindrical portion, that the upper end opening of the cap is arranged in the outer periphery of the cylindrical portion, and that the gap between the valve cover and the cap is opened facing upward. In this case, since the gap between the valve cover and the cap through which the pressurizing agent is filled is opened facing upward, when pressurizing agent is filled by attaching a pressuring agent filling device in the upper part of the discharge container, pressurizing agent can be filled without being made into a complicated structure.

In any of the sixth aspect of the manufacturing method of the present invention, it is a method to be preferable that it is provided with a temporary support portion to support the valve unit lower than the position of the valve unit to the cap in the fixed state in the inner surface of the cap, and that the valve unit is made to be supported by the temporary support portion to fill the pressurizing agent. In this case, when filling the pressurizing agent, the valve unit moves beneath the cap by the pressure of the pressurizing agent, the gap between the valve unit and the cap can be secured certainly. Moreover, by the filling pressure of the pressurizing agent, it is possible to prevent the valve unit from closing the opening of the container body and plugging the filling passage of the pressurizing agent. Further, before filling the pressurizing agent, by making the temporary support portion of the cap support the valve unit, the valve assembly can be treated as one part, the process until the cap is supported upper than the fixed position can be simplified.

In any of the sixth aspect of the manufacturing method of the present invention, it is a method to be preferable that the discharge container is accommodated in the container body, and is provided with the inner container having flexibility closed by the valve assembly, and that the pressurizing agent is filled in the inner container or in the space between the container body and the inner container. In this case, the filling of the pressurizing agent can be done easily.

In any of the sixth aspect of the manufacturing method of the present invention, it is a method to be preferable that the discharge container is accommodated in the container body, and is provided with the innermost container having flexibility closed by the valve assembly, and that the pressurizing agent is filled in the space between the container body and the innermost container. In this case, the filling of the pressurizing agent can be done easily.

The seventh aspect of the present invention is intended to provide a manufacturing method of a multilayer-structured discharge product which can control irregular contraction of the inner container.

The seventh aspect of the manufacturing method of the discharge product of the present invention is characterized in that a multilayer structured discharge container comprises a bottomed outer container, an inner container having flexibility and having an approximately same shape as the inner surface of the outer container, accommodated in the outer container, and a lid body to close the mouth portion of the outer container and the mouth portion of the inner container, that a content composed of the concentrate and the pressurizing agent is filled in the multilayer structured discharge container, and that in the state that a guide member is inserted into the inner container positioned inside the outer container, after contracting the inner container, the concentrate and the pressurizing agent are respectively filled.

In the seventh aspect of the manufacturing method of the discharge product of the present invention, since the inner container is contracted in the state that the guide member is inserted into the inner container, it can be made to be an intended shape by controlling the contracted shape of the inner container. Hence, the contracted shape of the inner container between products becomes approximately constant (in other words, the content, particularly the storage portion of the concentrate is constant), the variation of quality can be suppressed. Moreover, it becomes possible to restore easily the contracted shape of the inner container, and as the result, it becomes also possible to suppress the remaining of the concentrate. In addition, since the inner container is previously contracted/deformed before filling the concentrate, the convergence of the contraction/deformation to the vicinity of the passage communicating with the storage portion is suppressed, allowing to secure the passage to the storage portion.

In any of the seventh aspect of the present invention, it is preferable that the lower end portion of the guide member is positioned in the vicinity of the bottom portion of the inner container. In this case, it is possible to suppress such deformation as the inner container being raised, or the bottom portion is rolled up. As the result, it becomes possible to secure the passage to the storage portion certainly, the inner container becomes easy to restore the original shape, and the remaining of the concentrate can be further reduced.

In any of the seventh aspect of the present invention, it is a method to be preferable that the lower end of the guide member is spherical. In this case, it can be prevented that during the contraction of the inner container, the guide member tends to break (penetrate) the bottom portion of the inner container.

In any of the seventh aspect of the present invention, it is a method to be preferable that the contraction of the inner container is performed by filling gas between the outer container and the inner container. In this case, by filling gas between the outer container and the inner container, the inner container is easily contracted/deformed.

In any of the seventh aspect of the present invention, it is a method to be preferable that the contraction of the inner container is performed by reducing the pressure inside the inner container. In this case, the inner container can be easily contracted/deformed.

In any of the seventh aspect of the present invention, it is a method to be preferable that when contracting the inner container, the inner container is heated. In this case, the inner container gets soft, allowing easy contraction.

In any of the seventh aspect of the present invention, it is a method to be preferable that irregularity or gap is formed in the outer surface of the guide member. In this case, loosening (fold) generated when the inner container is contracted can be provided in an intended position, suppressing the variation of quality between the products, and the products can get good appearance.

In any of the seventh aspect of the present invention, it is a method to be preferable that the guide member is provided with a gas passage communicating the inside of the inner container and the exterior. In this case, it is possible to reduce the pressure inside the inner container through the guide member, the inner container can be easily contracted and deformed.

In any of the seventh aspect of the present invention, it is a method to be preferable that the guide member is provided in the lid body. In this case, the inner container can be contracted in the state that the lid body is attached to the outer container, allowing to simplify the manufacturing process.

In any of the seventh aspect of the present invention, it is a method to be preferable that the guide member is formed to be extendable and contractable. In this case, the guide member can be gradually contracted while supporting the gradually contracting inner container from inside, thereby the inner container is easy to be contracted along the shape of the guide member.

In any of the seventh aspect of the present invention, it is a method to be preferable that the guide member is pulled out from the inner container, after the inner container is contracted.

In any of the seventh aspect of the present invention, it is a method to be preferable that the guide member is saclike, having elasticity, and is made to be expandable and contractable by being expanded or contracted balloon-like. In this case, the continuous support of the inner container becomes possible by the guide member.

The eighth aspect of the present invention is intended to provide a discharge product of double layer structure which can discharge a composition for discharge to the last, in which the leak of the pressurizing agent is little.

The eighth aspect of the discharge product of the present invention is characterized in that it is provided with an outer container, an inner container having flexibility, accommodated therein, a valve assembly which closes the outer container and the inner container, and communicates a composition accommodating chamber between the outer container and the inner container with atmospheric air, and a composition for discharge filled in the composition accommodating chamber, and a pressurizing agent filled in the pressurizing chamber inside the inner container, where the composition for discharge is a homogeneous solution composed of the concentrate and a foaming agent dispersed uniformly in the concentrate.

In the eighth aspect of the discharge product of the present invention, even if the passage communicated with atmospheric air from the composition accommodating chamber is plugged or becomes small due to the expansion of the inner container by the discharge of the composition for discharge, the passage is expanded by the foaming agent dispersed uniformly in the concentrate, it is possible to discharge the composition for discharge to the last. Moreover, since the composition for discharge is positioned around the pressurizing agent, it is possible to prevent the pressurizing agent from leaking by permeating the outer container. Moreover, since the composition for discharge and the pressurizing agent are filled in the independent separate spaces, even if the outer container is placed in any direction, the composition for discharge can be discharged, allowing to prevent an improper use to spout pressurizing agent only. Further, since the composition for discharge is made to be the homogeneous solution in which the forming agent is dispersed in the concentrate, even if shaking action for dispersing the foaming agent before discharge is not done, it is possible to discharge foam only by opening the valve mechanism between the composition accommodating chamber and atmospheric air.

In any of the eighth aspect of the present invention, it is preferable that the pressurizing agent is dissoluble compressed gas which dissolves in the composition for discharge, and that the inner container is made of resin having permeability to the pressurizing agent. In this case, the dissoluble compressed gas permeates the inner container, and the dissoluble compressed gas can be dissolved in the composition for discharge, the foamability of the composition for discharge improves. Particularly, when carbon dioxide is used as the compression gas, not only the foamability is enhanced, but also such an effect as blood circulation promotion can be obtained.

In any of the eighth aspect of the present invention, it is preferable that the steam pressure (gauge pressure) of the composition for discharge at 25° C. is 0.01-0.3 MPa. In this case, since the composition for discharge has a specific steam pressure, even if the passage communicating with atmospheric air from the composition accommodating chamber is plugged or becomes small due to the expansion of the inner container by the discharge of the composition for discharge, the effect of enlarging the passage is further higher, allowing the smooth discharge of the composition for discharge to the last.

The ninth aspect of the present invention is intended to provide a discharge product which is easy to manufacture, and can discharge the content with its amount of discharge to be constant from the start of use to the just before the end of use.

The ninth aspect of the discharge container of the present invention is characterized in that the discharge container comprises an outer container, an inner container having flexibility accommodated therein, and a valve assembly which closes the outer container and the inner, having a valve mechanism, where the content is filled in a concentrate chamber between the outer container and the inner container, the pressurizing agent is filled in a pressurizing chamber in the inner container, and there is provided a pressure adjusting mechanism accommodated in the inner container, which raises the pressure up to a predetermined pressure when the inner pressure decreases.

In the ninth aspect of the discharge container of the present invention, even if the valve mechanism is activated and the content is discharged, the pressure in the pressurizing chamber is maintained to be constant, the discharge amount per unit hour can be made constant from start to finish. Moreover, since the pressure adjusting mechanism is independently accommodated in the inner container, there is no contact with the content, allowing stable pressure adjusting function. Further, according to the content filled between the outer container and the inner container, the permeation of the pressurizing agent filled in the inner container can be made little, the leak of the pressurizing agent when not in use can be made little.

In any of the ninth aspect of the discharge container of the present invention, it is preferable that the pressure adjusting mechanism is attached to the lower end of the valve assembly. In this case, the assembling of the discharge container is simple.

In any of the ninth aspect of the discharge container of the present invention, it is preferable that the pressure adjusting mechanism is provided with a high pressure chamber having a gas supplying hole communicated with the inside of the inner container, a reference pressure chamber sealed with a predetermined pressure, a piston which compresses/expands the reference pressure chamber according to the pressing pressure of the reference pressure chamber and the inner container, and a valve which shuts off/communicates the gas supply hole interlocked with the piston, where when the reference chamber is compressed smaller than the predetermined capacity by the piston, the valve shuts off the supply of gas, and when the reference chamber is expanded larger than the predetermined capacity by the piston, the valve communicates the gas supply hole. In this case, it becomes a stable pressure adjusting mechanism not affected by a temperature variation.

Particularly, it is preferable that a gas container in which the high pressure chamber and the valve are integrated is accommodated in the inner container. In this case, when assembling the discharge container, since there is no need to fill the pressurizing agent into the high pressure chamber, the assembling of the pressure adjusting mechanism is simple. Further, it is preferable that the pressure adjusting mechanism is formed below the valve assembly, a cylinder portion to accommodate the piston is provided, and a gas container is attached to the lower end of the cylinder portion. In this case, the structure is simple.

In any of the ninth aspect of the discharge container of the present invention, it is preferable that the bottom portion of the gas container is placed in the bottom portion of the inner container. In this case, since the bottom portion of the gas container is supported by the inner container, when attaching the valve assembly, the gas container is easy to be connected to the lower end of the cylinder portion.

As the manufacturing method of the discharge product in which the pressurizing agent is filled in the discharge container of the ninth aspect of the present invention, a method can be cited, in which the outer container and the inner container are prepared, the gas container is accommodated in the inner container, and by fixing the valve assembly to the outer container and the inner container, the pressure adjusting mechanism is actuated, then the pressurizing agent is filled into the inner container from the gas container. In this case, a special filling process of the pressurizing agent is not necessary, it is possible to assemble the discharge product by a user. Thereby it is possible to build a new refilling system of an aerosol container.

In any of the ninth aspect of the discharge container of the present invention, it is preferable that the pressure adjusting mechanism is accommodated by being hanged from the opening of the inner container, and there is provided a container holder for holding the gas container, a slit to communicate the inside of the container holder and the inside of the inner container is formed in the container holder. In this case, the position of the gas container becomes stable, and since the bottom portion of the gas container is supported by the container holder, when attaching the valve assembly, the gas container is easy to be connected with the lower end of the cylinder portion. Moreover, the size of the outer container and the inner container can be selected freely.

As the manufacturing method of the discharge product in which the pressurizing agent is filled in the discharge container of the ninth aspect of the present invention, a method can be cited, in which the outer container and the inner container are prepared, the gas container is accommodated in the inner container, and by fixing the valve assembly to the outer container and the inner container, the pressure adjusting mechanism is actuated, then the pressurizing agent is filled into the inner container from the gas container. In this case, a special filling process of the pressurizing agent is not necessary, it is possible to assemble the discharge product by a user. Thereby it is possible to build a new refilling system of an aerosol container. As the manufacturing method of the discharge product in which the pressurizing agent is filled in the discharge container of the ninth aspect of the present invention, a method can be cited, in which the outer container and the inner container are prepared, the container holder in which the gas container is held is accommodated in the inner container, and by fixing the valve assembly to the outer container and the inner container, the pressure adjusting mechanism is actuated, then the pressurizing agent is filled into the inner container from the gas container. In this case, a special filling process of the pressurizing agent is not necessary, it is possible to assemble the discharge product by a user. Thereby it is possible to build a new refilling system of an aerosol container.

The tenth aspect of the present invention is characterized in that the discharge container comprises an outer container, an inner container accommodated in the outer container, and a valve assembly engagingly fixed to the outer periphery of the outer container closing the outer container and the inner container, the content is filled in the accommodating chamber between the outer container and the inner container, and a pressurizing agent is filled in a pressurizing chamber inside the inner container, in which the valve assembly is provided with a valve mechanism which communicates/shuts off the discharge passage of a content communicating the accommodating chamber and atmospheric air, a valve holder accommodating the valve mechanism, and a cap which fixes the valve holder to the outer container so as to cover the valve holder and the outer container, in which an inner seal material is provided between the valve holder and the inner container, an outer seal of circular cross section is provided between the outer cylindrical surface of the outer container and the inner cylindrical surface of the cap, the cap is fixed to the fixed position in the outer container, the content is discharged by making the outer seal material and the inner seal material form a seal mechanism respectively, and in which when the cap is arranged in the temporary position upper than the fixed position, the outer seal material is made to form the seal structure, the inner seal material is not made to form the seal structure.

In the tenth aspect of the discharge product of the present invention, since it is possible to make such a state that the outer seal material is made to form the seal structure, the inner seal material is made not to form the seal structure, the pressurizing agent can be filled into the inner container from between the valve assembly and the inner container (undercup filling). In the tenth aspect of the discharge product of the present invention, it is preferable that the inner seal material is compressed in a vertical direction or the inner seal material is compressed in a horizontal direction.

BRIEF DESCRIPTION OF THE DRAWINGS

FIG. 41A-41D is respectively a cross-sectional view of the valve assembly, a cross-sectional view of the valve holder, a cross-sectional view of the moving valve, and the elastic valve of the multilayered discharge container of FIG. 40;

MODE FOR CARRYING OUT THE INVENTION

Figure 1:
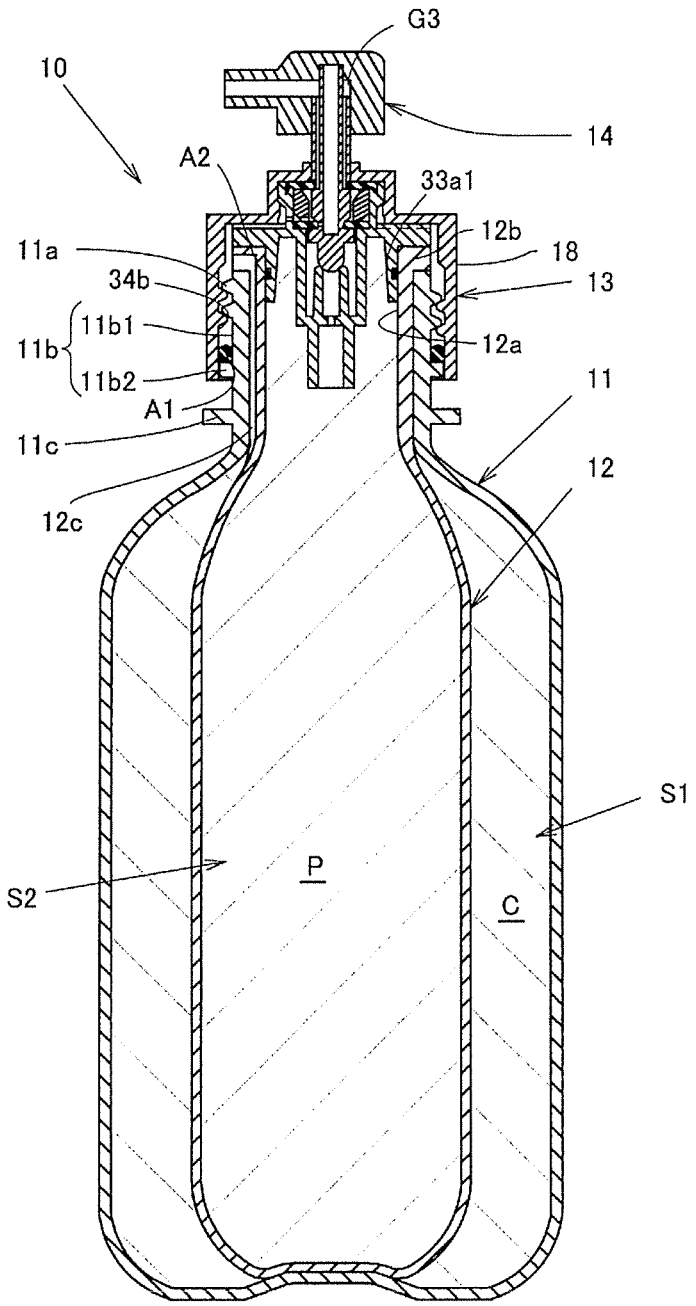
FIG. 1 A cross-sectional view showing the first embodiment of the discharge container of the present invention.

The discharge container 10 of FIG. 1 is the first embodiment of the present invention, in which a valve mechanism is provided with a stem having two independent intra-stem passages, where one intra-stem passage is communicated with an intra-holder discharge passage, the other intra-stem passage is communicated with an intra-holder gas passage, closing the other intra-stem passage to discharge a content, opening the other intra-stem passage to exhaust a pressuring agent.

In detail, the discharge container 10 of FIG. 1 comprises an outer container 11 made of synthetic resin, an inner container 12 made of synthetic resin accommodated inside thereof, and a valve assembly 13 closing the outer container 11 and the inner container 12, and is engagingly fixed to the outer periphery of the outer container, a content C is filled in an accommodating chamber S1 between the outer container 11 and the inner container 12, a pressurizing agent P is filled in a pressuring chamber S2 inside the inner container. This discharge container 10 is used by attaching a push button 14 to the valve assembly 13.

Figure 3A:
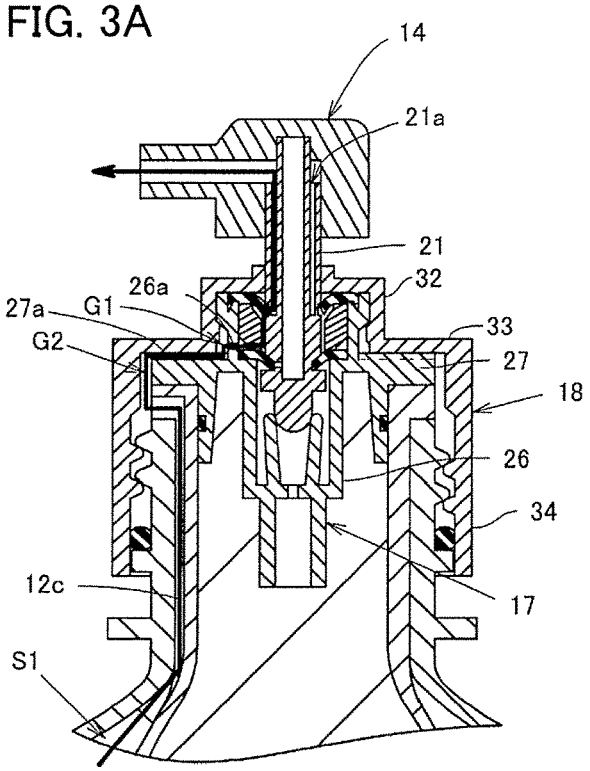
FIG. 3A is a partial cross-sectional view showing the use state of the discharge container of FIG. 1.
Figure 3B:
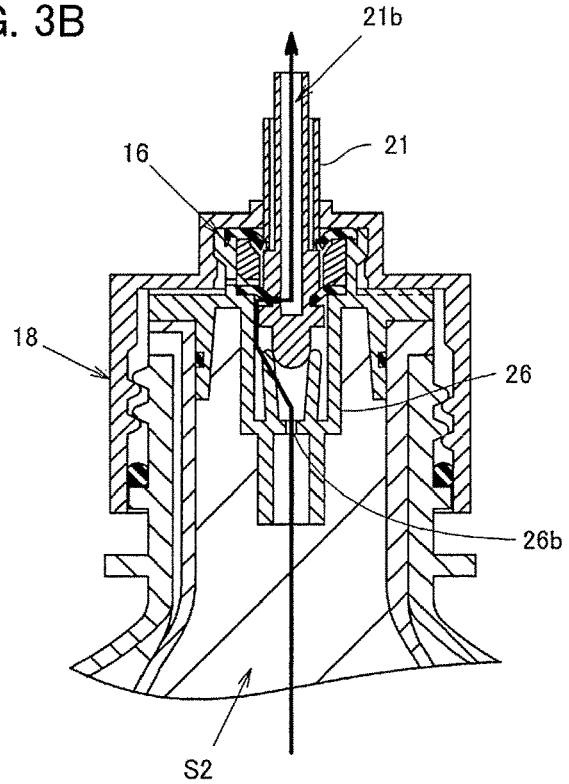
FIG. 3B is a partial cross-sectional view showing the discarded state of the discharge container of FIG. 1.

In this discharge container 10, the pressurizing chamber S2 and atmospheric air can be communicated by detaching the push button 14 from the valve assembly 13, and pushing down a stem 21 of a valve mechanism 16 (refer to FIG. 3B).

The outer container 11 is a pressure resistant container being transparent or translucent, inside of which is visible. In detail, it is a bottomed cylindrical pressure resistant container provided with a cylindrical body portion, a taper like shoulder portion, and a cylindrical neck portion. In the outer periphery of the neck portion, a screw 11*a* is formed. Below the screw 11*a*, a cylindrical outer seal holding portion 11*b* consisting of an outer cylindrical portion 11*b*1 and an annular protrusion 11*b*2 of the lower end thereof are formed. In this cylindrical outer seal holding portion 11*b*, an annular outer seal material A1 whose cross section is circular is held. The outer cylindrical portion 11*b*1 is a portion to compress the outer seal material A1 horizontally, the annular protrusion 11*b*2 is a portion to prevent the outer seal material A1 from dropping out from the outer cylindrical portion 11*b*1. Further, below the outer cylindrical portion 11*b*, an annular protrusion 11*c* is formed, which is for such as holding the outer container 11 when assembling the discharge container 10, and for hanging the outer container 11 when filling. The outer periphery shape of the annular protrusion 11*c* may be not only circular but also be shaped as being provided with a plane partially, for the prevention of the rotation of the discharge container 10, and further may be made to be rectangular.

Figure 5A:
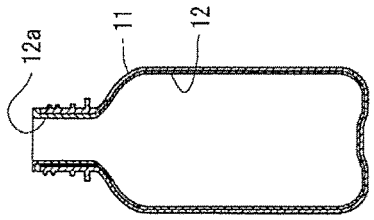
FIG. 5A-5H are side cross-sectional views showing the manufacturing method of the discharge container of FIG. 4.

The inner container 12 has substantially an identical shape with the inner surface of the outer container 11, and is a flexible bottomed cylindrical container provided with a cylindrical body portion, a taper like shoulder portion and a cylindrical neck portion (refer to FIG. 5A). The inner surface of neck portion of the inner container 12 is shaped to be an inner cylinder portion 12*a* compressing an inner seal A2 horizontally. The portion upper than the neck portion of this inner container 12 does not deform, the portion lower than the body portion has flexibility and deforms. The shoulder portion is composed so that the flexibility gradually becomes higher toward the body portion from the neck portion. In this embodiment, it gradually becomes thin toward the lower portion from the upper portion of the shoulder portion. The inner container 12 is transparent or translucent, of which the inside is made to be visible. In the upper end of the inner container 12, a flange portion 12*b* protruding outward is formed. The flange portion 12*b* is arranged in the upper end of the outer container 11. In the inner container 12, a plurality of longitudinal passage grooves 12*c* extending vertically, formed continuously in the upper outer surface of the shoulder portion is arranged annularly at an equal interval through the outer surface of the neck portion from the lower surface of the flange portion 12*b*.

In this embodiment, four longitudinal passage grooves 12*c* are provided. However, the number thereof is not particularly limited. Two to eight is preferable. Moreover, the longitudinal passage groove 12*c* may be sufficient as long as it is provided at least from the upper end of the inner container 12 to the non-deformable lower end of the neck portion. The longitudinal passage groove of the shoulder portion can be properly selected according to the flexibility (thickness) of the shoulder portion. This longitudinal passage groove 12*c* serves as a discharge passage of the content filled in the accommodating chamber S1 between the outer container 11 and the inner container 12. In addition, the longitudinal passage groove may be made to be provided in the upper surface of the neck portion, the inner surface of the neck portion and the shoulder portion of the outer container 11. Further, it may be made to be provided both in the inner surface of the outer container 11 and the outer surface of the inner container 12.

Such outer container 11 and inner container 12 are made so that an outer preform for the outer container in which the screw 11*a* is formed in the neck portion, and an inner preform for the inner container in which the flange portion 12*b* and the longitudinal passage groove 12*c* are formed in the neck portion are molded individually by injection molding etc. that the inner preform for the inner container is inserted into the outer preform for the outer container to prepare a two-layer preform. Then this two-layer preform is molded simultaneously into a portion lower than the shoulder portion of the outer container 11 and the inner container 12 by biaxial stretch blow molding etc. Thereby, the outer shape of the inner container 12 becomes a shape to be contactable with the inner surface of the outer container 11, in other words, a substantially identical shape with the inner surface of the outer container 11.

As the outer container 11, it is preferable to use thermoplastic synthetic resin such as polyethylene terephthalate, nylon. And, as the inner container 12, it is preferable to use thermoplastic synthetic resin such as polyethylene terephthalate, polyethylene, polypropylene. In addition, synthetic resin of the same quality of material may be used for the outer container 11 and the inner container 12, and synthetic resin of the different quality of material may be used for those. In this case, as the inner container 12, rubber or synthetic resin having elasticity may be used.

In addition, if the accommodating chamber S1 and the valve assembly 13 are communicated by a longitudinal passage formed between the outer container 11 and the inner container 12, the outer shape of the inner container 12 may be made to be a different shape to the inner surface of the outer container 11.

Figure 2A:
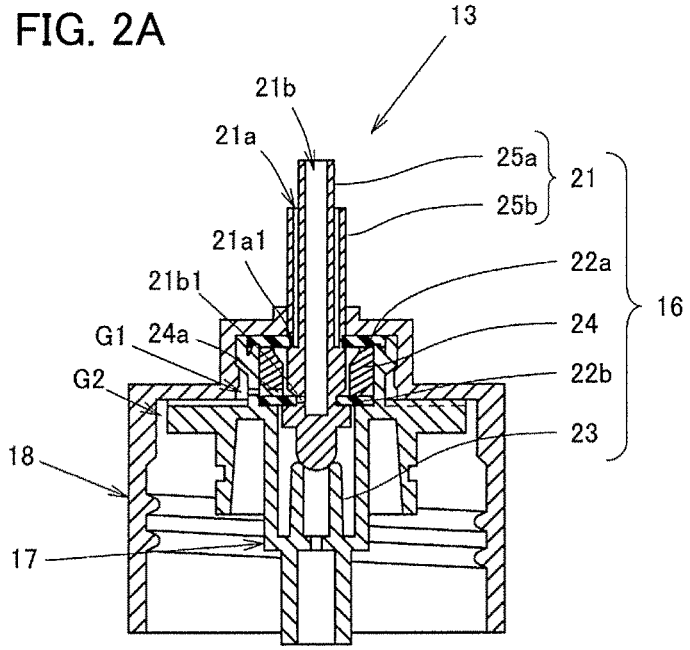
FIG. 2A-2D is respectively a cross-sectional view of the valve assembly of the discharge container of FIG. 1, a cross-sectional view of the valve holder, a cross-sectional view of the cap, and a cross-sectional view of the push button.

The valve assembly 13 is, as shown in FIG. 2A, provided with a valve mechanism 16 which lets through two fluids independently and shuts off/communicates those simultaneously, a valve holder 17 which closes the outer container 11 and the inner container 12, and a cap 18 which fixes the valve mechanism 16 to the inside of the valve holder, and fixes the valve holder 17 to the outer container 11.

The valve mechanism 16 comprises a stem 21 in which two independent first intra-stem passage 21*a* and second intra-stem passage 21*b*, and a first stem hole 21*a*1 and a second stem hole 21*b*1 respectively communicated with those passages are formed, an annular first stem rubber 22*a* closing the first stem hole 21*a*1, an annular second stem rubber 22*b* closing the second stem hole 21*b*1, an elastic body 23 energizing the stem 21 upward always, and a cylindrical support member 24 provided between the first stem rubber 22*a* and the second stem rubber 22*b* supporting those.

The stem 21 is that in which an inner cylindrical portion 25*a* and an outer cylindrical portion 25*b* whose lower end are closed are coaxially superimposed, the inner cylindrical portion 25*a* protrudes upper and also lower than the outer cylindrical portion 25*b*. And, an annular space between the inner cylindrical portion 25*a* and the outer cylindrical portion 25*b* composes the first intra-stem passage 21*a*, a columnar space in the inner cylindrical portion 25*a* coaxial with the first intra-stem passage 21*a* composes the second intra-stem passage 21*b*. The first stem hole 21*a*1 is a hole formed by penetrating the outer cylindrical portion 25*a* radially so as to communicate with the lower portion of the first intra-stem passage 21*a*. The second stem hole 21*b* is formed by penetrating the inner cylindrical portion 25*a* radially so as to communicate with the lower portion of the second intra-stem passage 21*b* in the lower portion than the first intra-stem hole 21*a* (in the inner cylindrical portion 25*a* protruding lower than the outer cylindrical portion 25*b*). Each outer end of the first stem rubber 22*a* and the second stem rubber 22*b* is supported to the inside of the valve holder 17 by a support member 24, the inner end plugs the first stem hole 21*a*1 and the second stem hole 21*b*1. And, the downward movement of the stem 21 makes the first stem hole 21*a* and the second stem hole 21*b* released from the inner ends of the first stem rubber 22*a* and the second stem rubber 22*b*.

In the support member 24, a slit 24*a* communicating the inside and the outside thereof is provided.

Figure 2B:
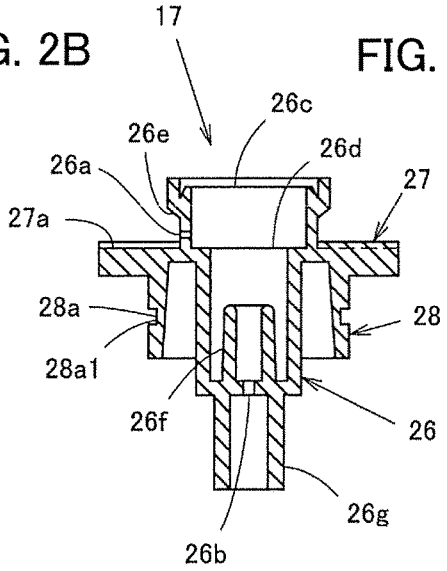

The valve holder 17 is, as shown in FIG. 2B, is that in which an intra-holder discharge passage R1 communicating the accommodating chamber S1 with atmospheric air and an intra-holder gas passage R2 communicating the pressurizing chamber S2 with atmospheric air are independently provided. In detail, it has a cylindrical housing 26, an annular flange 27 extending outward from the central side of the housing 26, and a cylindrical plug portion 28 provided coaxially outward to the housing 26 in the lower surface thereof.

The housing 26 has a first communicating hole 26*a* communicating the inside and the outside of the housing in the side surface, and has a second communicating hole 26*b* communicating the inside and the outside of the housing in the lower end. Moreover, in the upper end of the housing 26, a first rubber support portion 26*c* supporting the first stem rubber 22*a* of the valve mechanism 16 is formed, and a second stem rubber support portion 26*d* supporting the second stem rubber 22*b* of the valve mechanism 16 is formed between the first communicating hole 26*a* and the second communicating hole 26*b*, being the inner side surface.

Further, the upper periphery of the first communicating hole 26*a* of the housing 26 is expanded in diameter through a step portion 26*e*. And, in the bottom portion of the housing 26, a plurality of leaf springs 26*f* is provided so as to protrude upward. This leaf spring 26*f* composes an elastic body 23 of the valve mechanism 16 (refer to FIG. 2A). In this embodiment, four leaf springs are annularly arranged at an equal interval. A nonmetal valve assembly can be composed by molding the elastic body 23 integrally with the housing 26.

However, an independent spring may be arranged between the bottom portion of the housing 26 and the stem 21 of the valve mechanism 16. And, in the center of the bottom portion of the housing 26, a cylindrical portion 26*g* protruding downward, communicating with the second communicating hole 26*b* is formed. The inside of the housing 26 is divided into two spaces by the second stem rubber 22*b* of the valve mechanism 16. Stated differently, the inside of the housing 26 is divided into an upper space (a part of the intra-holder passage) between the first stem rubber 22*a* and the second stem rubber 22*b*, and a lower space (a part of the intra-holder gas passage) lower than the second stem rubber 22*b* (refer to FIG. 2A).

The annular flange 27 protrudes outward from the housing 26 between the first communicating hole 26*a* and the second communicating hole 26*b*. In the upper surface of the annular flange 27, a plurality of lateral passage grooves 27*a* is radially provided at an equal interval. This lateral passage groove 27*a* is made to be the same number as the longitudinal passage groove 12*c* of the inner container 12, and is provided so that the arrangement thereof is superimposed with the longitudinal passage groove 12*c* in a planar view.

The plug portion 28 is a cylindrical portion inserted along the inner surface of the neck portion of the inner container 12. In the lower side surface thereof, an annular inner seal holding portion 28*a* to hold the inner seal material A2 is formed. The bottom 28*a*1 of this inner seal material 28*a* compresses the inner seal material A2 horizontally.

Since the valve holder 17 is composed as described above, the intra-holder discharge passage is communicated with the housing 26 through the annular flange 27. In other words, it is communicated with the housing 26 so as to circumvent the annular flange 27 passing through inside the housing 26. Further in detail, it is composed of the upper space inside the housing 26, the first communicating hole 26*a*, and the lateral passage groove 27*a* of the annular flange 27. Meanwhile, the intra-holder gas passage is composed of the lower space inside the housing 26 and the second communicating hole 26*b* of the housing 26.

Figure 2C:
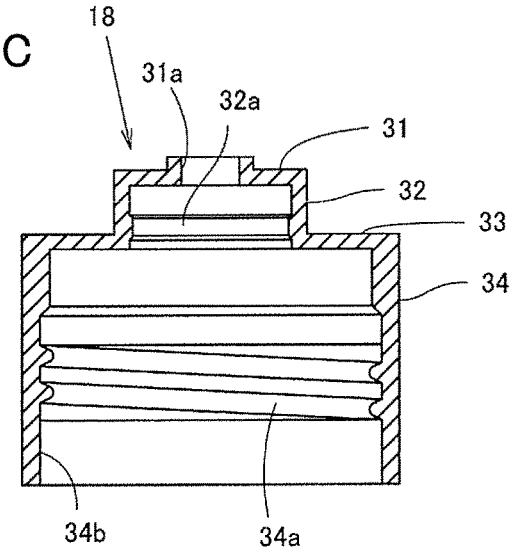

The cap 18 has, as shown in FIG. 2C, a circular plate like cover portion 31 closing the opening of the housing 26 of the valve holder 17, an upper cylindrical portion 32 arranged in the outer periphery of the housing 26 extending downward from the edge portion thereof, an annular ring portion 33 extending outward radially from the lower end thereof, and a lower cylindrical portion 34 extending downward from the outer end thereof.

The cover 31 is that which prevents the first stem rubber 22*a* from jumping upward. In the center of the cover 31, a center hole 31*a* which lets through the stem 21 is formed.

The upper cylindrical portion 32 is a portion which holds the housing 26 of the valve holder 17, and forms a discharge passage of the content across the housing 26. In the inner surface of the upper cylindrical portion 32, an engaging protrusion 32*a* engaging with the step portion 26*e* of the housing 26 is formed. By tucking the valve holder 17 between the cover 31 and the engaging protrusion 32*a*, the valve mechanism 16 is fixed to the valve holder 17 (housing 26) and holds the valve holder 17 (refer to FIG. 2A). In other words, the cap 18 and the valve holder 17 can be integrated. In addition, the lower inner surface (the inner surface lower than the engaging protrusion 32*a*) of the cylindrical portion 32 forms an annular gap G1 across the outer periphery of the housing 26 (refer to FIG. 2A). This gap G1 is communicated with the first communicating hole 26*a* of the housing 26, composing a discharge passage of the content.

The ring 33 is a portion to cover the upper surface of the annular flange 27 of the valve holder 17 so as to prevent the valve holder 17 from dropping off from the outer container 11. In addition, since in the annular flange 27, the lateral passage groove 27*a* is formed, a plurality of passages extending radially is formed between the ring 33 and the annular flange 27. This passage composes a discharge pass (intra-holder discharge passage) of the content, and is communicated with the gap G1.

The lower cylindrical portion 34 is a portion which is connected to the outer container 11, and composes a discharge passage of the content across the valve holder 17. The upper inner surface of the lower cylindrical portion 34 is designed so that the gap G2 is secured across the outer end of the annular flange 27 of the valve holder 17 (refer to FIG. 2A). In the middle inner surface of the lower cylindrical portion 34, a screw 34*a* engaging with the screw 11*a* of the outer container 11 is formed.

And, in a position of the outer seal holding portion 11*b* of the outer container 11, being the lower inner surface of the lower cylindrical portion 34 beneath the screw 34*a*, an inner cylindrical portion 34*b* somewhat expanded in diameter than the annular step portion 11*b*2 is formed. This annular cylindrical portion 34*b* is a portion compressing the outer seal material A1 radially across the outer cylindrical portion 11*b*1 of the outer container 11 (refer to FIG. 1).

Figure 2D:
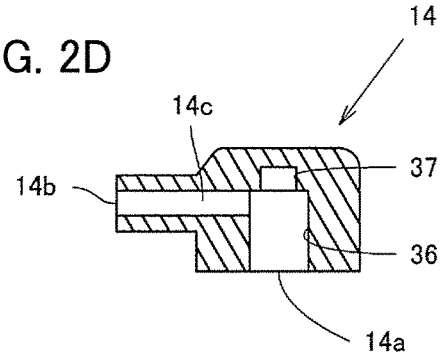

The push button 14 is, as shown in FIG. 2D, provided with a cylindrical stem engaging portion 14*a* formed in the lower surface, a discharge hole 14*b* provided in the front surface, and an intra-button passage 14*c* which communicates the stem engaging portion 14*a* and the discharge hole 14*b*.

The stem engaging portion 14*a* consists of a diameter-expanded hole 36 into which the outer cylindrical portion 25*b* of the stem 21 is inserted, and a diameter-reduced hole 37 into which the inner cylindrical portion 25*a* of the stem 21 is inserted, being provided in the upper portion thereof. The intra-button passage 14*c* is communicated with the upper portion of the diameter-expanded hole 36. And, the upper end of the diameter-reduced hole 37 is closed. The height of the diameter-reduced hole 37 is made to be smaller than the protruding amount in regard to the outer cylindrical portion 25*b* of the inner cylindrical portion 25*a* (refer to FIG. 1). Hence, when the stem 21 is inserted into the stem engaging portion 14*a*, the upper portion of the inner cylindrical portion 25*a* is arranged inside the diameter-reduced hole 37, the lower portion of the inner cylindrical portion 25*a* and the upper portion of the outer cylindrical portion 25*b* are arranged inside the diameter-expanded portion 36. Therefore, the upper end of the inner cylindrical portion 25*a* is closed by the upper end of the diameter-reduced portion 37, and the upper portion of the outer cylindrical portion 25*b* is communicated with the intra-button passage 14*c*, a space G3 surrounded by the diameter-expanded portion 36 and the inner cylindrical portion 25*a* is formed (refer to FIG. 1).

Next, the discharge passage of the content connecting the accommodating chamber S1 and atmospheric air excepting the push button 14, and the gas passage (gas filling passage and gas exhaust passage) connecting the pressurizing chamber S2 and atmospheric air are described referring to FIG. 3. The accommodating chamber S1 is, as shown in FIG. 3A, communicated with atmospheric air through the longitudinal passage groove 12*c*, the gap G2 between the lower cylindrical portion 34 and the valve holder 17, the intra-holder passage (the lateral passage groove 27*a* between the ring portion 33 of the cap 18 and the annular flange portion 27 of the valve holder 17, the gap G1 between the lower inner surface of the upper cylindrical portion 32 of the cap 18 and the outer periphery surface of the housing 26 of the valve holder 17, and the first communicating hole 26*a* of the housing 26, and the upper space of the housing 26) and the first intra-stem passage 21*a* of the stem 21 of the valve mechanism 16.

Meanwhile, the pressurizing chamber S2 is, as shown in FIG. 3B, communicated with atmospheric air through the intra-holder gas passage (the second communicating hole 26*b* of the housing 26 and the lower space inside the housing 26) and the second intra-stem passage 21*b* of the stem 21 of the valve mechanism 16.

Next, the seal structure of the discharge container 10 is described referring to FIG. 1. In this discharge container 10, the outer seal material A1 is provided between the outer container 11 and the valve assembly 13, the inner seal material A2 is provided between the inner container 12 and the valve assembly 13. In detail, the outer seal material A1 is compressed horizontally and held between the outer cylindrical portion 11b1 of the outer container 11 and the inner cylindrical portion 34b of the cap 18 of the valve assembly 13. And, the inner seal material A2 is compressed horizontally between the inner cylindrical portion 12a of the inner container 12 and the bottom 33a1 of the inner seal holding portion 33a of the plug portion 33 of the valve assembly 13. Stated differently, since the outer seal material A1 and the inner seal material A2 are compressed in a perpendicular direction to the axis of the outer container 11 and the inner container 12, the seal is formed regardless of the degree of fitting of the cap 18 to the outer container 11. Hence, even if the engaging of the cap 18 with the outer container 11 becomes loose due to an external force etc., the seal is never released, making the risk of spouting the content and the pressurizing agent little. In addition, as the outer seal material A1 and the inner seal material A2, it is preferable to use a ring like gasket (O ring).

The first aspect of the present invention is not limited to this seal structure. For example, as the discharge container 10a of FIG. 4, an annular plate seal material A3 may be provided between the flange portion 12b of the inner container 12 and the annular flange 27 of the valve holder 17. Or the inner seal material A2 may be replaced with the plate seal material A3.

And so forth, as long as the pressurizing chamber S2 can be sealed, it is not limited to the seal structure of the inner seal material A2. Moreover, the outer seal material 17 is also provided beneath the screw 11a, but it may be provided above the screw 11a. And so forth, as long as the gap between the outer container 11 and the cap 18 can be sealed, the seal structure of the outer seal material A1 is not limited. However, the seal structure of the discharge container 10 can reduce costs and is easy to assemble.

Next, the use method of the discharge container 10 is described. As the use method, by pushing down the push button 14, the content C can be discharged from the discharge hole 14b of the push button 14 (refer to FIG. 3A). In detail, by pushing down the stem 21 through the push button 14, the first stem hole 21a and the second stem hole 21b of the stem 21 are opened, the discharge passage of the content opens. However, since the closing portion (upper end of a diameter-reduced portion 37) of the push button 14 blocks the upper end opening of the second intra-stem passage 21b of the stem 21, only the passage of the content C of the valve assembly 13 is opened. In other words, the pressurizing agent P inside the inner container 12 (pressurizing chamber S2) presses the inner container 12 so as to expand, the accommodating chamber S1 is contracted, the content C is discharged from the discharge hole 14b from the accommodating chamber S1 through the discharge passage of the content. After discharging whole amount of the content C, the push button 14 is detached, the stem 21 is pushed down (refer to FIG. 3b). Thereby, the gas discharge passage is opened and the pressurizing agent P is exhausted from the pressurizing chamber S2. This discharge container 10 may be discarded in this state. However, by detaching the cap 18 from the outer container 11, each can be discarded separately.

Next, the manufacturing method of the discharge product using the discharge container 10 is described. From a double preform, the outer container 11 and the inner container 12 are prepared. Then, the valve holder 17 and the cap 18 are integrated. The integrated valve assembly 13 is fixed to the outer container 11 to assemble the discharge container 10. Then, in the state that the second intra-stem passage 21b of the stem 21 is closed, the stem 21 is pushed down to fill the content C in the accommodating chamber S1. After that, in the state that the first intra-stem passage 21a of the stem 21 is closed, the stem 21 is pushed down to fill the pressurizing agent P in the pressurizing chamber S2. In addition, before attaching the valve assembly 13 to the outer container 11, the content C may be filled in the accommodating chamber S1 from the opening of the longitudinal passage groove 12c.

As the content C, a content discharged in spray mist, a content discharged in foam, and a content discharged in creaminess or gel-like etc. can be cited. However, as the content C discharged in foam, it is preferable to use a uniform solution composed of a foaming agent dispersed uniformly in the content. In this case, since the foaming agent dispersed uniformly in the content expands the passage, it is possible to prevent the gap between the accommodating chamber S1 and the longitudinal passage groove 12c from being blocked by the inner container 12 expanding to make the outer surface of the inner container 12 and the inner surface of the outer container 11 contact precedently. Thereby, the content is preferably discharged to the last. This uniform solution exerts a similar effect, even if it is not used in the first aspect of the present invention (the eighth aspect of the present invention), as long as it is that in which a discharge container is provided with an outer container, an inner container, and a valve assembly, where the pressurizing agent P is filled in the pressurizing chamber of the inner container, the content C is filled in the accommodating chamber S1 between the outer container and the inner container.

As such uniform solution, that which shows an external appearance of transparent or translucent is preferable. The content may be aqueous solution or oily solution. The gauge pressure of the content C at 25° C. is preferable to be 0.01-0.3 MPa, further, 0.02-0.2 MPa. When the gauge pressure is lower than 0.01 MPa, the effect of expanding the passage from the composition accommodating chamber S1 to the longitudinal passage groove 17b becomes insufficient, there may be a case that the discharge is hard to be done. When the gauge pressure becomes higher than 0.3 MPa, the force becomes too strong causing the discharged foam is easy to be spattered.

As an example of the content in which a foaming agent is dispersed uniformly in the content, for example, the following four types can be cited.

[Content 1]

A composition composed of a surface-active agent 1-30% by mass, a monovalent alcohol 5-30% by mass, an oil dissolving in ethanol 1-10% by mass, an aqueous content 40-90% by mass, and a foaming agent 10-60% by mass can be cited. The content (1) is, regardless of containing the foaming agent so much as 10-60% by mass in the composition, since the aqueous content has a specific composition, the foaming agent is dispersed uniformly in the aqueous content, does not separate, and shows transparent or translucent appearance.

As the foaming agent, for example, propane, normal butane, isobutene, normal pentane, isopentane, and aliphatic hydrocarbon whose carbon number is 3-5 being a mixture of those (for example, LPG etc.), hydrofluoroolefin such as dimethyl ether, trans-1,3,3,3-tetrafluoroprop-1-ene and the mixture of those, of which the steam pressure (gauge pressure) is 0.1-0.5 MPa at 25° C. can be cited.

As the surface-active agent, for example, a nonionic surface-active agent, an anionic surface-active agent, a cationic surface-active agent, an amphoteric surface-active agent, a high-molecular surface-active agent, and a silicone surface-active agent can be cited.

As the monovalent alcohol, for example, monovalent alcohol of carbon number 2-5 such as ethanol, propanol, isopropanol, isobutyl alcohol, and amyl alcohol can be cited.

As the oil dissolving in ethanol, for example, silicone oil such as octamethyltrisiloxane, decamethyltetrasiloxane, octamethylcyclotetrasiloxane, decamethylcyclopentasiloxane, dodecamethylcyclohexasiloxane, and methylphenylpolysiloxane, ester oil such as isopropyl myristate, myristyl myristate, decyl oleate, lauric acid isostearyl, myristic acid isocetyl, myristic acid isostearyl, octyldodecyl myristate, octyl palmitate, octyl stearate, oleic acid octyldodecyl, ethyl isostearate, isooctane acid cetyl, dioctanate ethylene glycol, dioleate ethylene glycol, propylene glycol dicaprylate, dioleate propylene glycol, glyceryl tricaprylate, glyceryl caprylate, glyceryl tricaprinate/tricaprylate, glyceryl triisostearate, try2-ethyl hexane trimethylol propane, octyldodecyl neopentanoate, dimethyl octanoic acid hexadecyl, cetyl lactate, triethyl citrate, dioctyl succinate, adipic acid diisopropyl, and diethoxyethyl succinate, liquid hydrocarbon oil such as liquid paraffin, and isoparaffin, higher fatty acid such as laulic acid, myristic acid, palmitic acid, stearic acid, oleic acid, and isostearic acid, higher alcohol such as lauryl alcohol, cetyl alcohol, stearyl alcohol, myristyl alcohol, oleyl alcohol, lanolin alcohol, and isostearyl alcohol can be used. Moreover, it is preferable to contain a polyhydric alcohol 1-15% by mass in the aqueous content for enhancing the dispersity of the aqueous content and the foaming agent.

As the polyhydric alcohol, for example, divalent to trivalent polyhydric alcohol such as ethylene glycol, propylene glycol, 1-3 butylene glycol, and glycerin can be cited.

Further, it is preferable to contain effective ingredients in the content according to the purpose and the use of the discharge products. As the effective ingredients, for example, a styling agent, a moisturizing agent, an ultraviolet absorber, an amino acid, a vitamin group, an antioxidant, a various extraction liquid, an antiseptic/microbicide, a deodorant, a deodorization agent, an antiphlogistic analgetic, a refrigerant, an astringent, an anti-inflammatory agent, a local anesthetic, an antihistamine, a whitening agent, and a perfume can be cited.

[Content (2)]

A composition composed of an aqueous content 90-99.5% by mass containing an nonionic surface-active agent 1-50% by mass, of which the HLB is 13-17, and an aliphatic hydrocarbon 0.5-10% by mass, of which the carbon number is 3-5 can be cited. Since the content (2) contains an aqueous content containing a predetermined quantity of nonionic surface-active agent having a predetermined HLB and a predetermined foaming agent at a predetermined ratio, the foaming agent disperses uniformly in the aqueous content, does not separate, and shows transparent to translucent appearance. Particularly, by containing a divalent to trivalent polyhydric alcohol 5-50% by mass in the aqueous content, it is easy to obtain a transparent and uniform composition.

As the nonionic surface-active agent of which the HLB is 3-17, for example, polyglycerin fatty acid ester such as penta glyceryl monolaurate, penta glyceryl monomiristate, penta glyceryl monooleate, penta glyceryl monostearate, hexa glyceryl monolaurate, hexa glyceryl monomiristate, deca glyceryl monolaurate, deca glyceryl monomiristate, and deca glyceryl monooleate, polyoxyethylenesorbitan fatty acid ester such as POE sorbitan monooleate, POE sorbitan monopalmitate, POE sorbitan monostearate, POE sorbitan monooleate, and POE sorbitan monoisostearate, polyoxyethylene alkyl ether such as POE lauryl ether, POE cetyl ether, POE oleyl ether, and POE behenyl ether, poluoxyethylene/polyoxypropylene alkyl ether such as POE/POP cetyl ether, polyoxyethlene sorbit fatty acid ester such as POE sorbit tetrastearate, POE sorbit tetraoleate, and POE sorbit monolaurate, polyoxyethylene glycerin fatty acid ester such as POE glyceryl monostearate, and POE glyceryl monooleate, polyoxyethlene castor oil/hardened castor oil such as POE hardened castor oil/can be cited.

In addition, other than the nonionic surface-active agent, an anionic surface-active agent, a cationic surface-active agent, an amphoteric surface-active agent, and a polymeric surface-active agent, a silicone surface-active agent such as a polyoxyethylene/methyl polysiloxane copolymer can be added.

As the monovalent alcohol, the polyvalent alcohol, the foaming agent of the content (2), that which is similar with the content (1) can be used. Moreover, same as the content (1), it is preferable to contain effective ingredients.

[Content (3)]

A composition composed of an aqueous content 80-98% by mass containing an amino acidic surface-active agent 0.1-10% by mass and a monovalent alcohol of carbon number 2-3 25-60% by mass, and an aliphatic hydrocarbon (foaming agent) of carbon number 3-5 2-20% by mass can be cited. In the content (3), the foaming agent disperses in the aqueous content uniformly and does not separate, the content (3) showing transparent to translucent appearance.

As the amino acidic surface-active agent, for example, N-acyl glutamic acid salt such as N-coconut oil fatty acid acyl-L-glutamic acid triethanolamine, N-coconut oil fatty acid acyl-L-glutamic acid potassium, N-coconut oil fatty acid acyl-L-glutamic acid sodium, N-lauroyl-L-glutamic acid sodium, N-lauroyl-L-glutamic acid triethanolamine, N-lauroyl-L-glutamic acid potassium, N-lauroyl-L-glutamic acid sodium, N-myristoyl-L-glutamic acid potassium N-myristoyl-L-glutamic acid sodium, and N-stearoyl-L-glutamic acid sodium, N-acyl glutamic acid such as N-coconut oil fatty acid acyl-L-glutamic acid, N-lauroyl-L-glutamic acid, and N-stearoyl-L-glutamic acid, N-acyl glycine salt such as N-coconut oil fatty acid glycine potassium and N-coconut oil fatty acid glycine sodium, N-acyl alanine salt such as N-coconut oil fatty acid-DL-alanine triethanol amine can be cited.

As the monovalent alcohol, the foaming agent of the content (3), that which is similar with the content (1) can be used. Moreover, it is preferable to contain effective ingredients.

[Content (4)]

A composition composed of an oily content 85-99% by mass containing a surface-active agent 1-20% by mass and an oily base 50-99% by mass, and a foaming agent 1-15% by mass in the content can be cited.

As the surface-active agent, it is possible to use the nonionic surface-active agent similar with the content (1), particularly, it is preferable to use those in order to ease the foaming of the oily content; polyglycerol fatty acid ester such as monooleate diglyceryl, monostearate diglyceryl, monolaurate diglyceryl, monocaprylate diglyceryl, monolaurate hexadiglyceryl, monoomyristate hexaglyceryl, monolaurate pentaglyceryl, monomyristate pentaglyceryl, monooleate pentaglyceryl, monostearate pentaglyceryl hexastearate pentaglyceryl, trimyristate pentaglyceryl, trioleate pentaglyceryl, monolaurate decaglyceryl, monomyristate decaglyceryl, monostearate decaglyceryl, monoisostearate decaglyceryl, monooleate decaglyceryl, monolinoleic decaglyceryl, pentastearate decaglyceryl, and pentaoleate decaglyceryl.

As the oily base, similar with the content (1), such as ester oil, avocado oil, camellia oil, turtle oil, macadamia nut oil, corn oil, mink oil, olive oil, rapeseed oil, sesame oil, castor oil, linseed oil, safflower oil, jojoba oil, wheat germ oil, coconut oil, palm oil, and rice salad oil can be cited.

In addition, in the oily content, water 1-20% by mass, a monovalent alcohol 1-20% may be contained. Moreover, same as the content (1), it is preferable to contain effective ingredients.

As the foaming agent that which same as the content (1) can be used, but it is preferable to use that in which the steam pressure (gauge pressure) at 25° C. is 0.5-0.85 MPa so as to ease the foaming of the oily content.

As the pressurizing agent, a compressed gas such as carbon oxide, nitrogen monoxide, nitrogen, oxygen, air, and the mixture of those, liquefied gas such as liquefied petroleum gas, dimethyl ether and the mixture of those can be cited.

In addition, when using a uniform solution composed of a content and a foaming agent, it is preferable to use nitrogen gas, compressed air, carbon dioxide, nitrogen monoxide etc. Particularly, when using soluble compressed gas of which the solubility to a content is high such as carbon dioxide, nitrogen monoxide, it acts as a foaming agent when the pressurizing agent is permeated from the pressurizing chamber S2 to the composition accommodating chamber S1. Those are easy to foam even if the contained amount of the foaming agent is little, or the steam pressure of the foaming agent is low, which is preferable. In this case, for example, it is preferable that the pressure of the pressurizing agent is made to be 0.1-0.5 MPa. Stated differently, the steam pressure (gauge pressure) at 25° C. of the product pressure measured at the stem after filling the pressurizing agent is preferable to be 0.1-0.8 MPa so as to be 0.1-0.5 MPa higher than the steam pressure (gauge pressure) of the content before filling the pressurizing agent.

When the steam pressure of the product pressure after filling the pressurizing agent is lower than 0.1 MPa, the effect of filling the pressurizing agent becomes difficult to obtain. When the steam pressure of the product pressure after filling the pressurizing agent is higher than 0.8 MPa, the momentum during discharge becomes too strong, causing the discharged foam easy to spatter.

Figure 4:
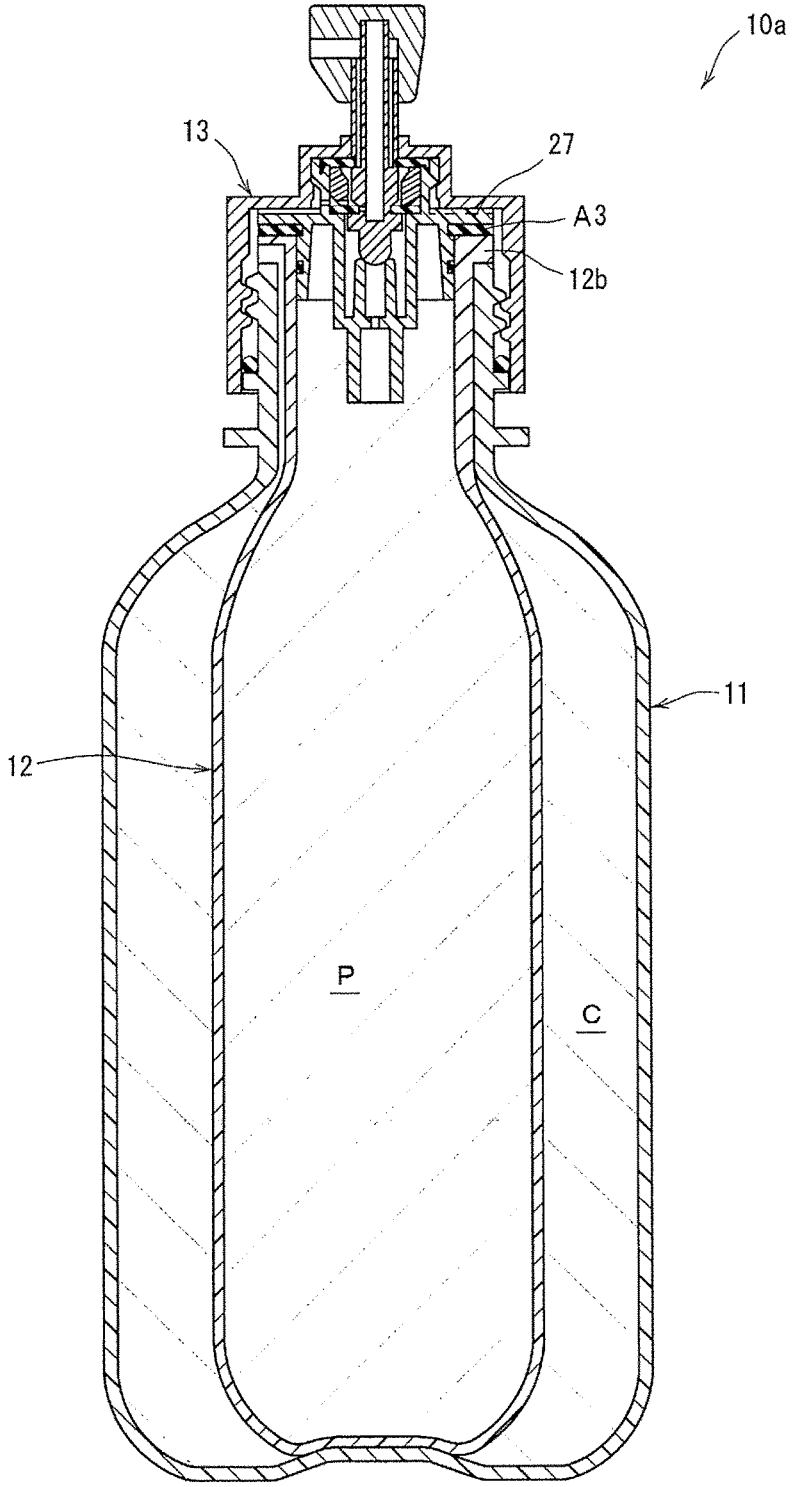
FIG. 4 A cross-sectional view showing the second embodiment of the discharge container of the present invention.

In the discharge container 10*a* of FIG. 4, the annular plate seal material A3 compressed vertically is provided between the upper surface of the flange portion 12*b* of the inner container 12 and the lower surface of the annular flange 27 of the valve assembly 13. Another composition is substantially same as the discharge container 10 of FIG. 1, and it has the outer container 11, the inner container 12 and the valve assembly 13. By providing the plate seal material A3 as described above, the plate material is compressed vertically by the fastening of the cap, the sealability of the pressurizing chamber in the inner container is further enhanced.

The manufacturing method of the discharge product using the discharge container 10*a* may be made to be same as that of the above described discharge container 10. In FIG. 5A-5H, another manufacturing method using the discharge container 10*a* is described. This manufacturing method is characterized in that before filling the content C and the pressurizing agent P, the inner container is contracted by inserting the guide member, after that the content C and the pressurizing agent P are filled (the seventh aspect of the present invention). Hence, it is sufficient to be a multilayer structured discharge container comprising the outer container and the inner container having approximately an identical shape with the inner surface of the outer container, having flexibility, being accommodated in the outer container, and a lid body (a valve assembly) closing the mouth portion of the outer container and the mouth portion of the inner container, even if being not used in the first aspect of the present invention, the similar effects can be obtained. The manufacturing method using the guide member can be adopted in any embodiment of the discharge container later described.

Next, using FIG. 5A-5H, it is described. First, same as the discharge container 10 of FIG. 1, a double preform consisting of the preform for the outer container 11 and the preform for the inner container 12 is prepared, by performing blowing (specifically biaxial stretch blowing) etc. the outer container 11 and the inner container 12 are simultaneously formed.

Figure 5B:
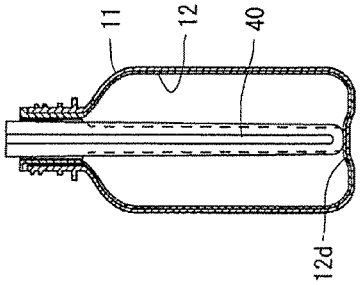

Next, as shown in FIG. 5B, the guide member 40 is inserted into the inner container 12. The guide member 40 is, as shown in FIG. 5 and FIG. 6, an approximately rod like hollow elastic body, the lower end of which is made to be contacted with the bottom portion 12*d* of the inner container 12. Moreover, in the outer periphery surface, a convex portion (longitudinal rib) 40*a* and a concave portion (longitudinal groove) 40*b* are regularly formed alternately. Further, in the vicinity of the upper end portion is made to be smaller than the inner diameter of the mouth portion (the inner cylindrical portion 12*a* of the neck portion) of the inner container 12, so that even in the state that the guide member 40 is inserted into the inner container 12, the inside of the inner container 12 and atmospheric air are maintained to be communicated.

Such guide member 40 is composed of an elastic material, for example, such as synthetic resin, silicone rubber.

Figure 5C:
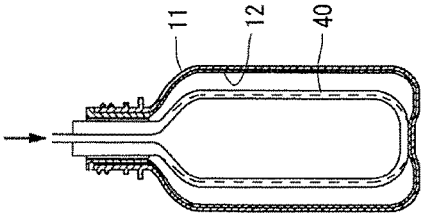
Figure 6:
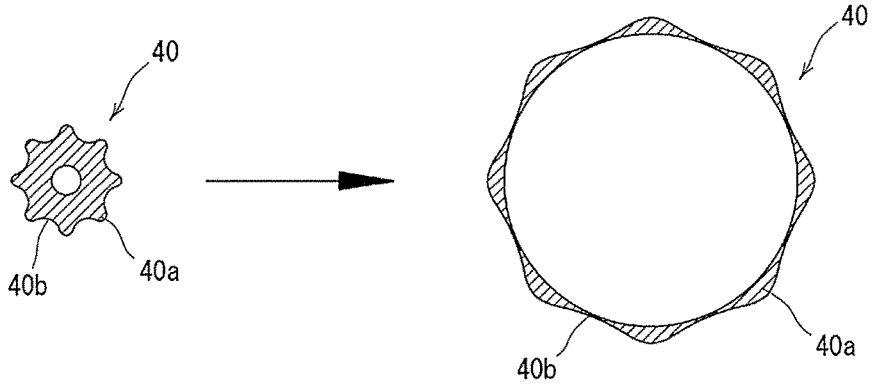
FIG. 6 A plane-sectional view of the guide member.
Figure 7A:
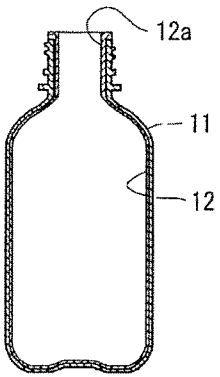
FIG. 7A-7F are side cross-sectional views showing further another embodiment of the manufacturing method of the discharge container of FIG. 4.
Figure 7B:
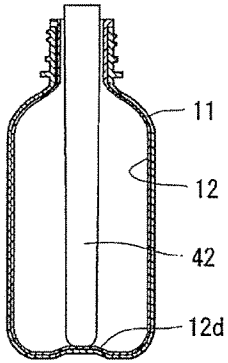
Figure 7C:
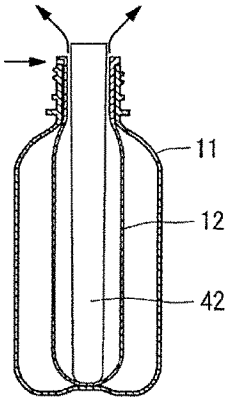
Figure 7D:
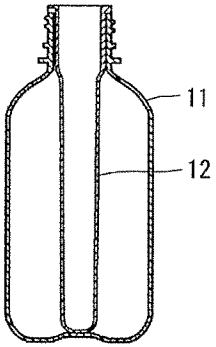
Figure 7E:
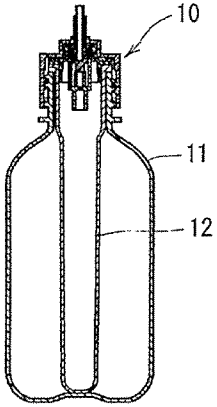
Figure 7F:
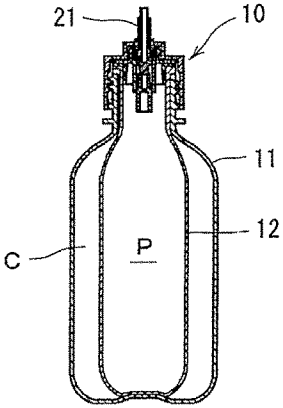

And, as shown in FIG. 5C, a supply and exhaust device etc. (not shown in the figure) is connected to the opening of the guide member 40, the guide member 40 is expanded to a degree not contacting the inner surface of the inner container 12.

Figure 5D:
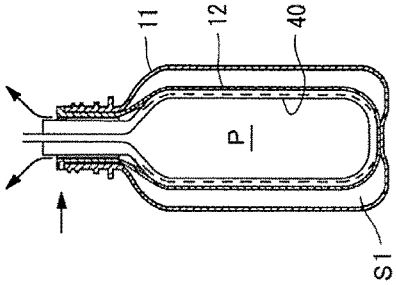

Next, as shown in FIG. 5D, a gas for contraction is filled in the accommodating chamber S1 through the longitudinal passage groove 12*c* of the inner container 12. When the gas is filled, the inner container 12 is contracted (contracted in the direction of reduced diameter), and contacts the outer surface of the guide member 40 expanded like a balloon. In addition, as the gas for contraction, that which is heated may be used. In this case, the inner container 12 is softened becoming easy to be contracted. The air in the inner container 12 is naturally exhausted to the exterior through the gap generated between the mouth portion (the inner cylinder portion 12*a* of the neck portion) and the guide member 40.

Figure 5E:
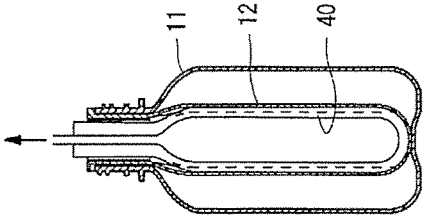

Moreover, as shown in FIG. 5E, along with the contraction of the inner container 12 by the filling of the gas for contraction, air is evacuated from the guide member 40 to make it gradually contract (deflate). On this occasion, it is preferable that the inner surface of the inner container 12 is made to maintain the state to be contacted with the outer surface of the guide member 40 without a gap, the inner container 12 being supported from inside. By doing in this way, the irregular contraction of the inner container 12 is suppressed, making it easy to be contracted/deformed along the shape of the guide member 40.

Figure 5F:
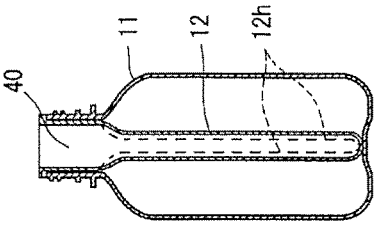

After contracting the guide member 40 completely, as shown in FIG. 5F, the guide member 40 is pulled out from the inner container 12. In addition, on this occasion, the inner container 12 is in the state that a regular slack 12*h* is formed along the irregularity provided in the outer periphery of the guide member 40, and this state is maintained.

Figure 5G:
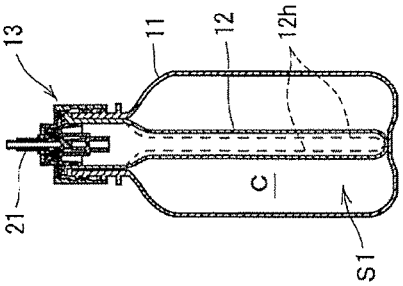
Figure 5H:
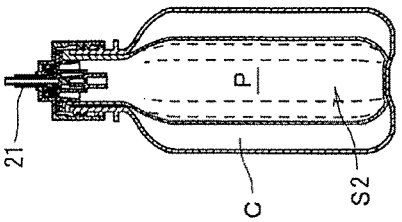

And, as shown in FIG. 5G, the valve assembly 13 is screwed to the outer container 11, the content C is filled in the accommodating chamber S1, the pressurizing agent P is filled in the inner container 12. The filling of the content C into the accommodating chamber S1 is carried out through the reversed root of the discharge passage of the content shown in FIG. 3A, by pushing downward the stem 21, in the state that the upper end of the second intra-stem passage 21*b* is closed. In this moment, since the inner container 12 is contracted, the passage to the accommodating chamber S1 is secured, the content C can be smoothly filled. Moreover, the filling of the pressurizing agent P in the inner container 12 is carried out through the reverse root of the gas exhaust passage shown in FIG. 3B, by pushing downward the stem 21, in the state that the upper end of the first intra-stem passage 21*a* is closed. In addition, before attaching the valve assembly 13 (FIG. 5F), the content C may be filled in the accommodating chamber S1 from the longitudinal passage groove 12*c*.

In addition, after filling the content C (FIG. 5G), the air in the inner container 12 before the filling of the pressurizing agent P can be exhausted through the discharge passage of the content by pushing downward the stem 21, in the state that the upper end of the second intra-stem passage 21*b* is closed (refer to FIG. 3B). The air in the accommodating chamber S1 can be exhausted by leaving the upper end of the second intra-stem passage 21*b* opened, before the pressurizing agent P is filled.

After filling the content C and the pressurizing agent P (FIG. 5H), the stem 21 is pushed down, in the state that the upper end of the second intra-stem passage 21*b* is closed, to exhaust the air remaining in the accommodating chamber S1, the accommodating chamber S1 is filled with the content C (to make it fluid-tight). Moreover, the removal of the content C and the pressurizing agent P remaining in the stem 21 is carried out to complete the manufacture of the discharge product.

In the manufacturing method described above, since the inner container 12 is contracted in the state that the guide member 40 is inserted into the inner container 12, the inner container 12 can be contracted along the guide member 40, the inner container 12 can be deformed into an intended shape. Hence, the variation between the products can be suppressed, further, it becomes also possible to fill the content C in the accommodating chamber S1 between the outer container 11 and the inner container 12 at an approximately uniform thickness. Moreover, since the irregularity is formed in the outer surface of the guide member 40, the slack 12*h* by the contraction of the inner container 12 can be provided in an intended portion. Hence, for example, even if the outer container 11 has translucency, it makes a good appearance, further, by the slack 12*h* formed regularly, such an effect can be generated that the inner container 12 is easy to restore the original shape.

Moreover, since the lower end of the guide member 40 contacts the bottom portion 12*d* of the inner container 12 before the contraction/deformation, such a deformation that the inner container 12 is raised, or the bottom portion 12*d* is rolled up can be suppressed, preventing the blocking of the longitudinal passage groove 12*c* by the shoulder portion of the inner container 12, allowing uniform filling of the content C in the accommodating chamber S1.

Further, when contracting/deforming the inner container 12 (to form the accommodating chamber S1 between the outer container 11 and the inner container 12), since the gas whose viscosity is much lower compared with the content C is used, the fear that the contraction/deformation converges in the vicinity of the longitudinal passage groove 12*c* of the inner container 12 is small, allowing simple and uniform contraction of the inner container 12. Moreover, since the method to contract the guide member 40 along with contraction of the inner container 12 is adopted, the inner container 12 becomes easy to be contracted along the guide member 40, allowing more simple contraction of the inner container 12.

The manufacturing method of FIG. 7 is characterized in that the guide member 42 is made to be a simple shape such as a columnar (rod-like) of which the cross section is, for example, circular, elliptic, polygonal.

Even in this case, the shape of the inner container 12 after contraction becomes approximately constant, making it possible to suppress the irregular contraction of the inner container 12. The manufacturing method is same as the method using the guide member 40 other than not having the process to inflate the guide member 40 and the process to deflate the guide member 40. Therefore the process drawings are shown in FIG. 7A-FIG. 7F, omitting specific description. In addition, in the present embodiment also, the lower end of the guide member 42 is formed to be spherical, preventing such a case that the guide member 42 resultantly break (resultantly penetrate) the bottom portion 12*d* during the contraction of the inner container 12.

Figure 8A:
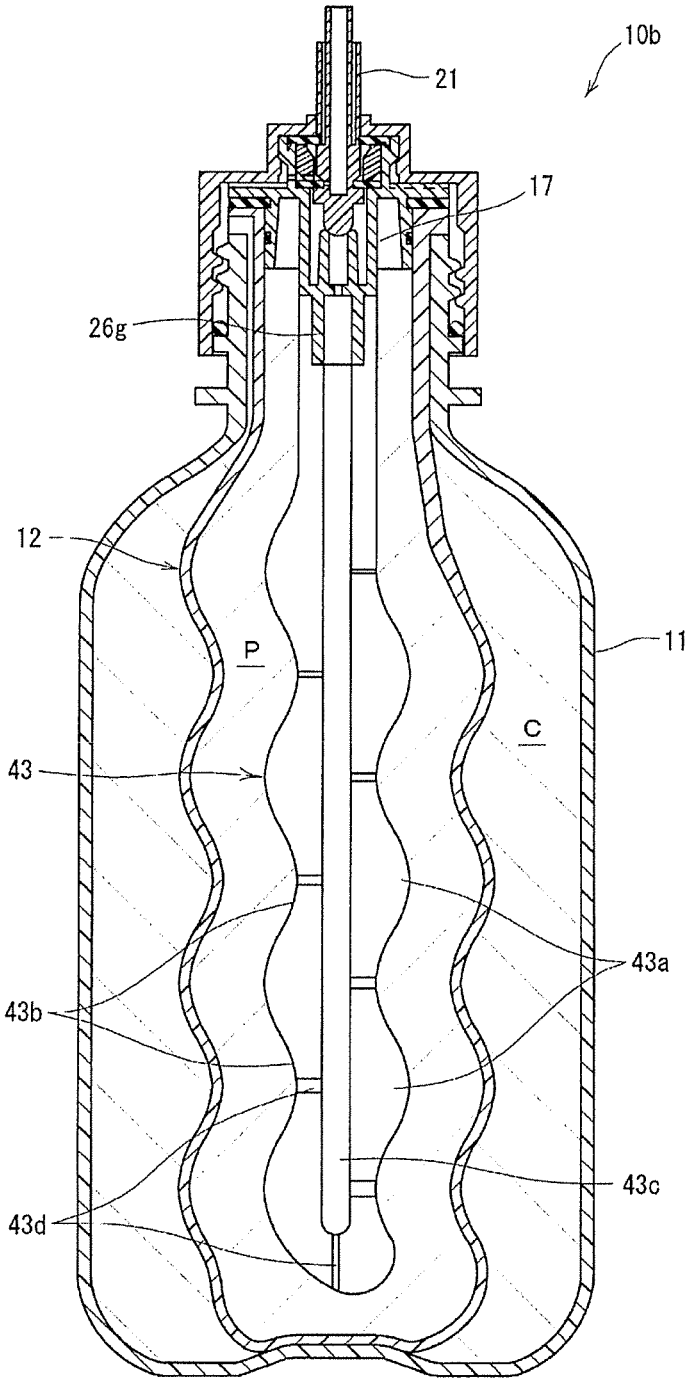
FIG. 8A is a cross-sectional view showing the third embodiment of the discharge container of the present invention.

The discharge container 10*b* of FIG. 8A is characterized in that a guide member 43 is attached to the lower end (the cylindrical portion 26*g*) of the valve holder 17. Another composition is substantially same as the discharge container 10*a* of FIG. 4. The guide member 43 of the discharge container 10*b* is, different to the guide member 40 of FIG. 5, not pulled out from the inside of the inner container 12, being left inside the inner container 12.

Figure 8B:
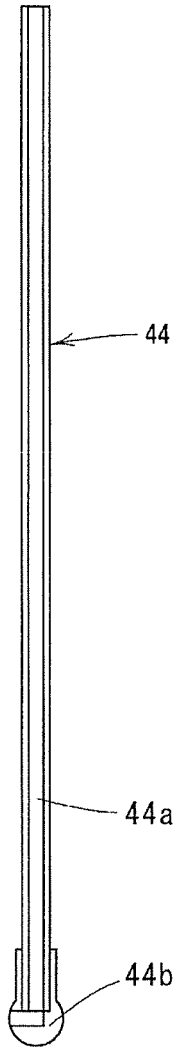
FIG. 8B is another embodiment of the guide member usable therein.

This guide member 43 is composed of hard resin, for example, such as polybutylene terephthalate, polyacetal, as shown in FIG. 8B, and is of a hollow rod-like shape, the lower portion of which is formed to be spherical, and a convex portion 43*a* and a convex portion 43 *b* are formed spirally, in the surface of which, a plurality of communicating holes 43*d* communicating the inside of the inner container 12 and a hollow portion 43*c* are formed so as to be along the concave portion 43*b*. The hollow portion 43*c* can be communicated with atmospheric air through the gas passage of FIG. 3B in the state being attached to the cylinder portion 26*g* of the housing 26 of the valve assembly 13. Hence, when the stem 21 is pushed downward, the inside of the inner container 12 and atmospheric air are communicated through the guide member 43.

In place of the guide 43, a guide member 44 of FIG. 8B may be used. The guide member 44 is characterized in that it is of a tubular shape, inside and outside of which is flat, having a hollow portion 44*a*, in the lower end thereof it has a spherical attachment 44*b* which makes the opening of the hollow portion 44*a* face laterally.

Figure 9C:
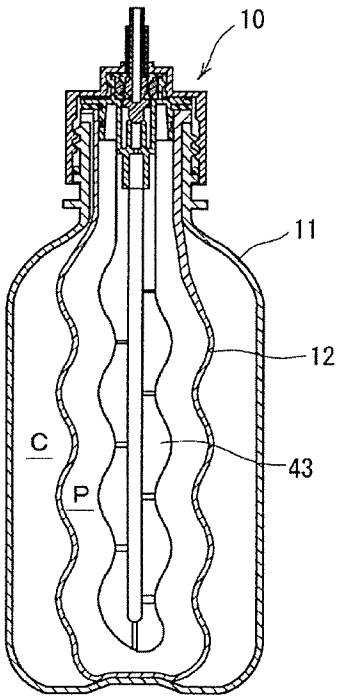
FIG. 9A-9C are cross-sectional views showing further another embodiment of the manufacturing method of the discharge container of FIG. 8A.

The manufacturing method thereof is described. First, as shown in FIG. 9A, for example, the outer container 11 and the inner container 12 are formed by molding a double preform using biaxial stretch blow molding etc. To the mouth portion of those containers, the valve assembly 13 to which the guide member 43 is attached is screwed. On this occasion, although the lower portion of the guide member 43 is not contacted to the bottom portion 12*d* of the inner container 12, but is positioned near the bottom portion 12*d*. Next, in the state that the stem 21 is pushed downward, a supply and exhaust device (not shown in the figure) such as a pump is connected to the second intra-stem passage 21*b*, the air inside the inner container 12 is drained through a suction gas passage consisting of the communicating hole 43*d* of the guide member 43 and the hollow portion 43*c*. Since the communicating hole 43*d* is formed so that the opening size becomes larger toward downward, in the lower side of the inner container 12 also, the pressure reduction is made to be carried out smoothly. In addition, on the occasion of the pressure reduction of the inner container, the upper end of the first intra-stem passage 21*a* is made to open, along with the contraction of the inner container 12, air is made to be supplied between the outer container 11 and the inner container 12. But, instead, it may be sufficient to fill a gas for contraction (heated gas may be sufficient).

Figure 9B:
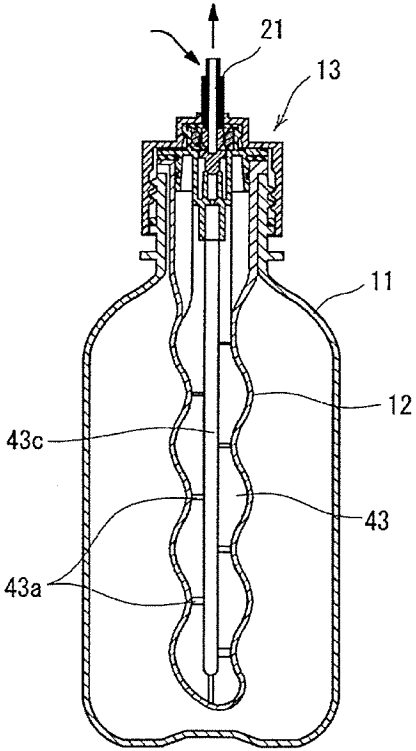
Figure 9A:
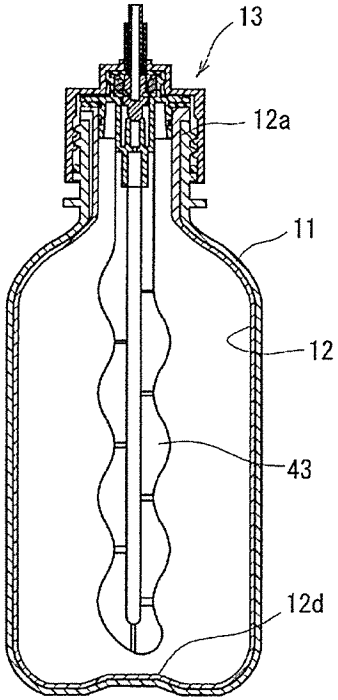

When the air in the inner container 12 is sufficiently drained, as shown in FIG. 9B, the inner container 12 deforms along the outer shape of the guide member 43. In other words, it becomes a shape in which concavity and convexity are spirally formed.

And, as shown in FIG. 9C, the manufacture of the discharge product 10*b* is completed by filling the content C in the accommodating chamber S1, filling the pressurizing agent P in the inner container 12, and exhausting the air in the accommodating chamber S1. In addition, the filling method is same as the embodiment described above. But, the point that the pressurizing agent P is filled in the inner container 12 through the hollow portion 43*c* of the guide member 43 and the communicating hole 43*d* is peculiar to the present embodiment.

In the manufacturing method of the discharge product using the discharge container 10*b*, since the contraction of the inner container 12 is carried out in the state that the valve assembly 13 is attached, it has a merit that there is no need to pay attention to the return of air to the inner container 12, allowing simple contraction work of the inner container 12. Moreover, since the guide member 43 is not taken out, the work process is simplified to that extent.

Figure 10:
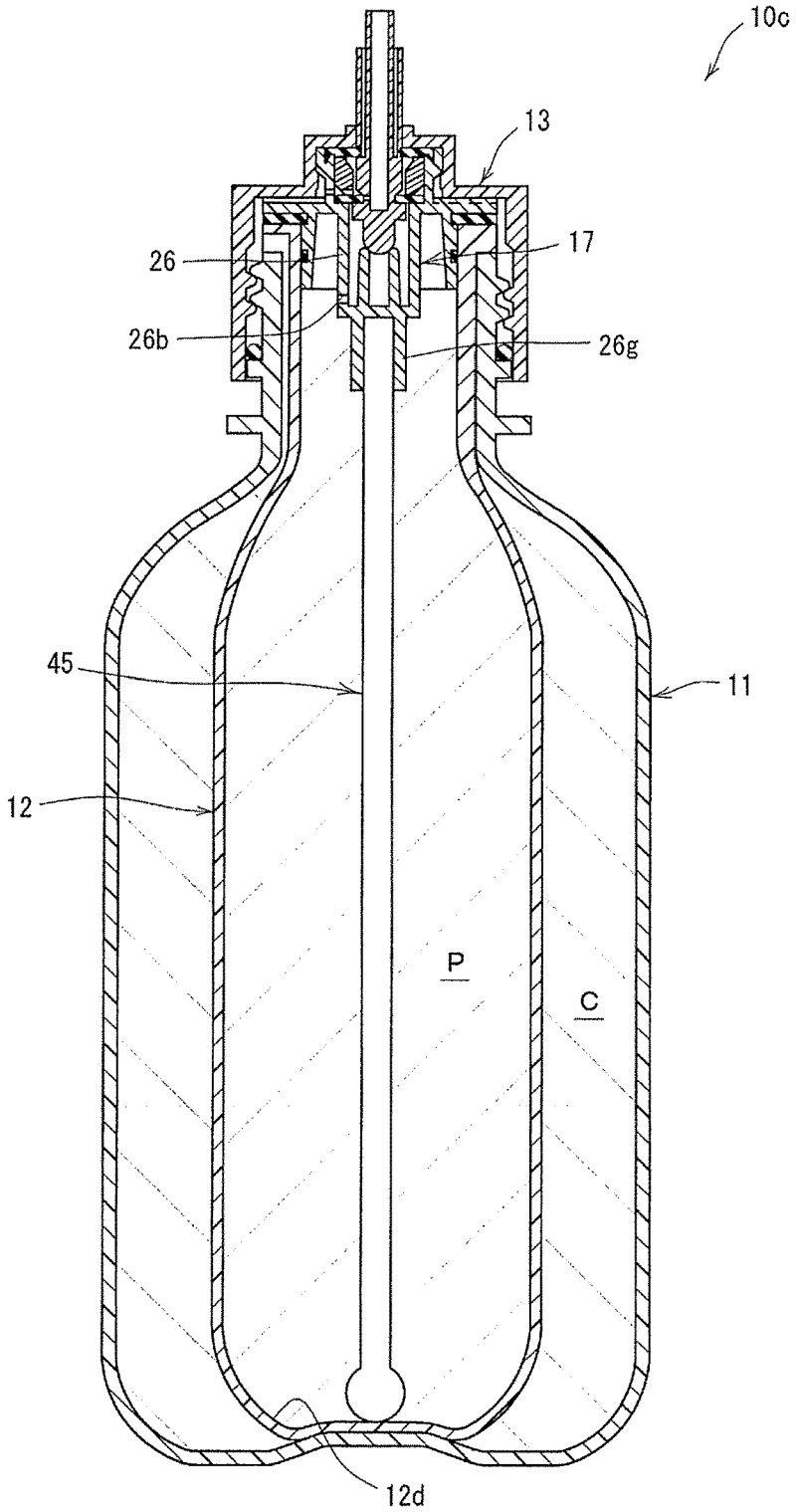
FIG. 10 A cross-sectional view showing the fourth embodiment of the discharge container of the present invention.

In the discharge container 10*c* of FIG. 10, a solid guide member 45 is attached to the lower end (the cylindrical portion 26*g*) of the valve holder 17, the second communicating hole 26*b* of the housing 26 is formed in the lower side surface of the housing 26. Another composition is substantially same as the discharge container 10*a* of FIG. 4. The guide member 45 of the discharge container 10*c* also is made to be left in the inner container 12 without being taken out from the inner container 12.

In such guide member 45 also, the deformation such as the inner container 12 being raised, and the deformation such as the bottom portion 12*d* being rolled up can be suppressed. Moreover, since the lower end is spherical, it is prevented that the guide member 45 resultantly breaks (penetrates) the bottom portion 12*d* of the inner container 12.

Figure 11:
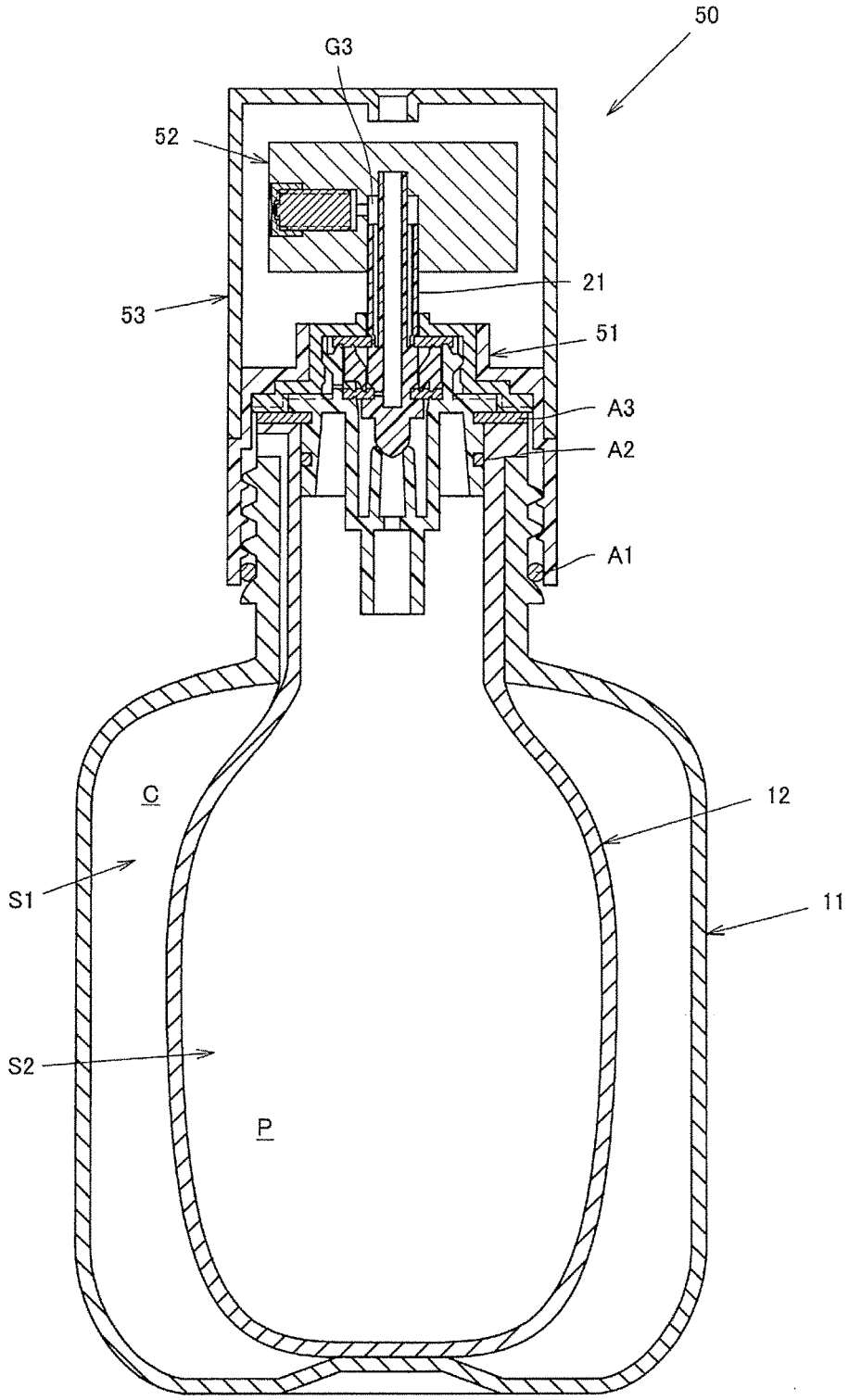
FIG. 11 A cross-sectional view showing the fifth embodiment of the discharge container of the present invention.

The discharge container 50 of FIG. 11 is that in which a protection cap 53 to assist the exhaust of the pressurizing agent is provided. In detail, it comprises the outer container 11, the inner container 12 accommodated in the outer container 12, a valve assembly 51 closing the outer container 11 and the inner container 12, and a push button (discharge member) 52 attached to the valve assembly 51. Moreover, to the valve assembly 51, the protection cap 53 to protect the stem 21 and the push button 52 of the valve assembly 51 are attached. Further, same as the discharge container 10*a* of FIG. 4, the annular plate seal material A3 is provided. In addition, the outer container 11 and the inner container 12 are substantially same as those of the discharge container 10 of FIG. 1.

Figure 12A:
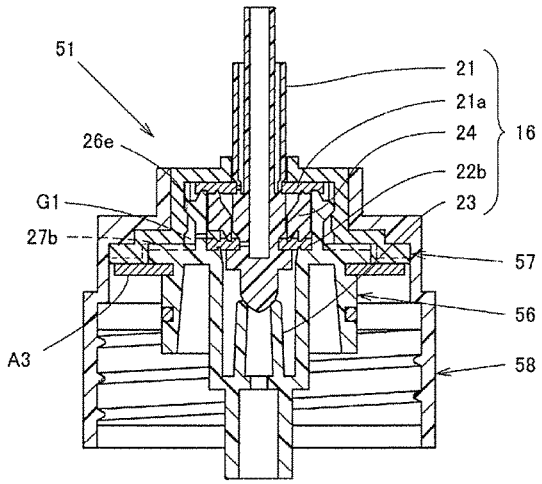
FIG. 12A-12E is respectively a cross-sectional view of the valve assembly of the discharge container of FIG. 11, a cross-sectional view of the valve holder, a plain view of the valve holder, a cross-sectional view of the valve cover, and a cross-sectional view of the cap.

A valve assembly 51 is, as shown in FIG. 12A, provided with the valve mechanism 16 which independently shuts off/communicates two fluids, a cylindrical valve holder 56 accommodating the valve holder 16, a valve cover 57 covering the valve holder 56 so as to fix the valve mechanism 16 to the inside of the valve holder 56, and a cap 58 which fixes the valve mechanism 16, the valve holder 56, and the valve cover 57 to the outer container 11. The valve mechanism 16 is substantially same as the discharge container 10 of FIG. 1.

Figure 12B:
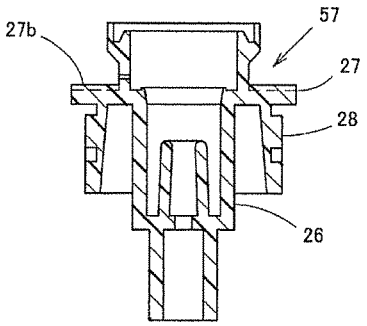
Figure 12D:
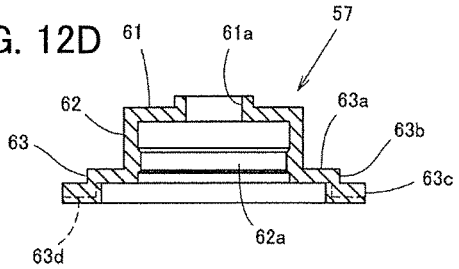
Figure 12C:
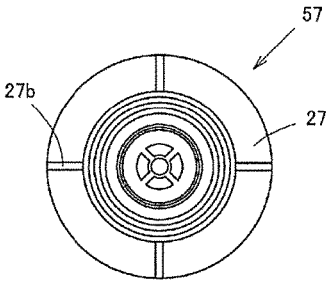

The valve holder 56 is different to the discharge container 10 of FIG. 1 in the point that a plurality of elongated protrusions 27*b*, not the lateral passage groove 27*a*, protruding upward is formed in the upper surface of the annular flange 27 as shown in FIG. 12B, 12C.

Another composition is substantially same as the discharge container 10 of FIG. 1, and is provided with the cylindrical housing 26, the annular flange 27, and the plug portion 28 provided coaxially outward to the housing. Between these elongated protrusions 27*b* serves substantially as the lateral passage.

The valve cover 57 is, as shown in FIG. 12D, provided with a canopy portion 61 closing the opening of the housing 26 of the valve holder 57, a cylindrical portion 62 extending downward from the edge portion thereof, arranged in the outer periphery of the housing 26, and an annular hem portion 63 extending outward radially from the lower end thereof. The valve cover 57 is communicated with the first communicating hole 26*a* of the housing 26 between the hem portion 63 and the annular flange portion 27 of the valve holder 56, and forms the lateral passage communicated with the accommodating chamber S1 through the longitudinal passage groove 12*c* of the inner container 12.

In the center of the canopy portion 61, a center hole 61*a* which let through the stem 21 of the valve mechanism 16 is formed.

In the inner surface of the cylindrical portion 62, an engaging protrusion 62*a* engaging with the step portion 26*e* of the housing 26 is formed. And, by tucking the valve holder 56 with the canopy portion 61 and the engaging protrusion 62*a*, the valve mechanism 16 is fixed to the valve holder 56 (the housing 26) and holds the valve holder 56 (refer to FIG. 12A). In addition, the lower inner surface of the cylindrical portion 62 (inner surface lower than the engaging protrusion 62*a*) forms the annular gap G1 with the outer periphery surface of the housing 26 (refer to FIG. 12A). This gap G1 is communicated with elongated protrusion 27*b* of the above described valve holder 56 (intra-discharge passage).

The hem portion 63 is provided with a first hem 63*a*, a step portion 63*b* extending downward from the end portion of the first hem 63*a*, and a second hem 63*c* extending outward radially from the lower end of the step portion 63*b*. The first hem 63*a* is arranged thereon so as to cover the annular flange portion 27 (the elongated protrusion 27*b*) of the valve holder 57 (refer to FIG. 12A). The second hem 63*c* is arranged thereon so as to cover the third seal material A3 (the flange portion 12*b* of the inner container 12) (refer to FIG. 12A). In addition, a plurality of downward grooves 63*d* formed continuously toward the lower surface of the second hem 63*c* is formed at an equal interval (refer to FIG. 3A, 3D).

Being composed as described above, the lateral passage between the hem portion 63 of the valve cove 57 and the annular flange 27 of the valve holder 56 is composed by (the gap G1) between the cylindrical portion 62 of the valve cover 57 and the housing 26 of the valve holder 56, between the first hem 63*a* and the flange portion 27 (the lateral passage between the elongated protrusions 27*b*), and between the lower surface of the second hem 63*c* and the third seal material A3 (the downward groove 63*d*).

In addition, the space (lateral passage) between the gap G1 and the elongated protrusion 27*b* may be communicated by extending the hem portion 63 of the valve cover 57 to the outer end of the third seal material A3.

Figure 12E:
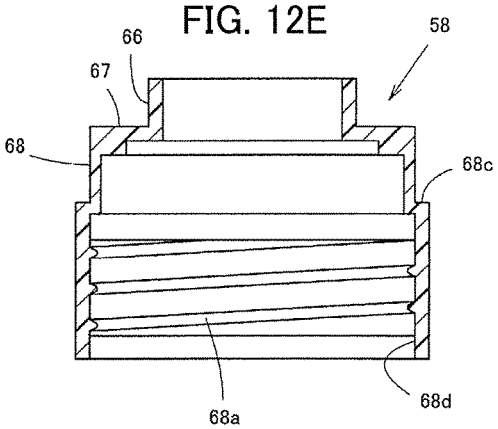

The cap 58 is, as shown in FIG. 12E, provided with an upper cylindrical portion 66 covering the outer periphery surface of the cylindrical portion 62 of the valve cover 57, an annular ring portion (pressing portion) 67 protruding radially outward from the lower end thereof, and a lower cylindrical portion 68 extending downward from the outer end thereof. The ring portion (pressing portion) 67 is arranged thereon so as to cover the hem portion 63 of the valve cover 57 (refer to FIG. 12A). The lower surface thereof is formed so as to contact the upper surface of the hem portion 63. The upper end of the upper cylindrical portion 66 is substantially made to be same height as the upper end of the cylindrical portion 62 of the valve cover 57. Hence, between the cap 58 and the valve cover 57 becomes an annular opening facing upward.

In the inner surface of the lower cylindrical portion 68, a screw 68*a* engaging with the screw 11*a* of the outer container 11 is formed. And, in the position of the annular protrusion 11*b*2 of the outer seal holding portion 11*b* of the outer container 11, being beneath the screw 68*a*, an inner cylindrical portion 68*b* somewhat diameter-expanded than the protrusion of the screw 68*a* is formed. This inner cylindrical portion 68*b* compresses the first seal material 16 radially across the outer cylindrical portion 11*b*1 of the outer container 11 (refer to FIG. 11). Moreover, in the upper outer periphery of the lower cylindrical portion 68, a protection cap engaging step portion 68*c* engaging with the protection cap 53 is formed.

For the valve holder 56, the valve cover 57, and the cap 53, it is preferable to use synthetic resin such as polyethylene terephthalate, nylon.

Thereby, the nonmetal valve assembly 51 can be constructed.

Figure 13A:
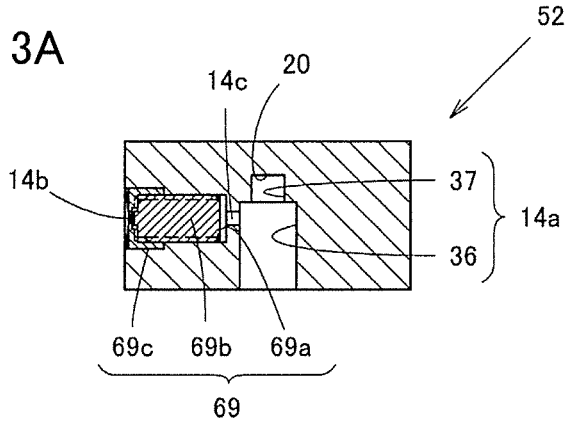
FIG. 13A, 13B is respectively a cross-sectional view of the push button and the protection cap of FIG. 11.

A push button 52 is, as shown in FIG. 13A, substantially same as the push button 14 of the discharge container of FIG. 1 other than that it is communicated with the intra-button passage 14*c* through a mechanical breakup mechanism 69 in the discharge hole 14*b*. In detail, a columnar core 69*b* is inserted into a nozzle inserting hole 69*a* formed in the front surface of the push button 14 so as to be communicated with the intra-button passage 14*c*, and a cup-like spray nozzle 69*c* in which the discharge hole 14*b* is formed in the center is attached to the front surface of the core 69*b*. Hence, the content passing through the intra-button passage 14*c* passes through the outer periphery of the core 69*b*, and passes through the groove of the rear surface of the spray nozzle 69*c*, goes to the discharge hole 14*b* while being given a turning force. However, another spray mechanism may be provided according to use.

As described above, the push button 14 is, by being attached to the stem 21 of the valve assembly 51, closes the opening of the second intra-stem passage 21*b* of the stem 21, the upper end surface 20 of the diameter-reduced hole 37 serves as a closing portion.

Figure 13B:
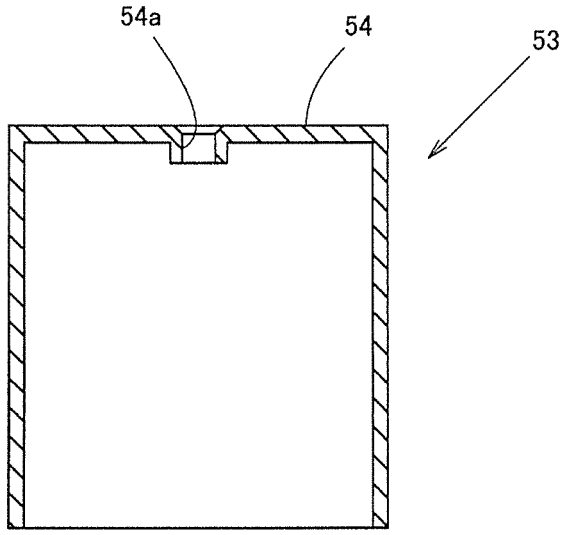

The protection cap 53 is, as shown in FIG. 13B, that which is cylindrical having a top surface 54. In the center of the top surface 54, the inner cylindrical portion 25*a* of the stem 21 can be inserted, and a stem inserting hole 54*a* for pressurizing agent exhaust locking the outer cylindrical portion 25*b* is formed. Hence, by turning inside out the protection cap 53 to insert the stem 21 into the stem inserting hole 54*a*, and pushing down the stem 21, the top surface 54 being the outer periphery edge of the stem inserting hole 54*a* engages with the upper end of the outer cylindrical portion 25*b*, the stem 21 can be pushed down, while closing the first intra-stem passage 21*a*.

Figure 14A:
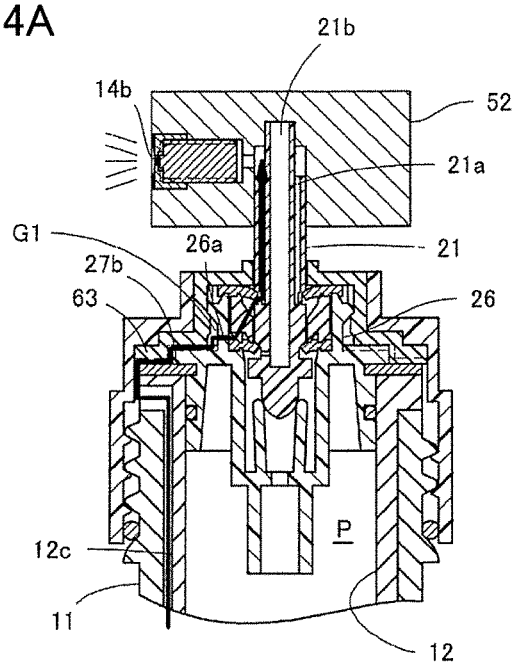
FIG. 14A, 14B is respectively a cross-sectional view of the use state and the discarded state of the discharge container of FIG. 11.

The double discharge container 50 composed as described above, same as the discharge container 10 of FIG. 1, can discharge the content C from the discharge hole 14*b* of the push button 52, by pushing down the push button 52 (refer to FIG. 14A).

Figure 14B:
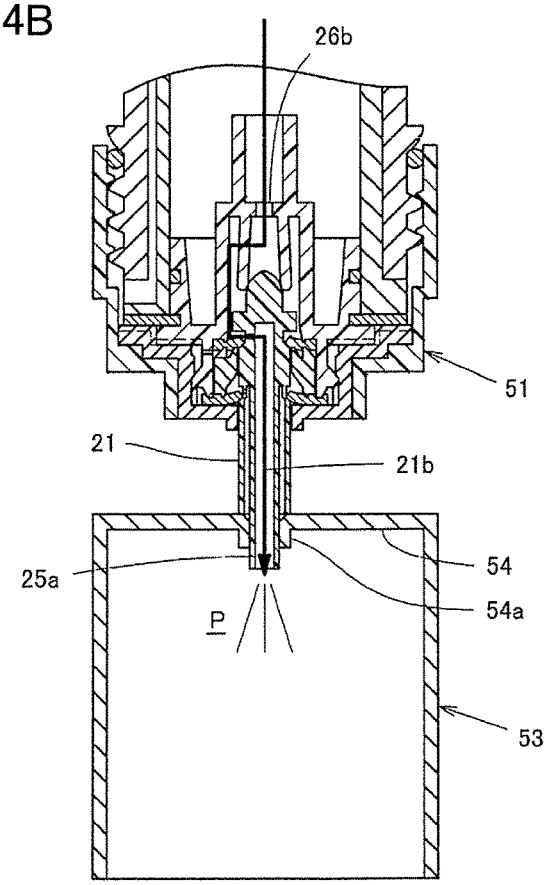

Meanwhile, when the discharge container 10 is discarded, the push button 52 is detached, as shown in FIG. 14B, the operation is carried out so that the inner cylindrical portion 25*a* of the stem 21 of the valve assembly 51 is inserted into the stem inserting hole 54*a* of the protection cap 53 of which the opening is placed facing downward. In this state, by pushing down the outer container 11, the pressurizing agent P can be exhausted downward. In this moment, since the top surface 54 of the protection cap 53 closes the upper end opening of the first intra-stem passage 21*a* of the stem 21, the pressurizing agent P in the inner container 12 (gas accommodating portion) only is exhausted from the stem 21. Since the first intra-stem passage 21*a* is closed, even if the content remains, it is not scattered. And, the pressurizing agent P is exhausted in the protection cap 53, preventing the scattering.

Here, the gas passage (intra-holder passage) of the valve assembly 13 consists of the cylindrical portion 26*g*, the second communicating hole 26*b*, the lower space of the housing 26 of the valve holder 56, and the second intra-stem passage 21*b* of the stem 21.

The discharge product using this discharge container 50 can be manufactured by any of the manufacturing method described above.

Figure 15A:
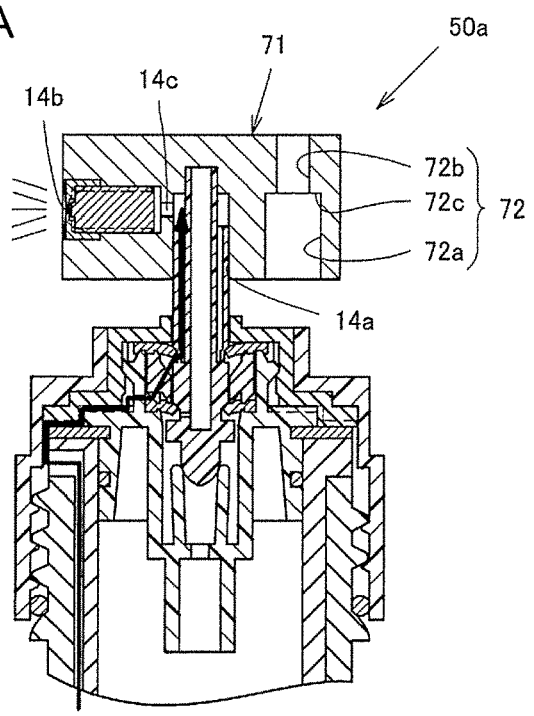
FIG. 15A, 15B are cross-sectional views showing the use state and the discarded state of the sixth embodiment the discharge container of the present invention.

The discharge container 50*a* of FIG. 15A is that in which an exhaust mechanism for pressurizing agent exhaust is provided in a push button 71. Another composition is substantially same as the double discharge container 50 of FIG. 11. FIG. 15A shows the use state of the discharge container 50*a*.

In the push button 71 of the double discharge container 50*a*, a stem hole 72 for pressurizing agent exhaust is formed. The stem hole 72 comprises a diameter-expanded hole 72*a* into which the outer cylindrical portion 25*b* of the stem 21 is inserted, a diameter-reduced hole 72*b* into which the inner cylindrical portion 25*a* of the stem 21 is inserted, being provided in the upper portion thereof, and a step portion 72*c* connecting the diameter-expanded hole 72*a* and the diameter-reduced hole 72*b*. The upper end of the diameter-reduced hole 72*b* is opened. Another composition is same as the push button 52 of the discharge container 50 of FIG. 11.

Figure 15B:
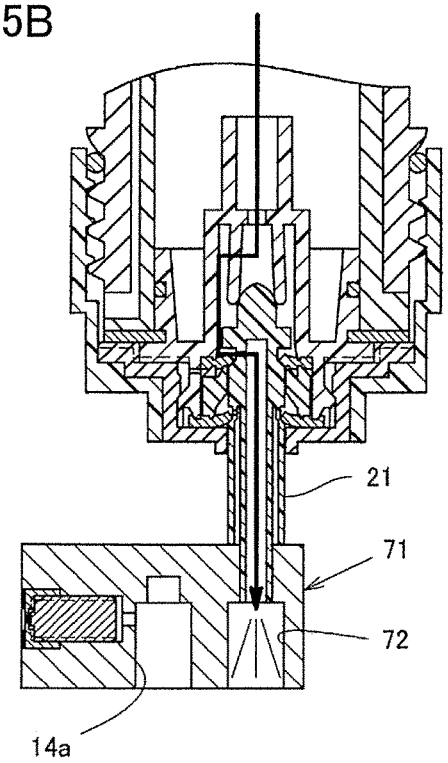

Being composed as described above, when discarding the discharge container 50*a*, as show in FIG. 15B, the push button 71 is detached from the stem 21, the push button 71 is placed so that the opening of the diameter-reduced hole 72*b* faces upward, the outer container 11 is turned upside down, the outer cylindrical portion 25*b* of the stem is inserted into the diameter-reduced hole 72*b* to engage the upper surface of the push button 72 and the upper end of the outer cylindrical portion 25*b*. In this state, by pushing down the outer container 11, the stem 21 is pushed down, the pressurizing agent P can be exhausted into the stem inserting hole 72 (switching operation). Moreover, even if the content remains, since the upper opening of the outer cylindrical portion 25*b* is closed by the upper surface of the push button 52, the content is never scattered.

In addition, the use state is substantially same as the discharge container 10 of FIG. 1, by pushing down the push button 71 in which the stem 21 is inserted into the stem engaging hole 14*a*, the content C is discharged from the discharge hole 14*b* (refer to FIG. 6A).

Figure 16A:
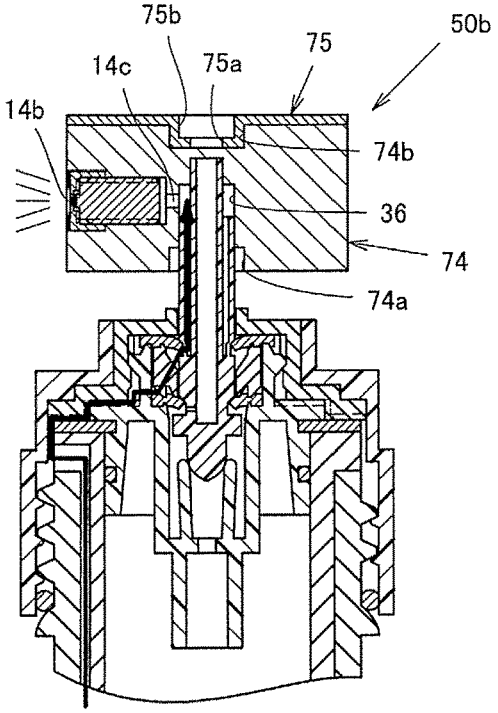
FIG. 16A, 16B are cross-sectional views showing the use state and the discarded state of the seventh embodiment the discharge container of the present invention.

The discharge container 50*b* of FIG. 16 is also that in which the discharge mechanism for pressurizing agent exhaust is provided in a push button 74. Another composition is substantially same as the discharge container 50 of FIG. 11. FIG. 16A shows the use state of the discharge container 50*b*.

To the push button 74 of the double discharge container 50*b*, an exhaust member 75 to assist the exhaust of the pressurizing agent is connected. In detail, in the upper surface of the push button 74, an exhaust member holding hole 74*b* to hold the exhaust member 75 is formed. Moreover, below the diameter-reduced hole 36 of the stem engaging hole 14*a*, an exhaust member engaging hole 74*a* further expanded in diameter is formed. Another composition is substantially same as the push button 52 of the double discharge container 50 of FIG. 11, and it is provided with the discharge hole 14*b* and the intra-button passage 14*c*.

The exhaust member 75 is that which is of flat plate-like, a recessed portion 75*b* in which a center hole 75*a* is provided is formed. The center hole 75*a* has a dimension (shape) letting through the inner cylindrical portion 25*a*, and a dimension (shape) not letting through the outer cylindrical portion 25*b*, the recessed portion 75*b* has a dimension (shape) letting through the outer cylindrical portion 25*b*. The recessed portion 75*b* of the exhaust member 75 protrudes in the view from the back, and the protruding portion (the rear side of the recessed portion 75*b*) is engaged with the exhaust member holding portion 74*b* of the push button 74, and is held.

Figure 16B:
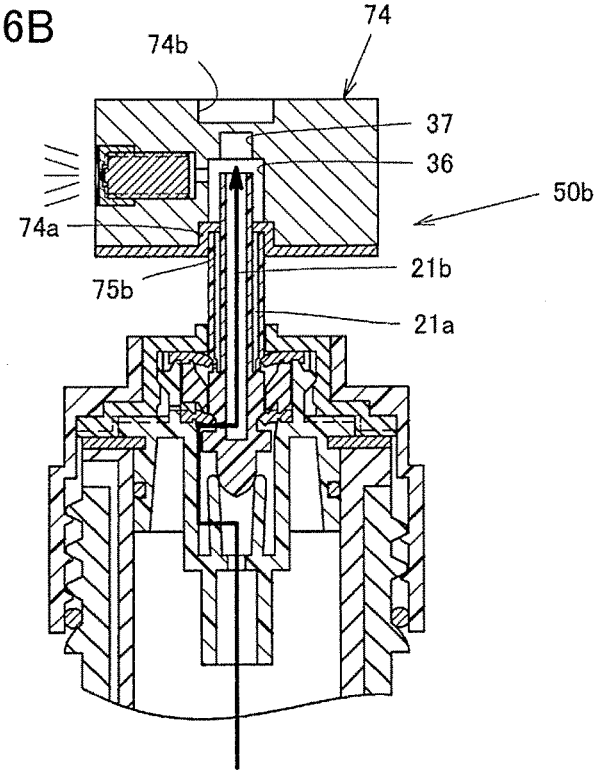

Being composed as described above, when discarding the double discharge container 50*b*, as shown in FIG. 16B, the exhaust member 75 is detached from the push button 74, the rear surface of the recessed portion 75*b* is inserted into the exhaust member engaging hole 74*a* of the stem engaging hole 14*a* so that the recessed portion 75*b* faces downward, the stem 21 is inserted into the push button 74 being in this state (switching operation). Thereby, the upper end of the inner cylindrical portion 25*a* is not inserted into the diameter-reduced hole 37 of the push button 74, the second intra-stem passage 21*b* is not closed. Meanwhile, the recessed portion 75*b* of the exhaust member 75 closes the upper end opening of the outer cylindrical portion 25*b*, the first intra-stem passage 21*a* is closed. Hence, by pushing down the push button 74 in this state, the pressurizing agent P can be exhausted from the discharge hole 14*b*. In addition, the use state is substantially same as the discharge container 50 of FIG. 11, by pushing down the push button 74 in which the exhaust member 75 is attached to the exhaust member holding hole 74*b*, the content is discharged from the discharge hole 14*b* through the first intra-stem passage 21*a*.

Figure 17:
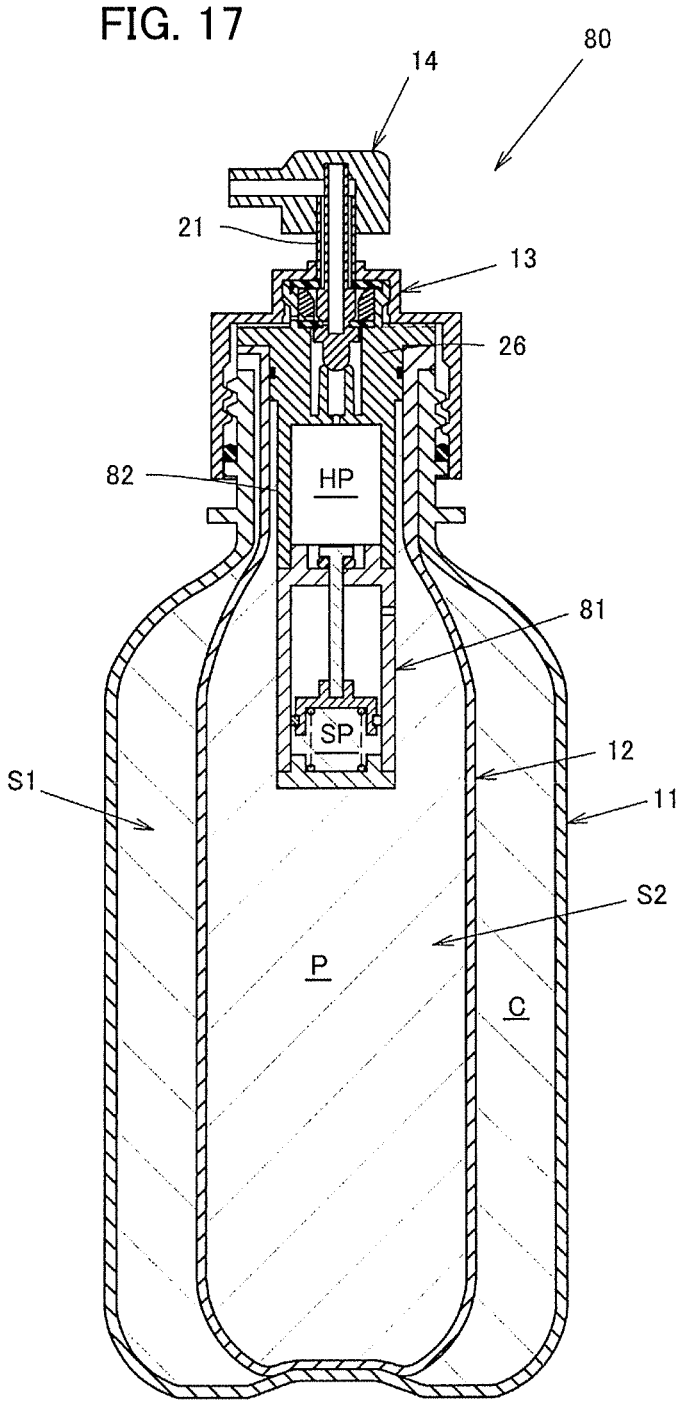
FIG. 17 A cross-sectional view showing the eighth embodiment of the discharge container of the present invention.

The discharge container 80 of FIG. 17 is that in which a pressure adjusting mechanism 81 to adjust the inner pressure of the inner container 12 is provided. In detail, it is provided with the outer container 11, the inner container 12 accommodated therein, the valve assembly 13 closing the outer container 11 and the inner container 12, fixed by being engaged with the outer periphery of the outer container, and a pressure adjusting mechanism 81 accommodated in the inner container 12 to adjust the inner pressure of the inner container 12.

In this discharge container 80 also, the content C is filled in the accommodating chamber S1 between the outer container 11 and the inner container 12, and the pressurizing agent P is filled in the pressurizing chamber S2 inside the inner container. And, it is used by attaching the push button 14 to the valve assembly 13. And, by detaching the push button 14 from the valve assembly 13, and pushing down (switching operation) the stem 21 of the valve mechanism 16, the pressurizing chamber S2 and the atmospheric air can be communicated.

In the discharge container 80, the outer container 11, the inner container 12, the push button 14 are substantially same as those of the discharge container 10 of FIG. 1. The valve assembly 13 is also same as the valve assembly 13 of the discharge container 10 of FIG. 1, other than the point that a cylindrical high pressure chamber 82 of the pressure adjusting mechanism 81 is provided in the lower end of the housing 26 of the valve holder 17 of the valve assembly 13.

Figure 18A:
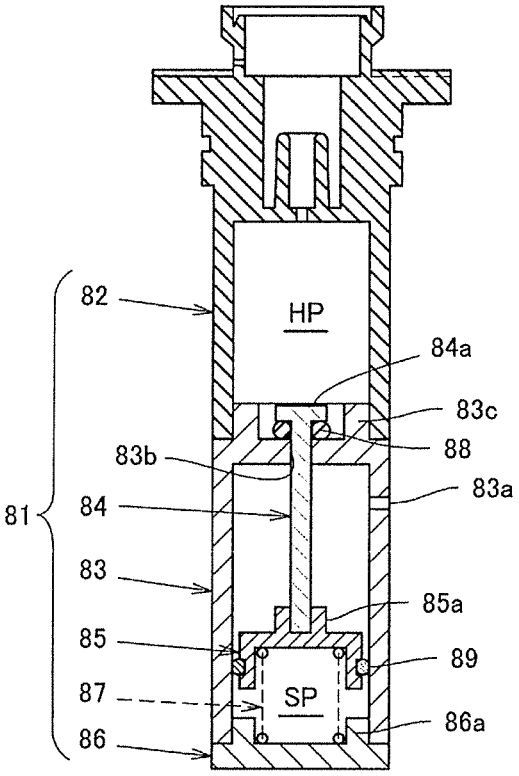
FIG. 18A, 18B is respectively a cross-sectional view showing the pressure adjustment mechanism, the operating state of the discharge container of FIG. 17.
Figure 18B:
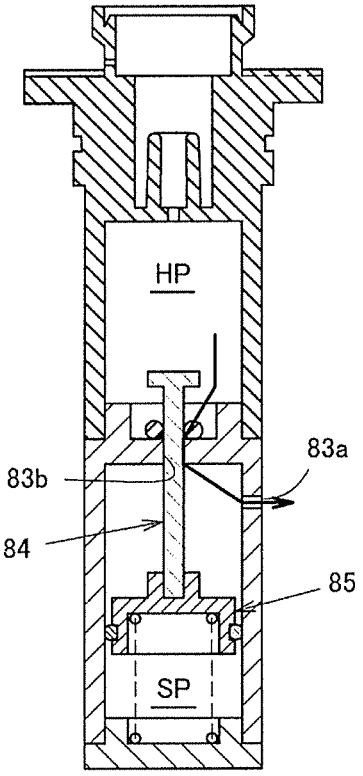

The pressure adjusting mechanism 81 is, as shown in FIG. 18A, provided with a cylindrical high pressure chamber body 82, a cylindrical cylinder portion 83 closing the lower end thereof, a valve rod 84 which communicates/shuts off between the high pressure chamber body 82 and the cylinder portion 83, a piston 85 interlocked with the valve rod 84, being accommodated inside the cylinder portion 83, a lower lid portion 86 closing the lower end of the cylinder portion 83, and a spring 87 provided between the piston 85 and the lower lid portion 86.

In the pressure adjusting mechanism 81, the inside of the high pressure body 82 serves as a high pressure chamber HP, between the piston 85 inside the cylinder portion 83 and the lower lid portion 86 serves as a reference pressure chamber SP, the valve rod 84 serves as a valve. And, the pressure inside the reference pressure chamber is adjusted by the inner pressure of the reference pressure chamber and the force of the spring 87 pressing the piston 85. In addition, not providing the spring 87, it is sufficient that the inner pressure of the reference chamber is made to be constant.

The high pressure chamber body 82 is a cylindrical body provided coaxially with the housing 26 in the lower end of the housing 26 of the valve assembly 13, and is communicated with the lower space of the housing 26 through the second communicating hole 26*b*. In this discharge container 80, the high pressure chamber body 82 is formed integrally in the lower end of the housing 26. However, it may be made to be separate members and to be connected.

The cylinder portion 83 is a cylindrical body having an upper bottom for closing the lower end of the high pressure chamber body 82. In the side surface, a gas communicating hole 83*a* is formed. In the center of the upper bottom, a center hole (gas supply hole) 83*b* is formed, in the upper surface of the upper bottom, a cylindrical engaging portion 83*c* closing the high pressure chamber body 82, being inserted inside the high pressure chamber body 82 tightly is provided.

The valve rod 84 is a rod body inserted into the center hole 83*b* of the cylinder portion 83, in the upper end of which a circular plate like clasping portion 84*a* is provided. A ring like valve seal 88 is provided between the lower surface of the clasping portion 84*a* and the upper bottom of the cylinder portion 83. Stated differently, when the valve rod 84 descends, the clasping portion 84*a* of the valve rod 84 presses the upper bottom of the cylinder 83 through the valve seal 88, thereby the center hole 83*b* is closed. Meanwhile, when the valve rod 84 ascends, the compression to the valve seal 88 by the clasping portion 84*a* is released, opening the center hole 83*b*. The piston 85 is that which is plate-like, and moves vertically on the inner surface of the cylinder portion 83 contacting tightly.

In the upper surface, a valve engaging portion 85*a* engaging with the lower end of the rod body of the valve rod 84 is formed. The lower surface receives the spring 87. In the side surface, a ring like seal material 89 is provided. In other words, by the vertical movement of the piston 85 inside the cylinder portion 83, the reference pressure chamber SP is compressed/expanded. The lower lid portion 86 is a member to close the lower end of the cylinder portion 83 tightly. In the upper surface, a cylindrical engaging portion 86*a* inserted inside the cylinder portion 83 tightly, closing the lower end opening of the cylinder portion 83 is formed. The upper surface of the lower lid portion 86 receives the spring 87.

The pressure adjusting mechanism 81 composed as described above operates depending on the difference of the pressing force to the piston 85 by the inner pressure of the reference pressure chamber and the spring, and the pressing force to the piston 85 by the pressure of the inner container 12 (the pressurizing chamber S2).

In detail, when the pressing force from the reference pressure chamber SP becomes larger than the pressing force from the inner container 12, the piston 85 moves so as to expand the reference pressure chamber SP, in other words, the piston 85 ascends (refer to FIG. 8B). Hence, the valve rod 84 ascends, the pressurizing agent P in the high pressure chamber HP is supplied to the inside of the inner container 12 through the center hole 83*b* and the gas communicating hole 83*a*. Meanwhile, when the pressing force from the inner container 12 becomes strong by the supply of the pressurizing agent P inside the inner container 12, the piston 85 moves so as to contract the reference pressure chamber SP. In other words, the piston 85 descends. Thereby, the valve rod 84 descends, the valve seal 88 between the clasping portion 84*a* of the valve rod 84 and the upper bottom of the cylinder portion 83 is compressed, the center hole 83*b* is shut off (refer to FIG. 18A).

Figure 19A:
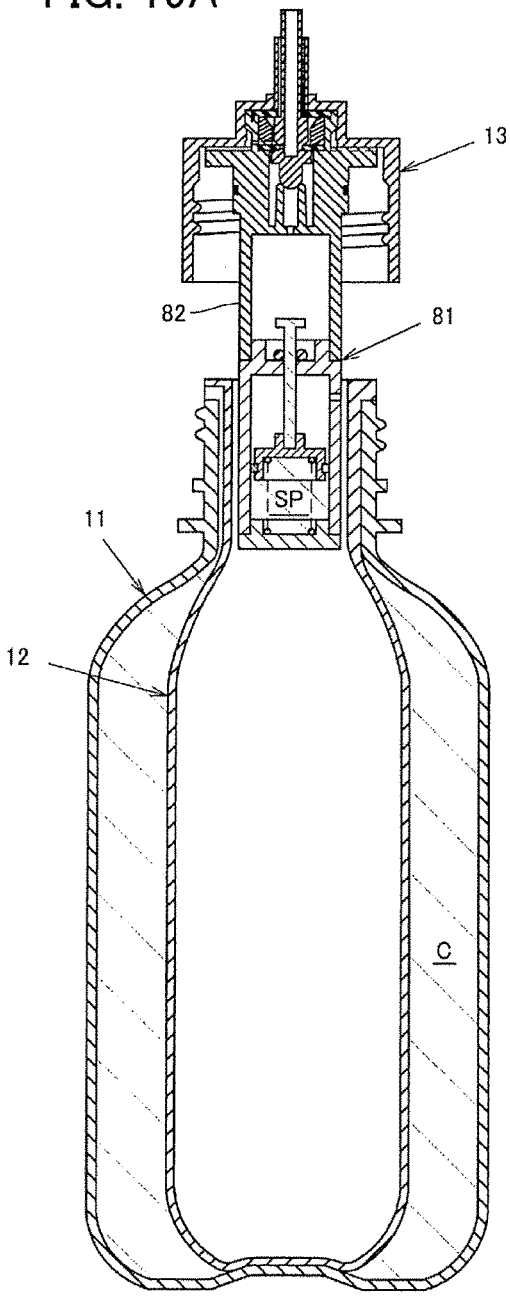
FIG. 19A, 19B are outline drawings showing the assembling process of the discharge container of FIG. 17.
Figure 19B:
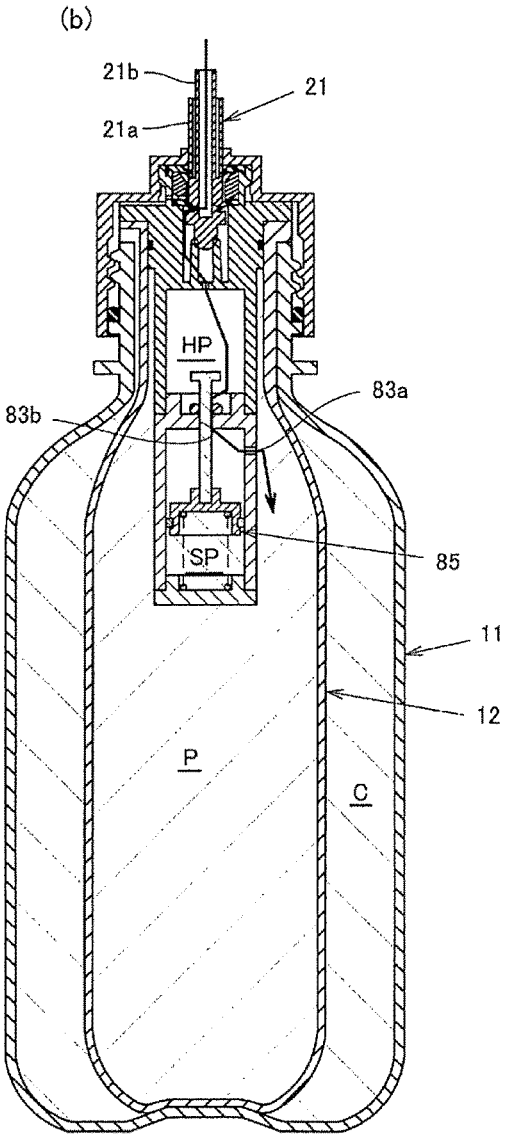

Next, the manufacturing method of the discharge product using the discharge container 80 is shown in FIG. 19.

First, a double bottle consisting of the outer container 11 and the inner container 12 is formed. In this moment, so as to make the accommodating chamber S1 open securely when filling the content, for example, using the above described guide member (the seventh aspect of the present invention), the inner container 12 may be contracted once. Meanwhile, a lid material in which the valve assembly 13 and the pressure adjusting mechanism 81 are connected is prepared (refer to FIG. 19A). The connected portion is preferable to be integrated.

This lid material is fixed to the double bottle. After that, the stem 21 is pushed down, the pressurizing agent P is filled from the second intra-stem passage 21*b* (refer to FIG. 19B). In this moment, it is preferable to fill while closing the first intra-stem passage 21*a*. Stated differently, before the pressurizing agent P is filled, since the force of pressing the piston 85 of the pressurizing chamber SP is larger than that of the inner container 12, the center hole 83*b* is opened, the pressurizing agent P is supplied to inside the inner container 12 through the center hole 83*b* and the gas communicating hole 83*a*. When the pressurizing agent P is filled in the inner container 12, the force of pressing the piston 85 of the inner container 12 becomes larger than that of the pressurizing chamber SP, the piston 85 descends together with the valve rod 84, the center hole 83*b* is shut off. After that also, by filling the pressurizing agent P inside the high pressure chamber HP, the pressure in the high pressure chamber HP is made to be sufficiently higher than the reference pressure chamber SP even in the expanded state (the state after the content C is discharged), where the outer surface of the inner container 12 contacts the inner surface of the outer container 11.

In addition, the filling of the content to the accommodating chamber S1 may be carried out before the lid material in which the valve assembly 13 and the pressure adjusting mechanism 81 are connected is fixed to the double bottle, moreover, it may be filled from the first intra-stem passage 21*a* of the stem 21 after being fixed to the double bottle.

Figure 20A:
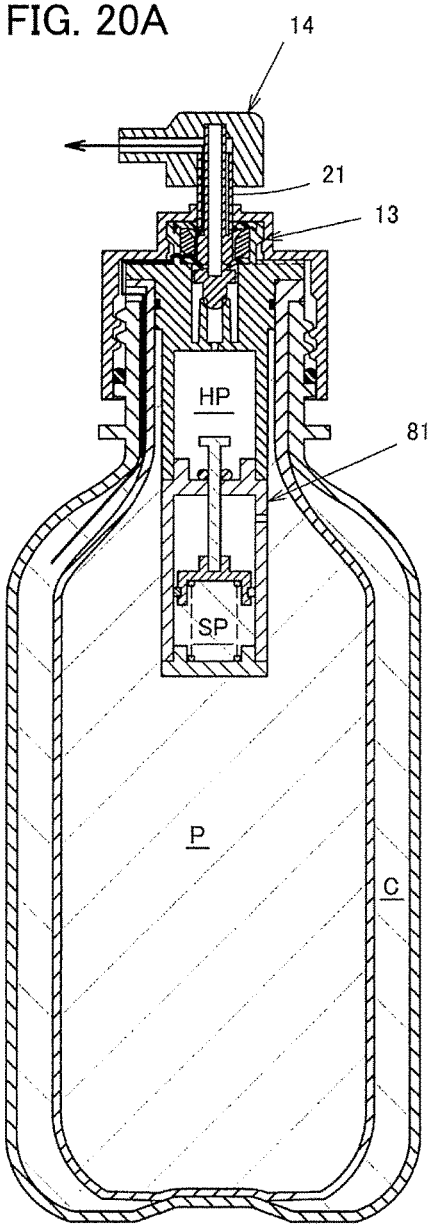
FIG. 20A is an outline drawing showing the use state of the discharge container of FIG. 17.

Next, the use method of the discharge product is shown. The use method is that the stem 21 is pushed down by the push button 14 to open the valve mechanism 16, the content C can be discharged by the pressure inside the inner container 12 (refer to FIG. 20A). By the discharge of the content C, the inner container 12 expands, when the inner pressure of the inner container 12 decreases, the pressure adjusting mechanism 81 operates as described above, and the pressurizing agent P is replenished to the inner container 12 from the high pressure chamber HP. When the pressure inside the inner container 12 becomes high, the piston 85 descends downward to stop the supply of the pressurizing agent P. Since this supply process and the supply stop process is carried out every time when the content C is discharged, the content C can be discharged at the same momentum to the last.

Figure 20B:
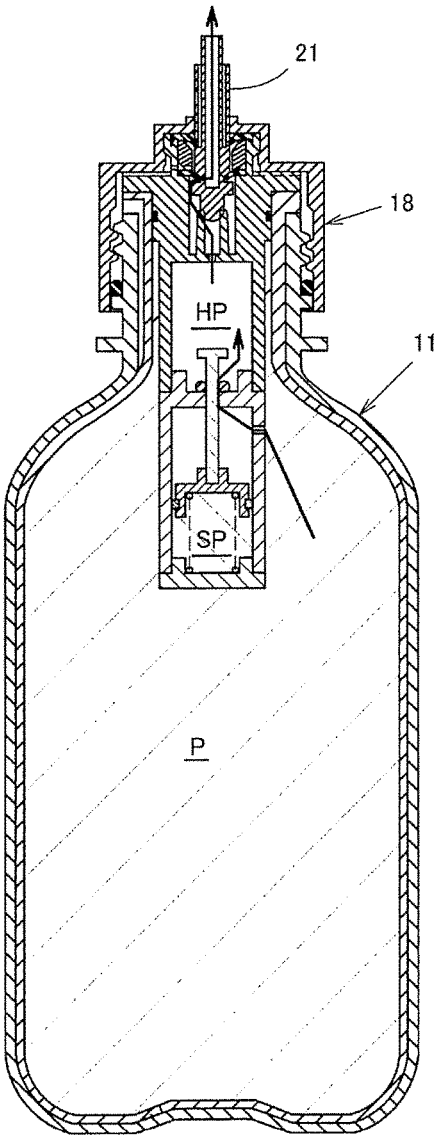
FIG. 20B is an outline drawing showing the exhaust mechanism of the pressuring agent thereof.

After discharging the content C, as shown in FIG. 20B, by detaching the push button 14 and pushing down (switching operation) the stem 21, the pressurizing agent P in the high pressure chamber can be exhausted to the exterior. Along with this, since the center hole 83*b* of the pressure adjusting mechanism 81 is opened, the pressurizing agent P in the inner container 12 can be also discharged from the second intra-stem passage 21*b* of the stem 21 through the gas communicating hole 83*a* and the center hole 83*b*. Further, by detaching the cap 18 from the outer container 11, it can be discarded according to the material sorted.

Figure 21:
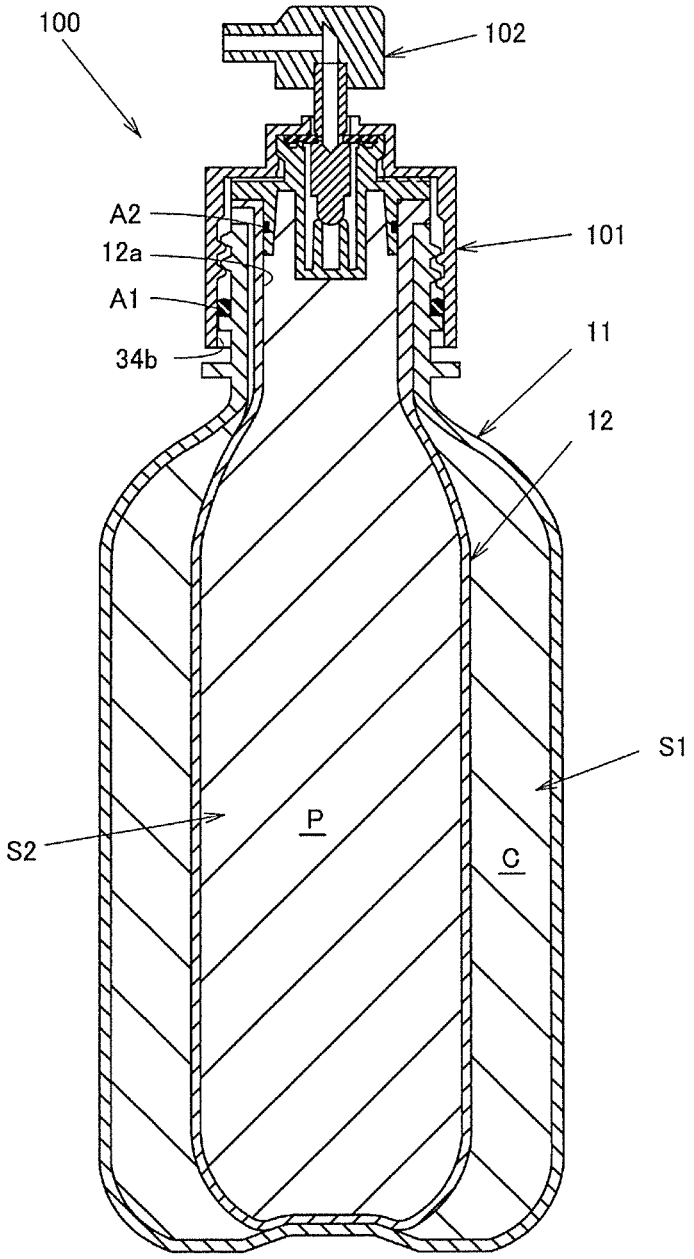
FIG. 21 A cross-sectional view showing the ninth embodiment of the discharge container of the present invention.

The discharge container 100 of FIG. 21 is the first aspect of the present invention, and is that in which an inner seal material is provided between the valve holder and the inner container, an outer seal material whose cross section is circular is provided between the outer cylindrical surface of the outer container and the inner cylindrical surface of the cap, and by moving the cap to a temporary position upper than the fixed position, the seal structure of the inner seal material is released while maintaining the seal structure of the outer seal material.

In detail, the discharge container 100 comprises the outer container 11 made of resin, the inner container 12 made of resin accommodated therein, a valve assembly 101 closing the outer container 11 and the inner container 12, fixed by being engaged with the outer periphery of the outer container. The outer container 11 and the inner container 12 are substantially same as the discharge container 10 of FIG. 1, the content C is filled in the accommodating chamber S1 between the outer container 11 and the inner container 12, and the pressurizing agent P is filled in the pressurizing chamber S2 in the inner container. A push button 102 is attached to the valve assembly 101.

Figure 23:
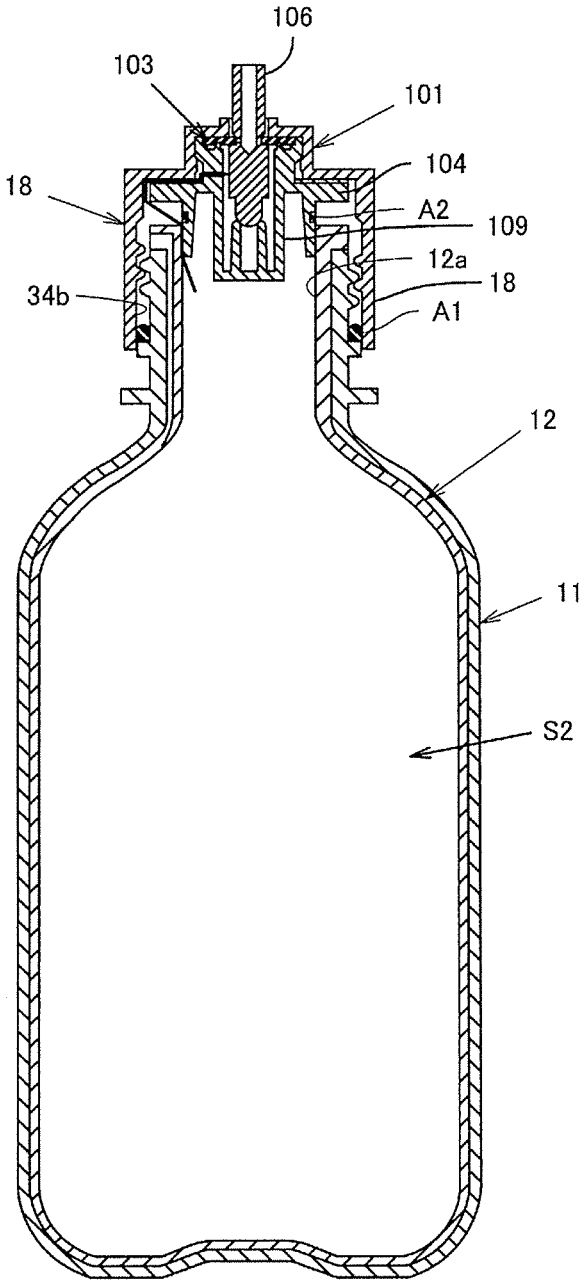
FIG. 23 A cross-sectional view of the discarded state of the discharge container of FIG. 21.

In this discharge container 100, the cap 18 of the valve assembly 101 is moved to the temporary position upper than the fixed position, and by pushing down (switching operation) the stem 106 of the valve mechanism 103, the pressurizing chamber S2 and atmospheric air can be communicated (refer to FIG. 23).

Figure 22A:
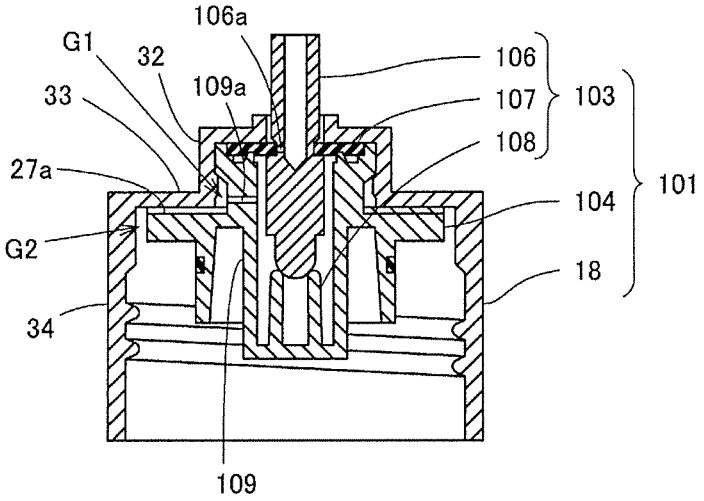
FIG. 22A-22C is respectively a cross-sectional view of the valve assembly, a cross-sectional view of the valve holder, and a cross-sectional view of the push button of the discharge container of FIG. 21.

The valve assembly 101 is, as shown in FIG. 22A, provided with a valve mechanism 103 which shuts off/communicates one fluid, a valve holder 104 closing the outer container 11 and the inner container 12, and the cap 18 which fixes the valve mechanism 103 to the inside of the valve holder 104, and fixes the valve holder 104 to the outer container 11. The cap 18 is substantially same as the cap 18 of the discharge container 10 of FIG. 1.

The valve mechanism 103 comprises a stem 106 in which a stem hole 106*a* communicating the inside and the outside is formed in the lower portion, an annular stem rubber 107 closing the stem hole 106*a*, and an elastic body 108 energizing the stem 106 always upward.

Figure 22B:
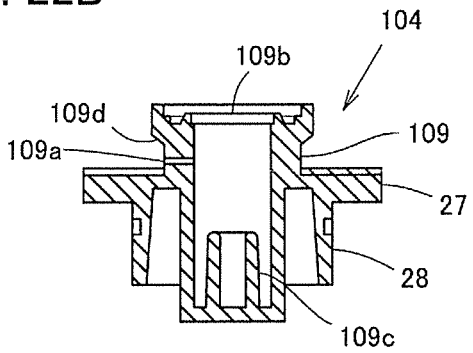

The valve holder 104 has, as shown in FIG. 22, a cylindrical housing 109, the annular flange 27 extending outward from the central side surface of the housing 109, and the cylindrical plug portion 28 provided in the lower surface thereof, being outward coaxially with the housing 109.

The annular flange 27 and the plug portion 28 are substantially same as the annular flange 27 and the plug portion 28 of the discharge container 10 of FIG. 1. The inside of the housing 109 of the valve holder 104 is communicated with the accommodating chamber S1 through the annular flange 27. In detail, the inside of the housing 109 is communicated with the accommodating chamber S1 so as to circumvent the annular flange 27 out of the housing 109.

The housing 109 is different to the housing 26 of the discharge container 10 of FIG. 1 in the point that it does not have a second communicating hole and the second rubber support portion. Another composition is substantially same as the housing 26 of FIG. 1, in the side surface of the housing 109, a communicating hole 109*a* is formed, a rubber supporting portion 109*b* supporting the stem rubber 107 is formed in the upper end of the housing 109, and a plurality of leaf springs 109*c* composing an elastic body 108 is formed protruding upward in the bottom portion of the housing 64. And, the upper periphery of the first communicating hole 109*a* of the housing 109 is expanded in diameter through a step portion 109*d*.

Being composed as described above, the discharge passage of the content connecting the accommodating chamber S1 and atmospheric air excepting the push button 14 is, as shown in FIG. 22, communicated with atmospheric air through the longitudinal passage groove 12*c* of the inner container 12, the gap G2 between the lower cylindrical portion 34 of the cap 18 and the valve holder 104, the content passage (the lateral passage groove 27*a* between the ring portion 33 of the cap 18 and the valve holder 104, the gap G1 between the lower inner surface of the upper cylindrical portion 32 of the cap 18 and the outer periphery surface of the housing 109 of the valve holder 104, the first communicating hole 109*a* of the housing 109, and the inside of the housing 109) and the stem 106 of the valve mechanism 103.

Figure 22C:
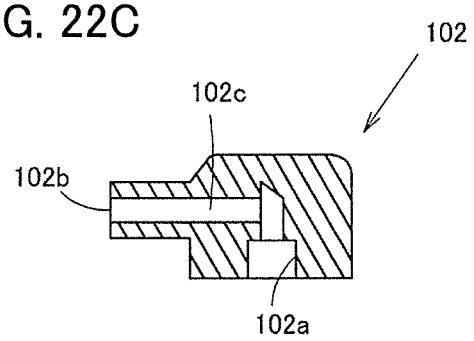

The push button 102 is, as shown in FIG. 22C, that which is publicly known attached to a one-fluid type stem, and is provided with a stem engaging portion 102*a* formed in the lower portion, a discharge hole 102*b* formed in front, and an intra-button passage 102*c* connecting those. In addition, a mechanical breakup mechanism etc. as the push button 52 of FIG. 11 may be adopted in the discharge hole 102*b* according to a discharge form.

Next, the seal structure of the discharge container is described referencing to FIG. 21.

In this discharge container 100 also, same as the discharge container 10 of FIG. 1, the outer seal A1 is provided between the outer container 11 and the valve assembly 101, and the inner seal material A2 between the inner container 12 and the valve assembly 101 (refer to FIG. 21). And, substantially same as the discharge container 10 of FIG. 1, since the outer seal material A1 and the inner seal material A2 are compressed to the axis of the inner and outer container vertically, the seal is formed regardless of the degree of fitting (degree of screwing) of the cap 18 to the outer container 11.

Further, in this discharge container 100, the arrangement of the outer seal material A1 and the inner seal material A2 is made so that, when the cap 18 is ascended together with the valve assembly 101 in the state that the compression of the outer seal material A1 by the lower portion of the inner cylindrical portion 34*b* of the cap 18 is maintained, the inner seal material A2 ascends together with the valve assembly 101, and departs from the inner cylindrical portion 12*a* of the inner container 12 (refer to FIG. 23). Stated differently, when the cap 18 connected with the valve assembly 101 is ascended, the seal structure of the inner seal material A2 can be released (temporary fixed position), while the seal structure of the outer seal material A1 is maintained. In addition, in the discharge container 10 of FIG. 1, the arrangement may be made to be the same. Thereby, the under cup filling to fill the pressurizing agent at higher speed becomes possible.

Next, the manufacturing method of the discharge container 100 is shown. The outer container 11 and the inner container 122 are prepared from a double preform. Then, the valve holder 104 and the cap 18 are integrated. Then, the seal structure of the outer seal material A1 is formed, and the integrated valve assembly 101 is fixed temporarily so that the seal structure of the inner seal material A2 is not formed (refer to FIG. 23). In this state, the housing 109 of the valve holder 104 and the pressurizing chamber S2 are communicated (refer to the thick line of FIG. 23). In this state, the stem 106 is pushed down, and from the stem 106, the pressurizing agent P is filled. After that, the cap 18 of the valve assembly 104 is fixed actually to the outer container 11 to form the seal structure of the inner seal material A2. In this state, the stem 106 is pushed down, and the pressurizing agent P invaded to the accommodating chamber S1 is exhausted. After that the content C is filled in the accommodating chamber S1. In this case also, as described above, it is preferable to carry out it after contracting the inner container 12 using the guide member.

Next, the use method of the discharge product 100 is shown. The use method is same as the discharge container 10 of FIG. 1, pushing down the push button 102 to open the valve mechanism 103, the content C can be discharged from the discharge hole 102*b* of the push button 102. After discharging the whole amount of the content C, the cap 18 of the valve assembly 101 is moved to the temporary fixed position, the seal structure of the inner seal material A2 is released, while maintaining the seal structure of the outer seal material A1 (the temporary fixing position of FIG. 23). Thereby, since the pressurizing chamber S2 and the housing 109 are communicated, by pushing down the stem 106 (or the push button 102), the pressurizing chamber S2 and atmospheric air can be communicated, the pressurizing agent P can be discharged from the stem 106. Finally, by detaching the cap 18 from the outer container 11, each can be sorted and discarded.

Figure 24:
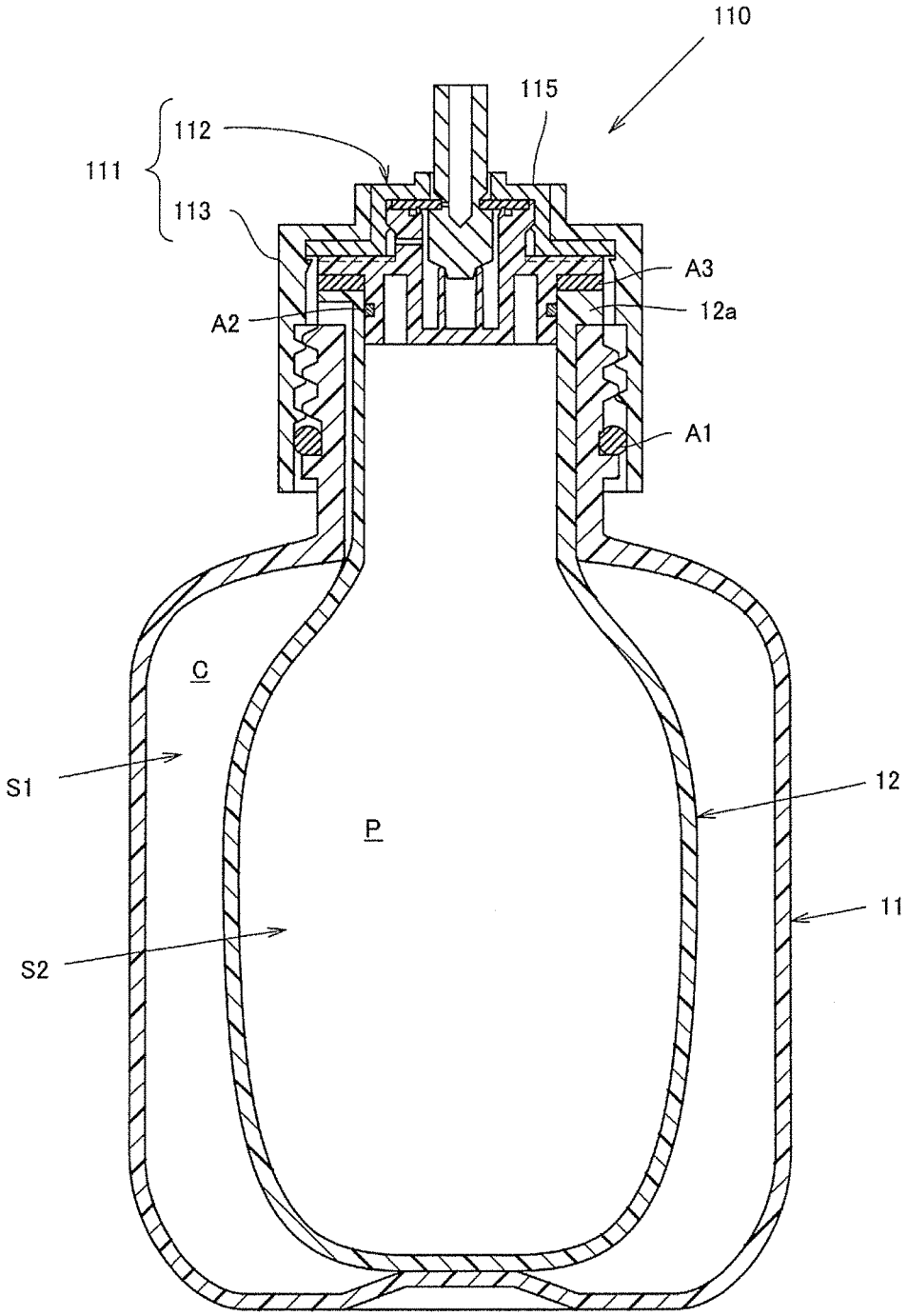
FIG. 24 A cross-sectional view showing the tenth embodiment of the discharge container of the present invention.

The discharge container 110 of FIG. 24 is that in which a valve assembly 111 is provided with a valve cover 115, and the pressurizing chamber S2 and atmospheric air are communicated only by moving the cap 113 of the valve assembly 111 to the temporary fixed position. In detail, it comprises the outer container 11, the inner container 12 accommodated therein, and the valve assembly 111 closing the outer container 11 and the inner container 12, being fixed by engaging with the outer periphery of the outer container 11. The outer container 11 and the inner container 12 are substantially same as the discharge container 10 of FIG. 1, the content C is filled in the accommodating chamber S2 between the outer container 11 and the inner container 12, the pressurizing agent P is filled in the pressurizing chamber S2. To this valve assembly 111 also, the push button 102 etc. of the discharge container 100 of FIG. 21 is attached.

In this discharge container 110 also, the pressurizing chamber S2 and atmospheric air can be communicated by moving the cap 113 of the valve assembly 111 to the temporary position upper than the fixed position, and by pushing down (switching operation) the stem 106 of the valve mechanism 103 (refer to FIG. 23).

Figure 25A:
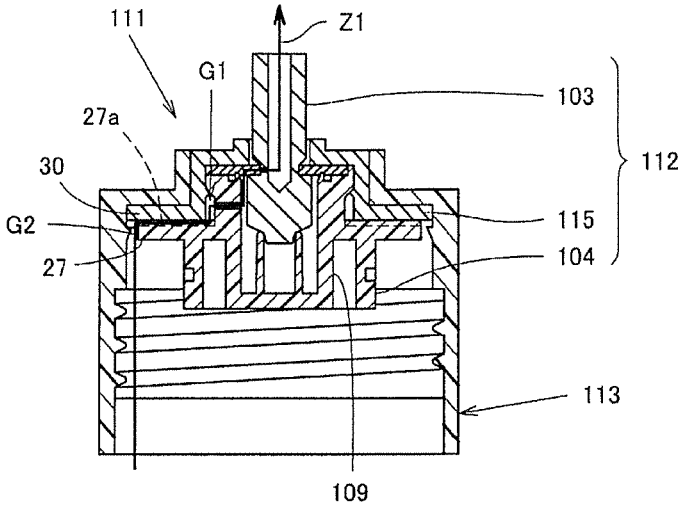
FIG. 25A-25C is respectively a cross-sectional view of the valve assembly, a cross-sectional view of the valve cover, and a cross-sectional view of the cap of the discharge container of FIG. 24.

The valve assembly 111 has a valve unit 112 to which the valve mechanism 103 is fixed, closing the outer container 11 and the inner container 12, and a cylindrical cap 113 fixing the valve unit 112 to the outer container 11. The valve unit 112 of the valve assembly 111 is, as shown in FIG. 25A, provided with the valve mechanism 103, the cylindrical valve holder 104 in which the annular flange (the first flange portion of the sixth aspect of the present invention) 27 arranged in the upper end of the outer container 11 is formed, accommodating the valve mechanism 103, and a valve cover 115 in which the hem portion (the second flange portion of the sixth aspect of the present invention) 118 arranged above the annular flange 27, fixing the valve mechanism 103 to the valve holder 104 is provided. Between the annular flange 27 of the valve holder 104 and the hem portion 118 of the valve cover 115, the passage (the lateral passage groove 27*a*) extending outward radially is formed. The valve mechanism 103 and the valve holder 104 are substantially same as the discharge container 100 of FIG. 21. In addition, the plate seal material A3 compressed in the vertical direction (the axis of the outer container) is provided across the flange portion 12*d* through the annular flange portion 27 of the valve holder 104 and the flange portion 12*a* of the inner container 12 (refer to FIG. 24).

Figure 25B:
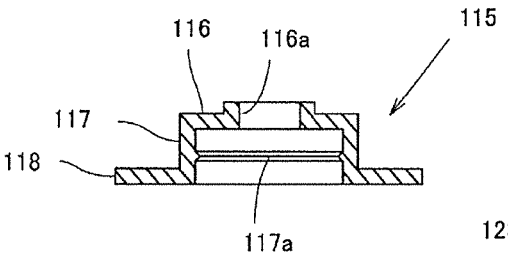

The valve cover 115 is, as shown in FIG. 25B, provided with a canopy portion 116 closing the opening of the housing 109 of the valve holder 104, a cylindrical portion 117 extending downward from the edge portion thereof, arranged in the outer periphery of the housing 109, and an annular hem portion 118 extending outward radially from the lower end thereof.

In the center of the canopy portion 116, a center hole 116*a* letting through the stem 106 of the valve mechanism 103 is formed.

In the inner surface of the cylindrical portion 117, an engaging protrusion 117*a* to engage with the lower end of a step portion 109*d* of the housing 109 is formed. And, by the canopy portion 116 and the engaging protrusion 117*a*, the valve mechanism 103 is fixed to the valve holder 104, the valve unit 112 is integrated. In addition, the lower inner surface of the cylindrical portion 117 (inner surface lower than the engaging protrusion 117*a*) forms the annular gap G1 with the outer periphery surface of the housing 109, and is communicated with the lateral passage groove 27*a* (refer to FIG. 25A).

The hem portion 118 is arranged so as to over the annular flange 27 of the valve holder 104 in the upper portion thereof. In other words, the hem portion 118 is arranged in the upper end of the outer container 11 through the annular flange 27. And, the valve cover 115 closes the outer container 11.

Since the valve cover 115 as described above is provided, the passage between the hem portion 118 of the valve cover 115 and the annular flange 27 of the valve holder 104 is securely formed regardless of the attached state of the cap 113.

Figure 25C:
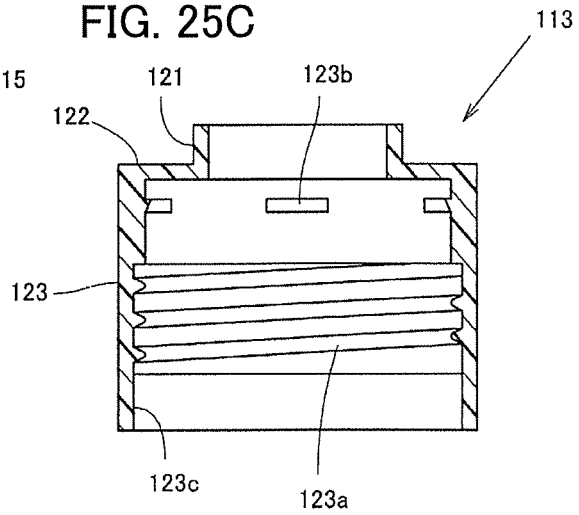

The cap 113 of the valve assembly 111 is, as shown in FIG. 25C, provided with an upper cylindrical portion 121 covering the outer periphery surface of the cylindrical portion 117 of the valve cover 115, an annular connecting portion (pressing portion) 122 protruding outward radially from the lower end thereof, and a lower cylindrical portion 123 extending downward from the outer end thereof. The connecting portion (pressing portion) 122 is arranged on the hem portion 118 of the valve cover 115, and presses the whole of the valve unit 112.

The upper end of the upper cylindrical portion 121 is made to be the same height as the upper end of the cylindrical portion 117 of the valve cover 115 (refer to FIG. 25A). Hence, the gap between the cap 113 and the valve cover 15 opens facing upward.

In the inner surface of the lower cylindrical portion 123, a screw 123*a* engaging with the screw 11*a* of the outer container 11 is formed. And, in the position of the annular outer seal holding portion 11*b* of the outer container 11, being beneath the screw 123*a*, an inner cylindrical portion 123*b* of which the diameter is somewhat reduced than the thread of the screw 123*a* is formed. This inner cylindrical portion 123*b* compresses the outer seal material A1 across the outer cylindrical portion 11*b*1 of the outer container 11.

Moreover, above the screw 123*a*, a plurality of support protrusions (temporary support portion) 123*c* engaging with the lower surface of the hem portion 118 of the valve cover 115 is annularly formed.

It is preferable that the arranged position of the longitudinal passage groove 12*c* of the inner container 12 comes between the adjoining support protrusions 123*b* in a planar view. This support protrusion 123*c* is formed in the position where a gap between the upper surface of the hem portion 118 of the valve cover 115 and the lower surface of the connecting portion 122 (pressing portion) is formed, when engaging with the lower surface of the hem portion 118 of the valve cover 115. This support protrusion 123*c* does not contact with the lower surface of the hem portion 118 after the discharge container 110 is assembled (after the cap 113 is fixed to the outer container 11). By providing the support protrusion 123*c*, before attaching the valve assembly 111 to the outer container 11, the valve unit 112 can be held with the cap 113, the valve assembly 111 (the valve unit 112 and the cap 113) can be handled as one body.

Further, by providing the support protrusion 123*c*, as later described, during filling the pressurizing agent (temporary fixing in the position upper than the fixed position), the valve unit 112 moving downward to the cap 113 by the filling pressure of the pressurizing agent can be supported, the later described pressurizing agent filling passage can be secured, and it can be prevented that the opening of the outer container 11 is closed by the fall down of the valve unit 112.

Being composed as described above, as shown by the thick line of FIG. 25, a concentrate passage Z1 of the valve assembly 111 reaches to the stem 106 from the longitudinal passage 12*c* of the inner container 12 communicating with the accommodating chamber S1, through the gap G2 of the outside of the support flange 27, between the support flange (the first flange portion) 27 and the hem portion (the second flange) 118 (the lateral passage groove 27*a*), the gap G1 between the housing 109 and the valve cover 115, the first communicating hole 109*a*, and the inside of the housing 109.

Stated differently, by pushing down the stem 106 of the valve mechanism 103, the stem rubber 107 bends, the inside of the housing 109 is communicated with the exterior, the concentration passage Z1 is opened. Hence, the concentration C pressurized by the pressurizing agent P in the inner container (the pressurizing chamber S2) is discharged from the stem 106 passing through the concentration passage Z1.

Next, the use method of the discharge container 110 is shown. The use method is that, same as the discharge container 10 of FIG. 1, by pushing down the push button 102 to open the valve mechanism 103, the content C can be discharged from the discharge hole 102*b* of the push button.

After discharging whole amount of the content C, same as the discharge container 100 of FIG. 21, the cap 113 of the valve assembly 111 is moved to the temporary fixed position, the seal structure of the inner seal material A2 is released, while maintaining the seal structure of the outer seal material A1. Thereby, since the pressurizing chamber S2 and atmospheric air are communicated, the pressurizing agent P can be exhausted from an annular opening between the valve cover 115 and the cap 113 (the reverse direction of the thick line of FIG. 26A). Similarly, in the end, by detaching the cap 113 from the outer container 1, each can be sorted and discarded.

Next, an example of the filling method of the content C and the pressurizing agent P into the discharge container 110 (the manufacturing method of the discharge container) is described.

First, a two-layer preform of the outer container 11 and the inner container 12 is prepared, the outer container 11 and the inner container 12 are simultaneously molded from the two-layer preform by biaxial stretch blow molding etc. (refer to FIG. 5A). In addition, the outer container 11 and the inner container 12 may be molded separately, and the inner container 12 is inserted into the outer container 12 while squeezing the inner container 12.

Figure 26B:
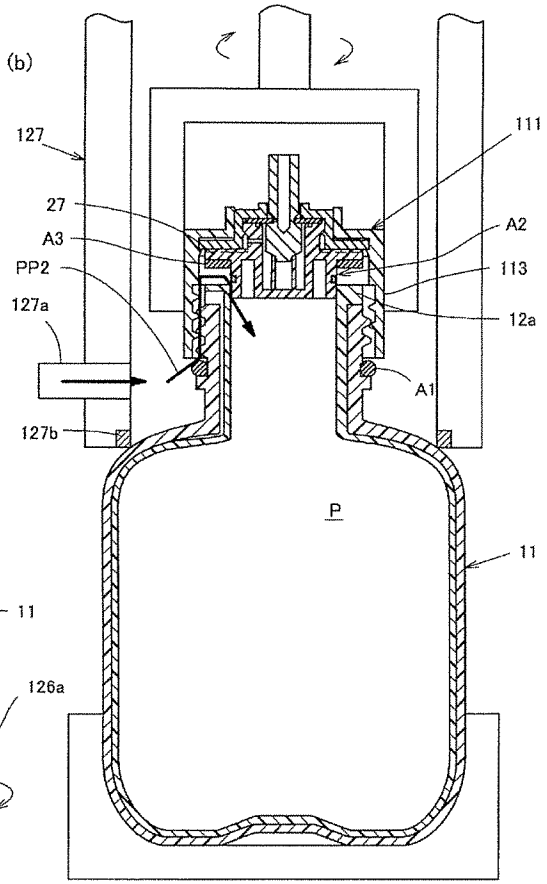
FIG. 26B is a side cross-sectional view showing the outline of pressurizing agent filling process using the pressurizing agent filling machine of another aspect.
Figure 26A:
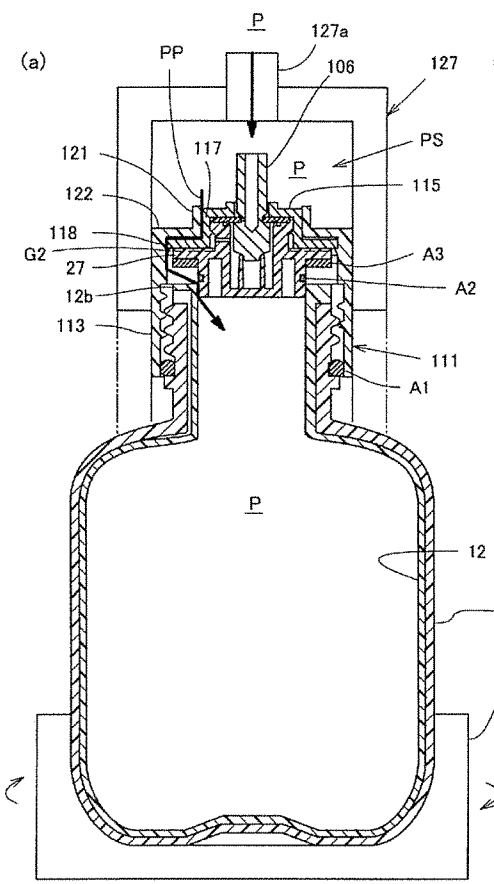
FIG. 26A is a side cross-sectional view showing the outline of pressurizing agent filling process of the discharge container of FIG. 24.

Then, as shown in FIG. 26A, the outer container 11 is placed on a rotating table 126*a*. Meanwhile, a pressurizing agent filling machine 127 equipped with a pressurizing agent filling nozzle 127*a* is attached to the cap 113 of the valve assembly 111, the valve assembly 111 is arranged above the outer container 11. And, to the valve assembly 111 (pressurizing agent filling machine 127), the outer container 11 is rotated to fasten the cap 113, and the valve assembly 111 is held in the temporary fixed position upper than the fixed position. In other words, the cap 113 of the valve assembly 111 is not completely screwed to the outer container 11 to make the inner seal material A2 and the plate seal material A3 not exerting seal effect. In this moment, the pressurizing agent filling machine 127 holds the cap 113, and at the same time, is attached to the cap 113 so that a space PS between the cap 113 and the pressurizing agent filling machine 127 is sealed so that the pressuring agent P does not leak.

In this temporary fixed state, the pressurizing agent P is supplied to the space PS from the pressurizing agent filling nozzle 127*a*. Thereby, the pressurizing agent P is filled inside the inner container 12 passing through a pressurizing agent filling passage PP from between the valve cover 115 and the cap 113. In detail, the pressurizing agent filling passage PP reaches from between the cylindrical portion 117 of the valve cover 115 and the upper cylindrical portion 121 of the cap 113 to between the hem portion 118 of the valve cover 115 and the connecting portion (pressing portion) 122 of the cap 113, the gap G2 outside of the annular flange 27 of the valve holder 104 between the mutual holding protrusion 123*c*, and between the annular flange 27 of the valve holder 104 and the flange portion 12*b* of the inner container 12 (the inner seal material A2).

In this moment, the valve unit 112 descends somewhat to the cap 113 by the filling pressure of the pressurizing agent P, and is supported to the engaging protrusion 123*c* of the cap 113. Hence, the gap between the upper surface of the hem portion 118 of the valve cover 115 and the lower surface of the connecting portion 122 of the cap 113 (pressing portion) can be secured largely. Moreover, even if the filling pressure of the pressurizing agent P is applied to the valve unit 112, the opening of the outer container 11 is never closed by the valve holder 104 etc.

And, during the pressurizing agent filling, since the outer seal material A1 seals between the lower portion of the cap 113 and the outer container 11, the pressurizing agent P does not leak to the exterior from the lower end of the cap 113.

In addition, the cap 113 is covered by the pressurizing agent filling machine 127, whole of the cap 113 may be accommodated in the sealed space PS (for example, as the imaginary line, the lower end of the pressurizing agent filling machine 127 is sealed with the shoulder portion of the outer container 11). In this case, even in the state that the outer seal material A1 is omitted, or the outer seal material A1 does not seal between the lower portion of the cap 113 and the outer container 11, the pressurizing agent P can be filled.

After filling the pressurizing agent P, the outer container 11 is further rotated to fix the valve assembly 111 to the outer container 11. Thereby, the inner seal material A2 and the plate seal material A3 are compressed to seal the inside of the inner container 12.

After filling the pressurizing agent P, when the supply of the pressurizing agent P from the pressurizing agent filling machine 127*a* is stopped, the pressure inside the inner container 12 and the space PS becomes substantially equilibrium. Hence, when the outer container 11 is rotated and the cap 113 is descended to the outer container 11, the valve unit 112 and the outer container 11 (the inner container 12) are integrated by the plate seal material A3, the valve unit slides 112 against the cap 113. Thereby, the position between the lateral passage groove 27*a* of the valve unit 112 and the lateral passage groove 12*c* between the outer container 11 and the inner container 12 is hard to be misaligned. Further, the displacement, torsion, cutoff of the inner seal material A2 between the outer container 11 and the valve unit 112 can be prevented.

In addition, without providing the inner seal material A2, the flange portion 12*a* may be made to be a substitute by compressing the flange portion 12*a* of the inner container 12. Moreover, the plate seal material A3 may be omitted.

After that, the stem 106 is pushed down to exhaust a small amount of pressurizing agent P and air invaded into the accommodating chamber S1 (the space between the outer container 11 and the inner container 12). Finally, the content C is filled inside the accommodating chamber S1 from the stem 106 while contracting the inner container 12, the production of the discharge product is completed. Here, the outer container 11 is rotated to screw with the valve assembly 111, but the cap 113 may be rotated so as to fix the valve assembly 111. However, since the valve assembly 111 is connected to the pressurizing agent filling machine 127, it is preferable to rotate the outer container 11, because the equipment does not become complicated.

As another example of filling method of the pressurizing agent (manufacturing method of discharge product) to the discharge container 110, when the valve assembly 111 is held in the temporary fixed position upper than the fixed position to the outer container 11, as shown in FIG. 26B, the outer seal material A1 is positioned lower than the lower end of the cap 113 to make the seal between the cap 113 and the outer container 11 not formed, the pressurizing agent filling machine 127 and the shoulder of the outer container 11 are sealed with a seal material 127*c*, the pressurizing agent P may be filled from the pressurizing agent filling nozzle 127*a* arranged near the lower end of the cap 113 through a pressurizing agent filling passage PP2. The pressurizing agent filling passage PP2 reaches from between the outer container 11 and the cap 113 to between the annular flange 27 of the valve holder 104 and the flange portion 12*b* of the inner container 12 (the inner seal material A2).

In the case of this filling method, since the valve unit 112 (the valve cover 115) moves upward by the filling pressure of the pressurizing agent, the hem portion 118 contacts the inner surface of the connecting portion 122 of the cap 113, the pressurizing agent filling passage can be formed between the outer container 11 and the valve unit 112, the pressurizing agent can be filled safely. Hence, the engaging protrusion 123*c* of the cap 113 may be omitted. Moreover, even the cap 113 is rotated for fixing to the outer container 11, since the valve unit 112 and the outer container 11 (the inner container 12) are integrated by the plate seal material A3, and the valve unit 112 slides with the cap 113 and does not rotate against the outer container 11, the position of the lateral passage groove 27*a* of the valve unit 112 and the position of the longitudinal passage groove 12*c* between the outer container 11 and the inner container 12 is hard to become misalignment, and the displacement, torsion, cutoff of the inner seal A2 between the outer container 11 and the valve unit 112 can be prevented. When adopting this filling method, the cap 113 is fixed, and rotating the outer container 11, the cap 113 may be fixed to the outer container 11. Moreover, the filling from the both sides; the filling from between the cylindrical portion 117 of the valve cover 115 and the upper cylindrical portion 121 of the cap 113 (filling from the upper part, the passage PP of FIG. 26A); the filling from the lower end of the cap 113 (filling from the lower part), may be carried out.

Further, in the case that this filling method is adopted, the outer seal material A1 and the inner seal material A2 may be arranged so that the cap 113 does not have the temporary fixed position. In other words, it is sufficient that when the outer seal material A1 and the inner seal material A2 make the cap 113 descend to the outer container 11, the seal structure is formed simultaneously.

Figure 27A:
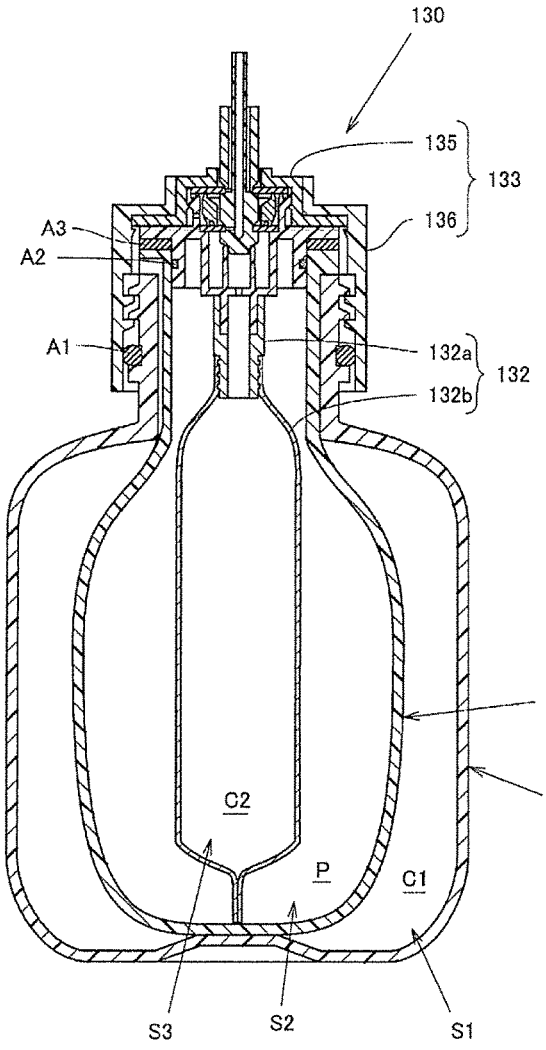
FIG. 27A is a cross-sectional view showing the eleventh embodiment of the discharge container of the present invention.

The discharge container 130 of FIG. 27A is that in which the valve assembly and the outer container are fitted with a clip, not by screw type. Moreover, it is the two-fluid discharge type discharge container in which a pouch is accommodated in the inner container, two concentrates are accommodated therein, and are discharged simultaneously.

The discharge container 130 is provided with a bottomed outer container 131 and the inner container 12 accommodated in the outer container, an innermost container 132 accommodated in the inner container 12, and a valve assembly 133 closing the inner container 12 and the innermost container 132. The valve assembly 133 has a valve unit 135 closing the outer container 131 and the inner container 12 and the innermost container 132, to which the valve mechanism 16 is fixed, and a cylindrical cap 136 which fixes the valve unit 135 to the outer container 131. And, a first concentrate C1 is accommodated in the space (the first accommodating chamber S1) between the outer container 131 and the inner container 12 of the discharge container 130, a second concentrate C2 is accommodated in the innermost container 42 (the second accommodating chamber S3), the pressurizing agent P is filled in the inner container 12 (pressurizing chamber S2), the two-fluid discharge type discharge product is produced.

The inner container 12 is substantially same as the inner container 12 of the discharge container 10 of FIG. 1.

Figure 27B:
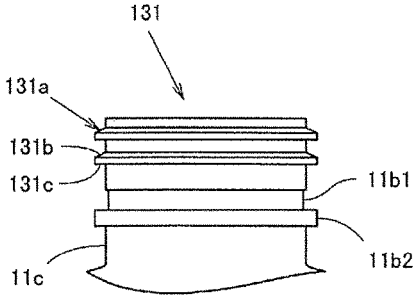
FIG. 27B is an enlarged partial side view showing a part of the outer container.

In the outer container 131, as shown in FIG. 27B, a first annular protrusion 131*a* is formed in the outer periphery of the neck portion. In the first annular protrusion 131*a*, an upper surface 131*b* is made to be a taper like surface expanded in diameter facing downward, a lower surface 131*c* is made to be a horizontal surface (perpendicular to the axis of the outer container 131). In this embodiment, two first annular protrusions 131*a* are provided, but it may be also one and more than three. Another composition is substantially same as the outer container 11 of the discharge container 10 of FIG. 1, an annular protrusion 11*b*2 and an outer cylindrical portion 11*b*1 are formed in the neck portion.

The innermost container 132 is, as shown in FIG. 27A, provided with a pouch 132*a* whose lower end is closed, and a connecting member 132*b* fixed to the upper end opening thereof. The pouch 132*a* is that in which a plurality of sheets is welded or bonded together. As the sheet, synthetic resin sheet such as polyethylene, polyethylene terephthalate, nylon, eval, vapor deposition resin sheet in which silica, alumina are evaporated on the synthetic resin sheet, and that in which synthetic resin sheet etc. is laminated on a metal sheet such as aluminum foil are used. The connecting member 132*b* is that which is cylindrical, pasted on the opening of the pouch 132*a*, and is connected to the later described valve assembly 133. As the connecting member 132*b*, that in which synthetic resin such as polyethylene is injection-molded is used.

Figure 28:
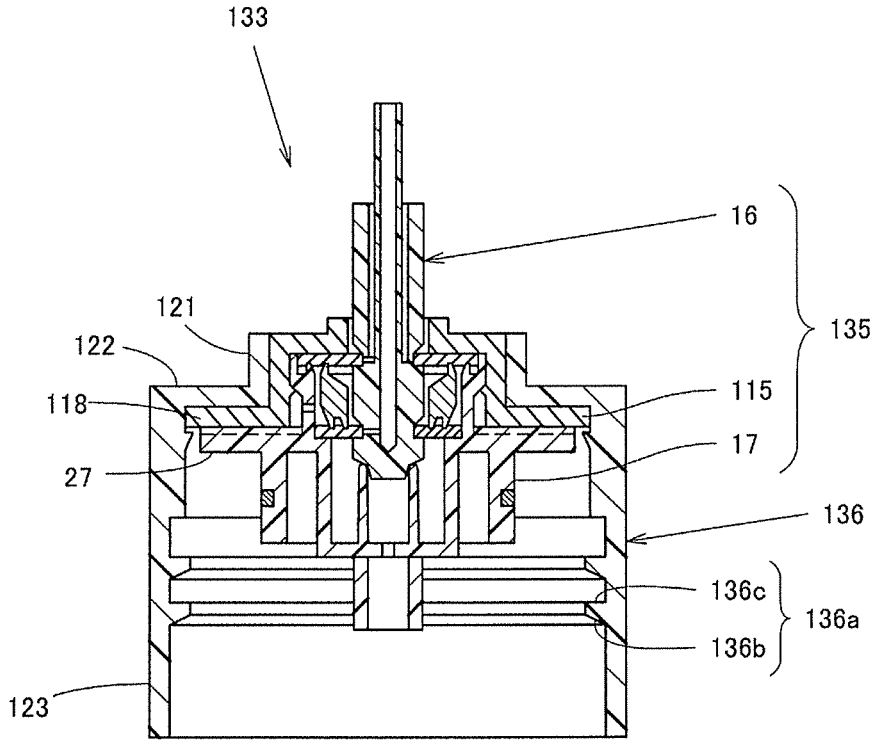
FIG. 28 A side cross-sectional view showing the valve assembly of the discharge container of FIG. 27A.

The valve unit 135 of the valve assembly 133 is, as shown in FIG. 28, provided with the two-fluid type valve mechanism 16, the cylindrical valve holder 17 in which the annular flange (the first flange portion) 27 arranged in the upper end of the outer container 131 is formed, and the valve cover 115 in which the hem portion 118 (the second flange portion of the sixth aspect of the present invention) arranged above the annular flange (the first flange portion of the sixth aspect of the present invention) 27 fixing the valve mechanism 16 to the valve holder 17, being provided in the upper portion thereof is provided. The valve mechanism 16 and the valve holder 17 are substantially same as those of the discharge container 10 of FIG. 1. The valve cover 115 is substantially same as those of the discharge container 110 of FIG. 24.

The cap 136 is, as shown in FIG. 28, has one or a plurality of second annular protrusions 136*a* engaging with a first annular protrusion 131*a* of the container body 131 in the inner surface of the lower cylindrical portion 123. A lower surface 136*b* of a second annular protrusion 136*a* is made to be a tapered surface expanded in diameter downward, an upper surface 136*c* is made to be a horizontal surface. Another composition is substantially same as the cap 113 of the discharge container 110 of FIG. 24, and it has the upper cylindrical portion 121, the connecting portion (pressing portion) 122 and the lower cylindrical portion 123.

Figure 29A:
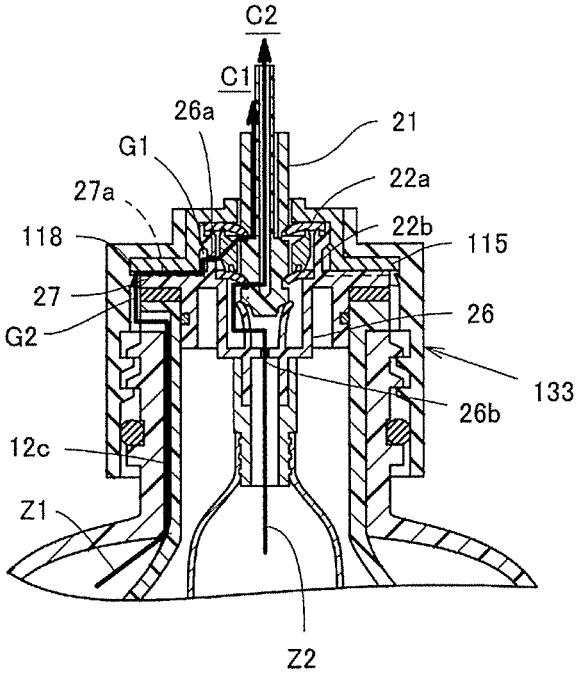
FIG. 29A is a side view showing the use state of the discharge container of FIG. 27A.

Being composed as described above, as shown in FIG. 29A, the first passage Z1 of the valve assembly 133 reaches from the longitudinal passage groove 12*c* of the inner container 12, to the gap G2 outside of the annular flange 27, between the annular flange 27 and the hem portion 118 (the lateral passage groove 27*a*), the gap G1 between the housing 26 and the valve cover 115, the first communicating hole 26*a*, the upper space of the housing 26 (between the first stem rubber 27*a* and the second stem rubber 27*b*), and the cylindrical hole of the first intra-stem passage 21*a* of the stem 21. Meanwhile, the second concentrate passage Z2 of the valve assembly 133 reaches to the second communicating hole 26*b*, the lower space of the housing 26 (the space lower than the second stem rubber 27*b*), and the center hole of the second intra-stem passage 21*b* of the stem 21. In other words, by pushing down the stem 21 of the valve mechanism 16, the first content C1 and the second content C2 are discharged from the stem 21 to the exterior through the first concentrate passage Z1 and the second concentrate passage Z2.

Next, the filling method of concentrate and the pressurizing agent in the discharge container 130 (manufacturing method of discharge product) is described. First, the outer container 131 and the inner container 12 are molded same as the discharge container 10 of FIG. 1.

Then, the innermost container 132 in which the second concentrate C2 is filled is connected to the cylindrical portion 26*g* of the housing 26 of the valve assembly 133. The cap 136 of the valve assembly 133 to which the innermost container 132 is connected is attached to the pressurizing agent filling machine 127 (refer to FIG. 29B) equipped with the pressurizing agent filling nozzle 127*a*, the valve assembly 133 is arranged above the outer container 131.

Figure 29B:
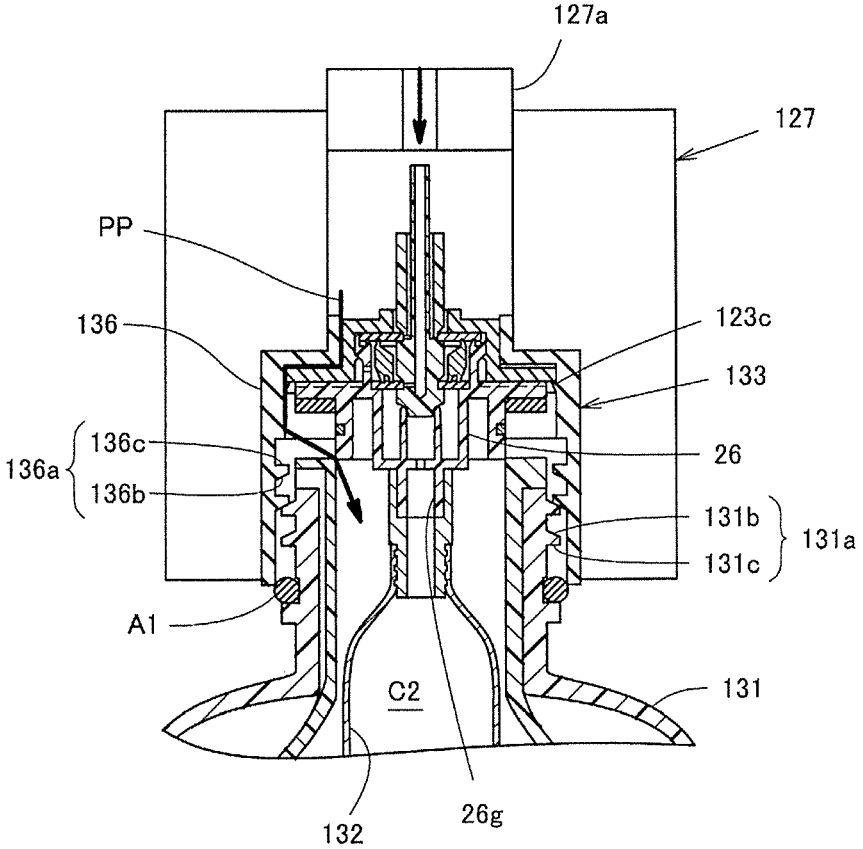
FIG. 29B is a side cross-sectional view showing the outline of the pressurizing agent filling process of the discharge container of FIG. 27A.

After that, the valve assembly 133 is descended to the outer container 131, as shown in FIG. 29B, the taper like upper surface 131*b* of the first annular protrusion 131*a* of the outer container 131 and the taper like lower surface 136*b* of the second annular protrusion 136*a* are made to contact, the cap 136 is held upper than the fixed position to the outer container 131.

In this temporary fixed state, same as the discharge container 110 of FIG. 24, the pressurizing agent P is filled from between the valve cover 17 and the cap 113 (the pressurizing agent filling passage PP). In this moment, since the outer seal material A1 seals between the lower portion of the cap 136 and the outer container 131, the pressurizing agent P does not leak to the exterior from the lower end of the cap 136. And, since the valve unit 135 is held by the support protrusion 123*c*, even if the filling pressure of the pressurizing agent P is applied, the valve unit 135 never closes the opening of the outer container 131, the pressurizing agent passage PP is secured.

After filling the pressurizing agent P, the valve assembly 133 are further descended. In other words, the second annular protrusion 136*a* of the valve assembly 133 is made to override the first annular protrusion 131*a*, the upper surface 136*c* of the second annular protrusion 136*a* and the lower surface 131*c* of the first annular protrusion 131*a* are made to engage, making it to be a fixed state (refer to FIG. 27).

After fixing the outer container 131 and the valve assembly 133, the first accommodating chamber S1 is deaired, the first concentrate C1 is filled from the stem 21 through the first concentrate passage Z1. In addition, the empty innermost container 132 is connected to the valve assembly 133, after filling the pressurizing agent P between (pressurizing chamber S2) the inner container 12 and the innermost container 132 in first, it may be filled through the second concentrate passage Z2 from the stem 21.

In addition, in this discharge container 130 also, as another filling method of the pressurizing agent, same as the discharge container 110 of FIG. 24, by composing so that the outer seal A1 is not formed in the temporary fixed state as FIG. 26B, the pressurizing agent P may be filled from the lower end of the cap 136 (the tenth aspect of the present invention). Moreover, a slit may be provided in the first annular protrusion 131*a* of the outer container 131 of the discharge container 130 and the second annular protrusion 136*a* of the cap 136 so as to make each other let through. In other words, it is sufficient that between the adjoining first annular protrusions 131*a*, the second annular protrusion 136*a* can pass through. Forming the slit as described above, after discharging whole amount of the content (after use), by rotating the cap 136 to ascend the cap 136 up to the temporary fixed position, the pressuring chamber S2 is communicated with atmospheric air, the pressurizing agent P can be discharged from the opening of the upper end of the cap 136 and the valve cover 115.

In the discharge container 130 also, the content and the pressurizing agent may be filled after the inner container becomes accustomed to be contracted uniformly by the insertion of the guide member into the inner container 12. Further, as the discharge container 140 shown in FIG. 30, a connecting portion 141*b* of an innermost container 141 is extended to the vicinity of the bottom portion of a pouch 141*a*, it may be made to be a guide member concurrently serving as a dip tube. Another composition is substantially same as the discharge container 130 of FIG. 27.

The discharge product using the discharge container 140 is manufactured as described below.

Figure 31A:
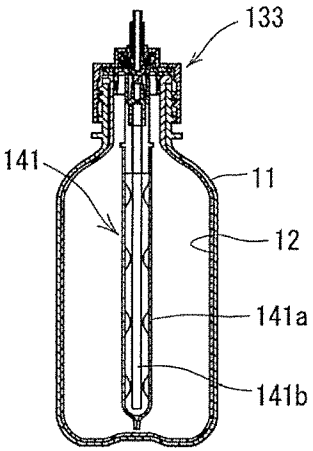
FIG. 31A-31D are side cross-sectional views showing the manufacturing method of the discharge container of FIG. 30.

First, into the outer container 11 and the inner container 12 molded by blowing, the innermost container 141 attached to the valve assembly 133 (the pouch 141*a* and the connecting member 141*b*) is inserted (FIG. 31A). In this moment, the valve assembly 133 is made to be in a state of being suspended. In other words, the outer seal material A1 the inner seal material A2, and the plate seal material A3 are not exerted.

Figure 31B:
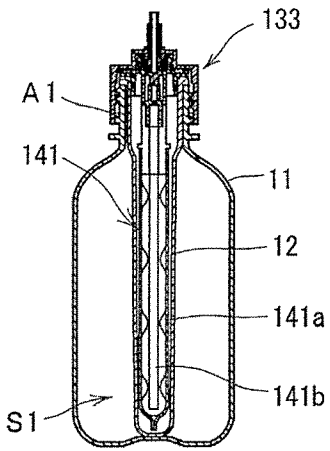

Next, a gas for contraction is filled in the first accommodating chamber S1 between the outer container 11 and the inner container 12 to contract the inner container 12. In this moment, the pouch 141*a* and the connecting member (tube) 141*b* functions as a guide member, the inner container 12 contracts/deforms along the outer surface of the pouch 141*a* (refer to FIG. 31B). In addition, when contracting the inner container 12, if air etc. is filled inside the pouch 141*a*, since the shape of contract and the size of the inner container can be adjusted, it is also possible to contract the inner container 12, while exhausting the air inside the pouch 141*a*.

Figure 31C:
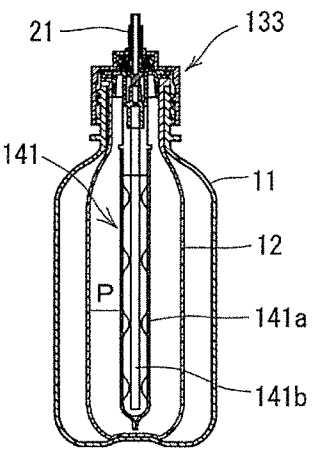

And, the pressurizing agent P is filled in the inner container from the lower end of the cap 136 through the gap between the inner container 12 and the housing 26, at the same time as the completion of filling, the valve assembly 133 is perfectly screwed to the outer container 11 and sealed (what is called undercup filling: FIG. 31C).

Figure 30:
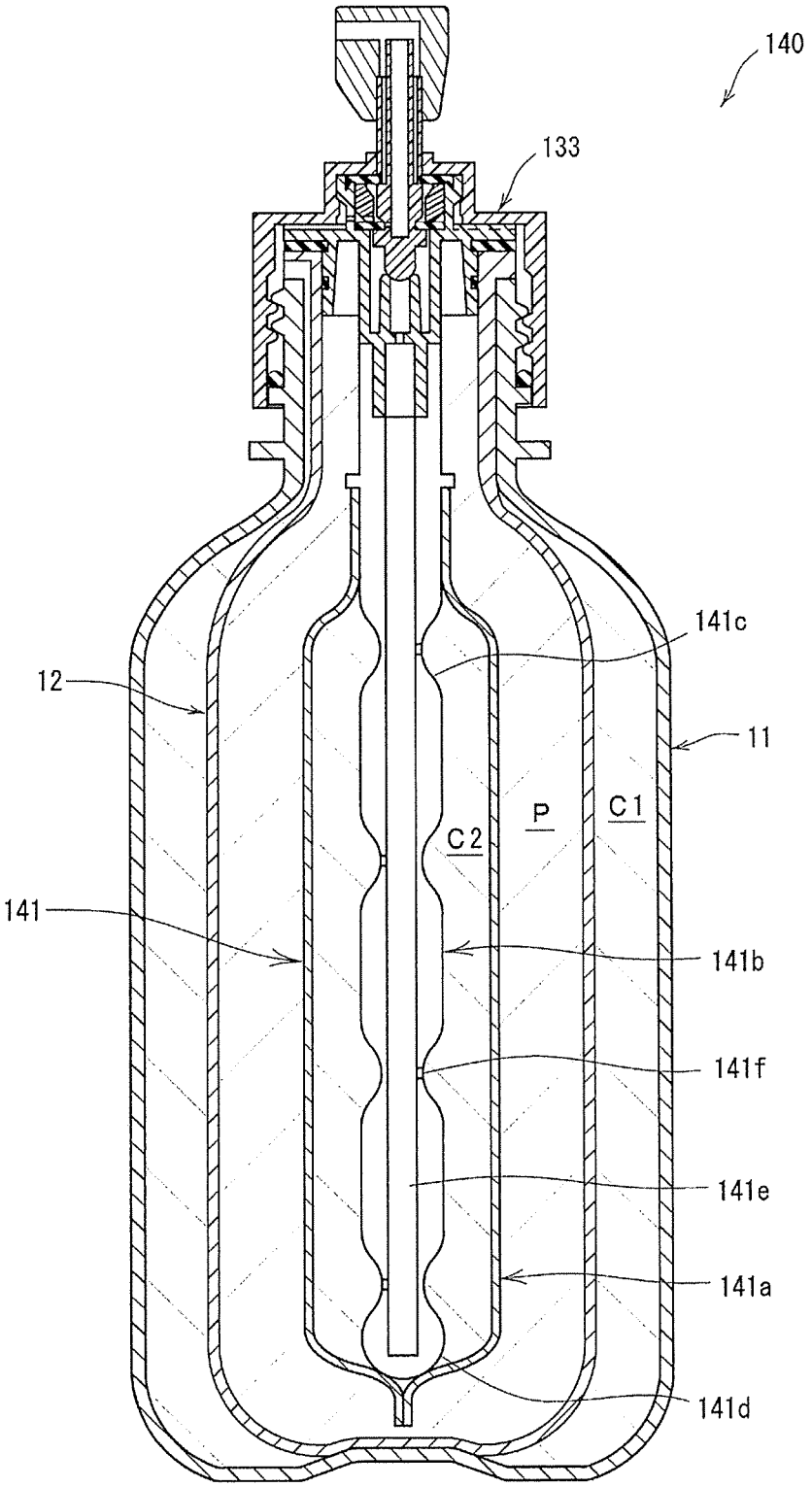
FIG. 30 A cross-sectional view showing the twelfth embodiment of the discharge container of the present invention.
Figure 31D:
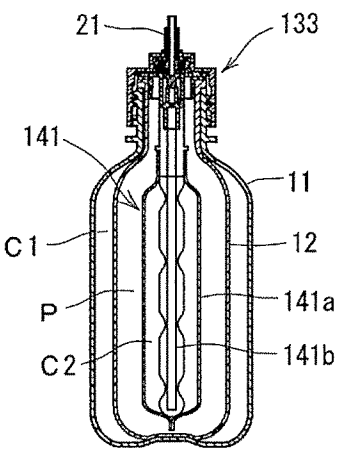

After that, the first concentrate C1 is filled in the first accommodating chamber S1 through the first intra-stem passage 21*a* of the stem 21. Further, the second concentrate C2 is filled in the pouch 24 through the second intra-stem passage 21*b* and a hollow portion 141*c* of the connecting member 141*b* and a communicating hole 141*d* (FIG. 30 and FIG. 31D). And, by attaching a spray member 145 to the stem 21, the manufacture of the discharge product is completed. In addition, the spray member 145 is composed so that any of the first intra-stem passage 21*a* of the stem 21, the second intra-stem passage 21*b* of the stem 21 is not closed, by pushing down the spray member 145, both of the first concentrate C1 in the first accommodating chamber S1 and the second concentrate C2 in the pouch 24 are made to be discharged from the spray member 145. Moreover, it may be made so that each is discharged independently.

In addition, here, the innermost container 142 of the pouch is cited, but it may be formed from a preform of more than triple (multiple preform).

Figure 32:
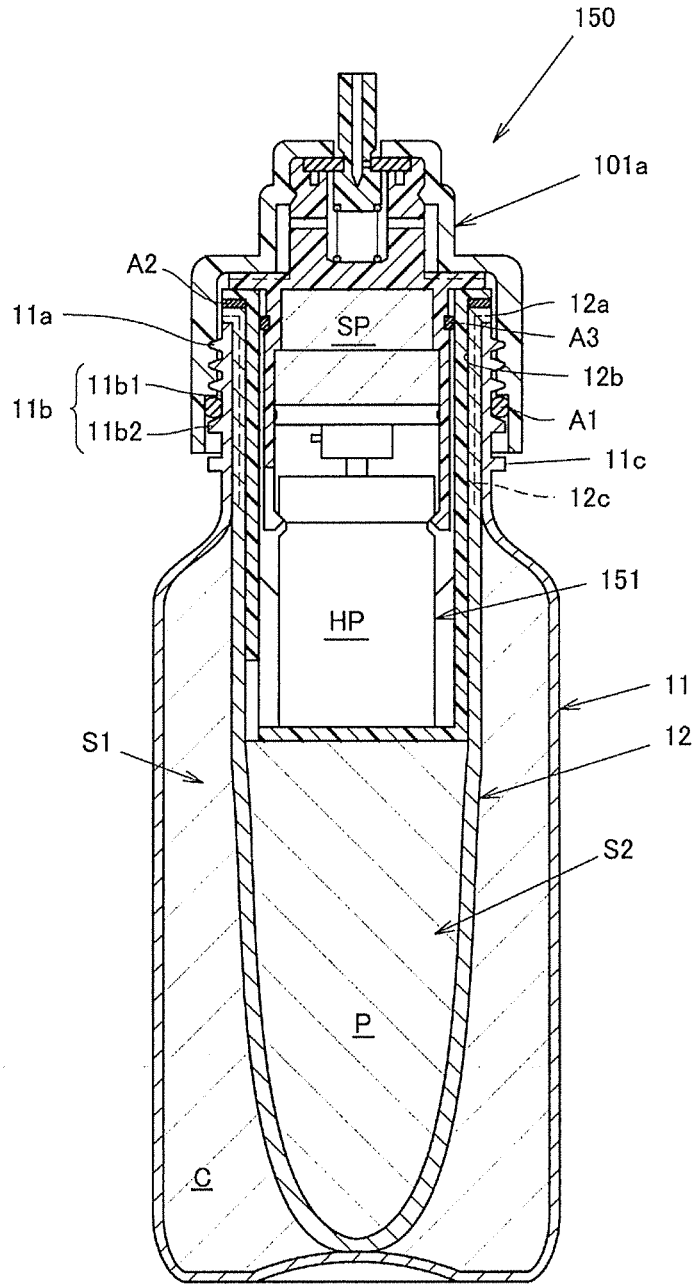
FIG. 32 A cross-sectional view showing the thirteenth embodiment of the discharge container of the present invention.
Figure 33:
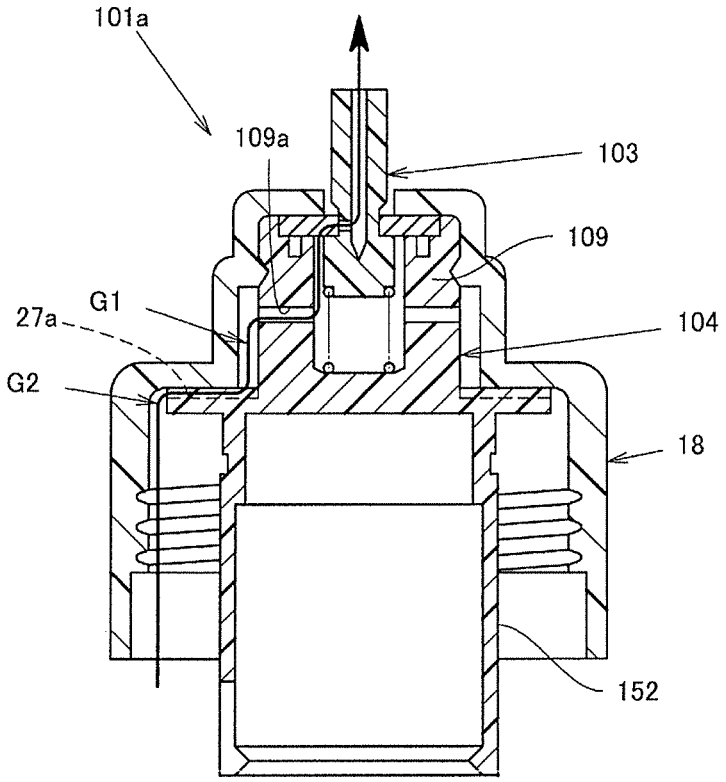
FIG. 33 A side cross-sectional view showing the valve assembly of the discharge container of FIG. 32.

The discharge container 150 of FIG. 32 is that which is provided with a pressure adjusting mechanism 151 adjusting the inner pressure of the inner container 12. In detail, it is provided with the outer container 11, the inner container 12 accommodated therein, a valve assembly 101*a* closing the outer container 11 and the inner container 12, being fixed by engaging with the outer periphery of the outer container, and a pressure adjusting mechanism 151 adjusting the inner pressure of the inner container 12. The outer container 11 and the inner container 12 are substantially same as those of the discharge container 100 of FIG. 21, the content C is filled in the accommodating chamber S1 between the outer container 11 and the inner container 12, the pressurizing agent P is filled in the pressurizing chamber S2. The valve assembly 101*a* is substantially same as the valve assembly 101 of FIG. 21 other than that, as shown in FIG. 33, a cylindrical cylinder portion 152 is integrally formed in the lower end (the lower end of the plug portion 28) of the housing 109, and it has the valve mechanism 103, the valve holder 104, and the cap 18.

Figure 37A:
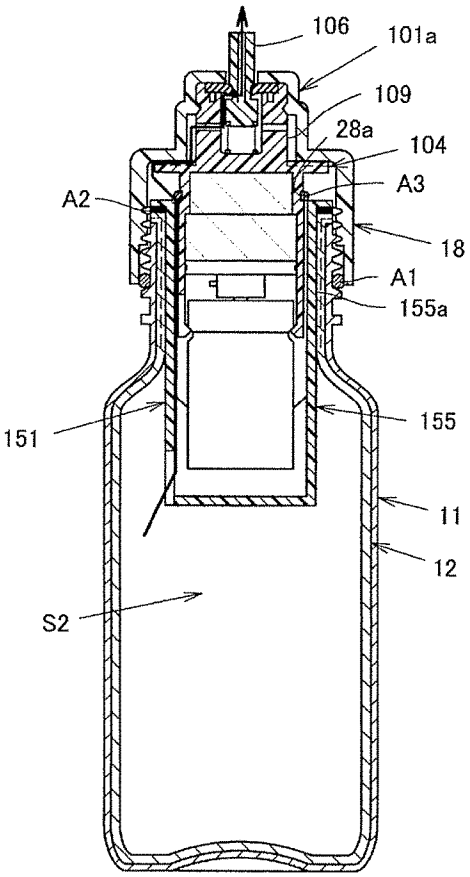
FIG. 37A is an outline drawing showing the exhaust mechanism of the pressurizing agent of the discharge container of FIG. 32.

In this discharge container 100, by moving the cap 18 of the valve assembly 101*a* to the temporary position upper than the fixed position, and pushing down (switching operation) the stem 106 of the valve mechanism 103, the pressurizing chamber S2 and atmospheric air can be communicated (refer to FIG. 37A).

Figure 34A:
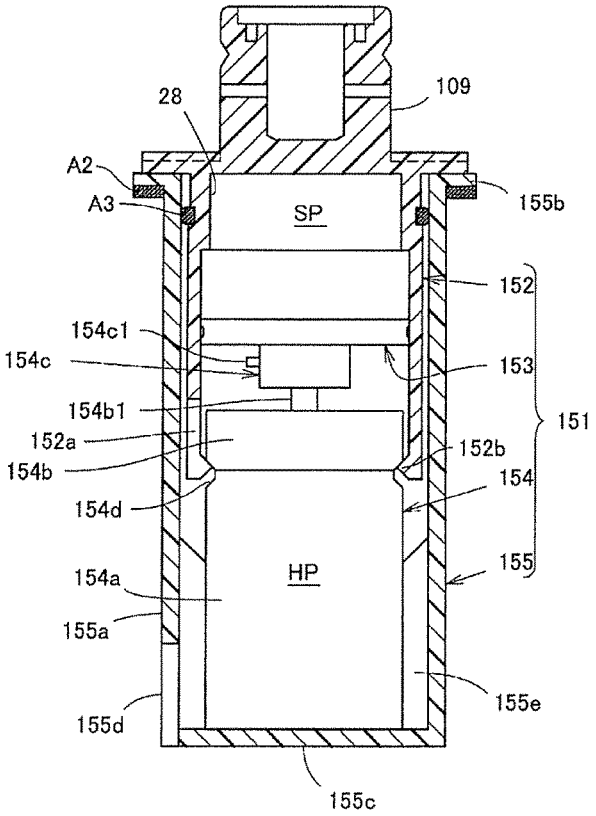
FIG. 34A, 34B is respectively a cross-sectional view showing the state prior to operation and the operating state of the pressure adjustment mechanism of the discharge container of FIG. 32.

The pressure adjusting mechanism 151 is, as shown in FIG. 34A, provided with a cylinder portion 152 described above, a piston 153 accommodated inside the cylinder portion 152, an aerosol container (gas container) 154 in which high pressure gas is filled, being inserted into the lower end of the cylinder portion 152, and a container holder 155 hanged from the opening of the inner container. In addition, in the pressure adjusting mechanism 151, a space inside the cylinder portion 152 surrounded by the lower surface of the housing 109 and the piston 153 serves as the reference pressure chamber SP, the inside of the aerosol container 154 serves as the high pressure chamber HP, and the valve of the aerosol container 154 serves as a valve.

The cylinder portion 152 extends further downward from the lower end of the plug portion 33. In the lower portion of the cylinder portion 152, a slit 152*a* going upward from the lower end is formed. Moreover, in the lower end, a holding claw 152*b* which holds the piston 153 so that the piston 153 of the later described pressure adjusting mechanism 151 does not fall before the valve assembly 101*a* is attached to the outer container 11 is formed. Stated differently, the pressure adjusting mechanism 151 is fixed to the lower end of the valve assembly 101*a* through the cylinder portion 152, and is hanged inside from the opening of the inner container 12. The piston 153 moves up and down contacting tightly the inner surface of the cylinder portion 152. In other words, the piston 153 seals the pressurizing chamber S2 and at the same time, seals the reference pressure chamber SP.

And, by the up and down motion of the piston 153, the reference pressure chamber SP is compressed/expanded. In addition, by the inside of the reference pressure chamber SP being compressed, the air inside is compressed, and the piston 153 receives a reaction force.

The aerosol container 154 comprises a pressure resistant container 154*a*, an aerosol valve 154*b* closing the opening thereof, and a push button 154*c* attached to a stem 154*b*1 of the aerosol valve 154*b*.

By pushing down the push button 154*c* to descend the stem 154*b*1, the aerosol valve 154*b* is opened, the pressurizing agent P in the pressure resistant container 154*a* is sprayed from a discharge port 154*c*1 of the push button 154*c*. The aerosol container 154 may be fixed to the cylinder portion 152 by engaging the holding claw 152*b* of the cylinder portion 152 with an annular recessed portion 154*d* formed in the outer periphery of the aerosol valve 154*b*. In this moment, the piston 153 is arranged on the push button 154*c* of the aerosol container 154. In addition, the push button 154*c* is not necessary to be provided as long as it is composed so that the stem 154*b*1 and the piston 153 are made to be interlocked.

The container holder 155 makes it easy to engage the valve assembly 101*a* with the cylinder portion 152 by stabilizing the position of the aerosol container 154, when the valve assembly 101*a* is attached to the outer container 11. After attaching the valve assembly 101*a* also, it holds the aerosol container 154 to make it easy for the piston 153 and the push button to operate. In detail, it comprises a cylindrical holder body 155*a*, a flange 155*b* formed on the upper end thereof, and a bottom portion 155*c* closing the lower end thereof. The inner upper surface of the holder boy 155*a* is made to be a cylinder, and is a portion to compress the inner container 12 radially. In the lower portion of the holder body 155*a*, a slit 155*d* communicating between the holder body 155*a* and the inner container 12 is formed. And, in the lower inner surface of the holder body 155*a*, a positioning rib 155*e* for positioning the aerosol container 154 is formed aligned radially. The container holder 155 is held by being clamped between the upper end (the flange portion of the inner container 12) of the outer container 11 and the annular flange 27 of the valve holder 17 of the valve assembly 101*a*. Moreover, the lower surface of the flange portion 155*b* is a portion to compress the annular plate seal material A3 downward.

Figure 34B:
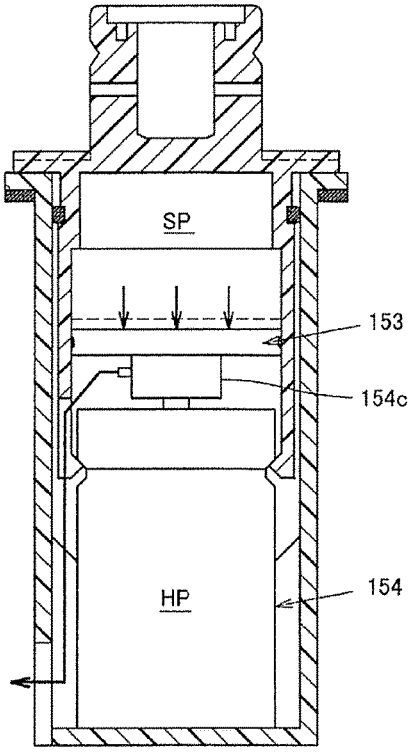

The pressure adjusting mechanism 151 composed as described above operates according to the difference of the pressure of the reference pressure chamber SP and the pressure of the inner container 12 (pressurizing chamber S2). In detail, as shown in FIG. 34B, when the pressure of the reference pressure chamber SP becomes larger than the pressure of the inner container 12, the piston 153 moves so as to expand, in other words, the piston 153 descends. In this moment, the inner pressure of the reference chamber SP decreases. Hence, the push button 154*c* of the aerosol container 154 is pushed, the pressurizing agent P is supplied to the inside of the inner container 12 from the aerosol container 154. And, when the pressurizing agent P is sufficiently supplied in the inner container 12, substantially equalizing the pressure of the reference pressure chamber SP and the pressure of the inner container 12, the piston 153 moves to the original position so as to contract the reference pressure chamber SP by the spring force of the aerosol valve, in other words, the piston 153 ascends. Hence, the push button 154*c* of the aerosol container 154 turns back, and the aerosol valve 154*b* is also shut off.

In addition, a spring to press the piston 153 downward may be set in the cylinder 152. Moreover, in place of the piston, a pressure-position transducer such as a diaphragm may be used.

Figure 35A:
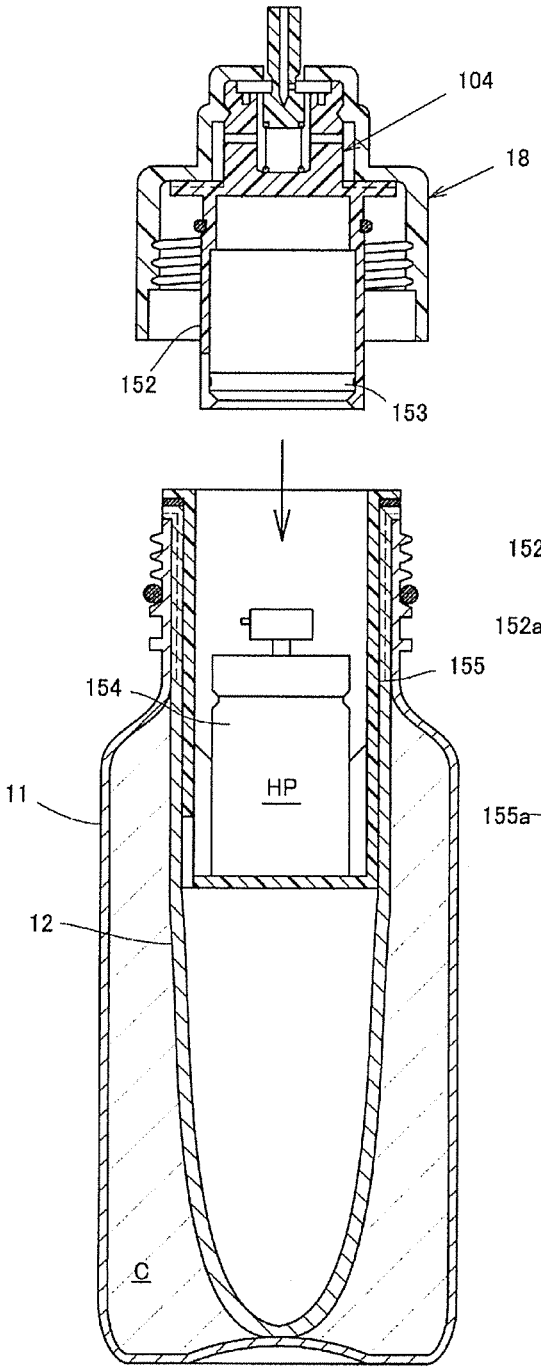
FIG. 35A, 35B are outline drawings of the assembling process of the discharge container of FIG. 32.
Figure 35B:
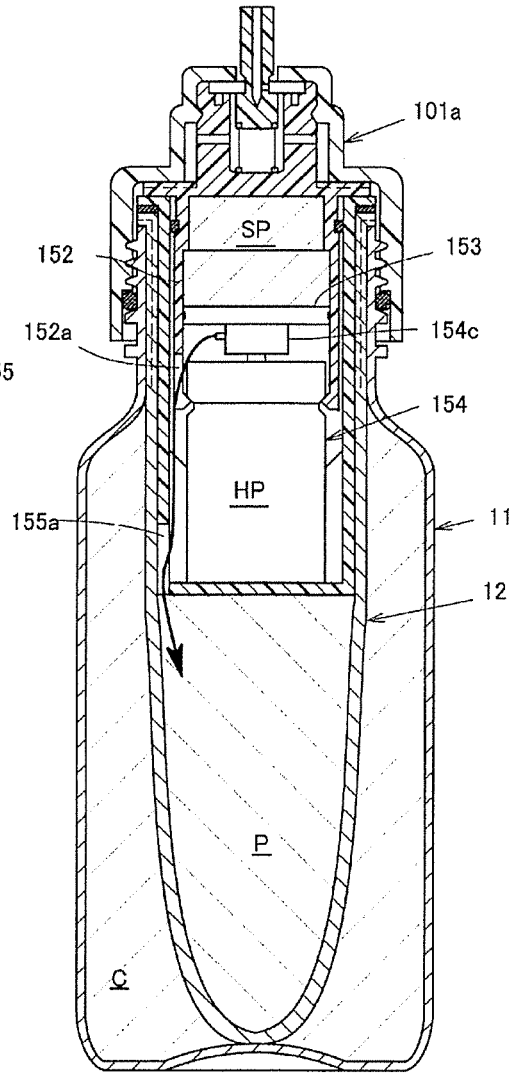

Next, the assembling method of the discharge container 150 is shown. First, a double container (double bottle) consisting of the outer container 11 and the inner container 12 is molded. In this moment, it is preferable that the inner container 12 is once previously contracted with the guide member etc. so that the concentrate chamber S1 is securely formed when the content C is filled. Then, the container holder 155 in which the aerosol container 154 is accommodated is housed inside the inner container 12. Meanwhile, the cap 18 is fixed to the valve holder 17, and a lid member in which the piston 153 is inserted into the cylinder portion 152 of the valve holder 17 is prepared (refer to FIG. 35A). This lid member is fixed to the double container. In this moment, the aerosol container 154 is connected to the cylinder portion 152, and at the same time, the push button 154*c* of the aerosol container 154 pushes up the piston 153, the reference pressure chamber SP is sealed and compressed. However, since the pressurizing agent P is not still filled in the inner container 12, the piston 153 does not ascend higher than the height where the aerosol valve 154*b* of the aerosol container 154 is opened (the state that the push button 154 is somewhat pushed down). Stated differently, as shown in FIG. 35B, the aerosol valve 154*b* becomes an opened state, the pressurizing agent P is sprayed from the push button 152*c* of the aerosol container 154, and supplied to the inside of the inner container 12 through the slit 152*a* of the cylinder portion 152 and the slit 155*d* of the container holder 155. When the inside of the inner container 12 reaches a predetermined pressure, the piston 153 is pushed up to the height where aerosol valve 154*b* is closed, the pressure of the reference pressure chamber SP and the pressure of the inner container 12 substantially balance, the spray of the aerosol container 154 stops (refer to FIG. 33).

As described above, in the discharge container 150, the pressurizing agent P can be filled inside the inner container 12 only by assembling, and a special filling facility of the pressurizing agent is not necessary. Moreover, after assembling the discharge container 150, as later described, the inner pressure of the inner container 12 can be controlled to be constant.

Figure 37B:
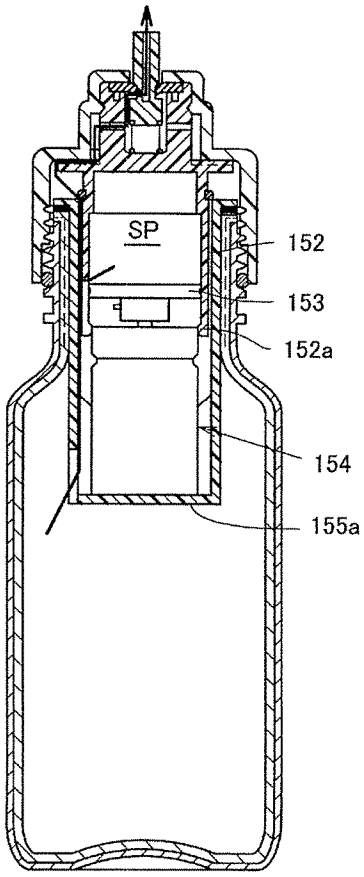
FIG. 37B is an outline drawing showing the exhaust mechanism of the pressurizing agent of the fourteenth embodiment of the discharge container of the present invention.
Figure 37C:
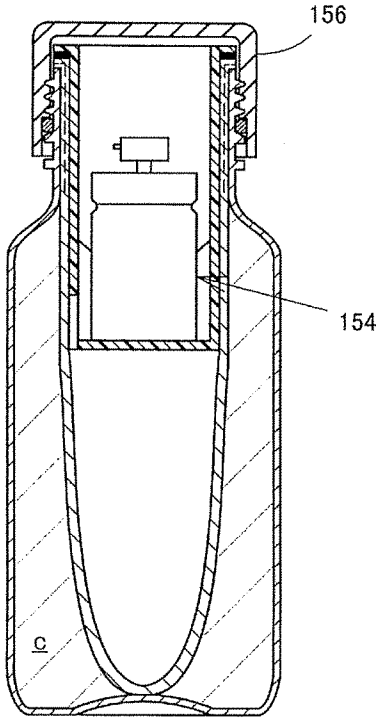
FIG. 37C is a cross-sectional view showing the refill product of the discharge container of FIG. 32.

In addition, the filling of the content C in the accommodating chamber S1 may be carried out before the valve assembly 101*a* is fixed to the double container, and also it may be filled from the stem 106 after fixing to the double container, opening the valve mechanism 103. Particularly, in the case that it is carried out before the valve assembly 101*a* is fixed, the double container (the outer container 11 and the inner container 12), the aerosol container 154, and the container holder 155 can be made to be a refill product. When making it to be the refill product, for, example, it is preferable to seal by a lid member 156, as shown in FIG. 37C. Thereby, the valve assembly 110*a* etc. can be reused. Moreover, it is possible to replace the aerosol container 154 only.

Figure 36A:
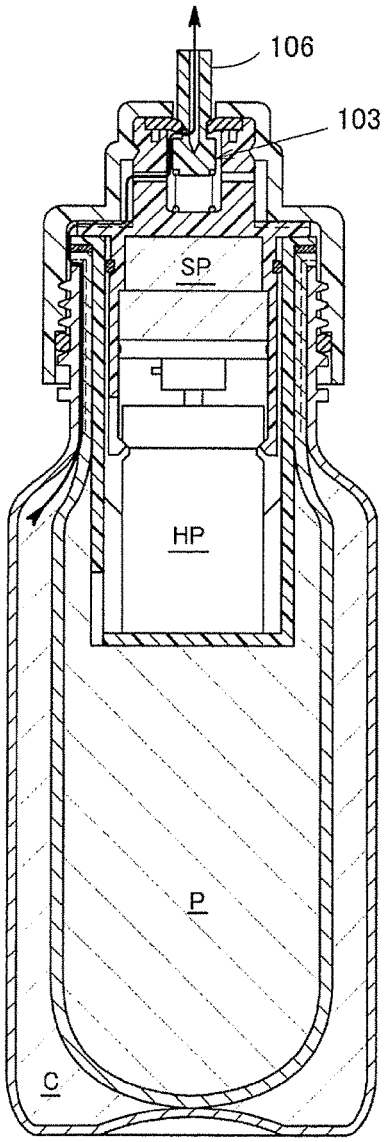
FIG. 36A, 36B are outline drawings of the use state of the discharge container of FIG. 32.
Figure 36B:
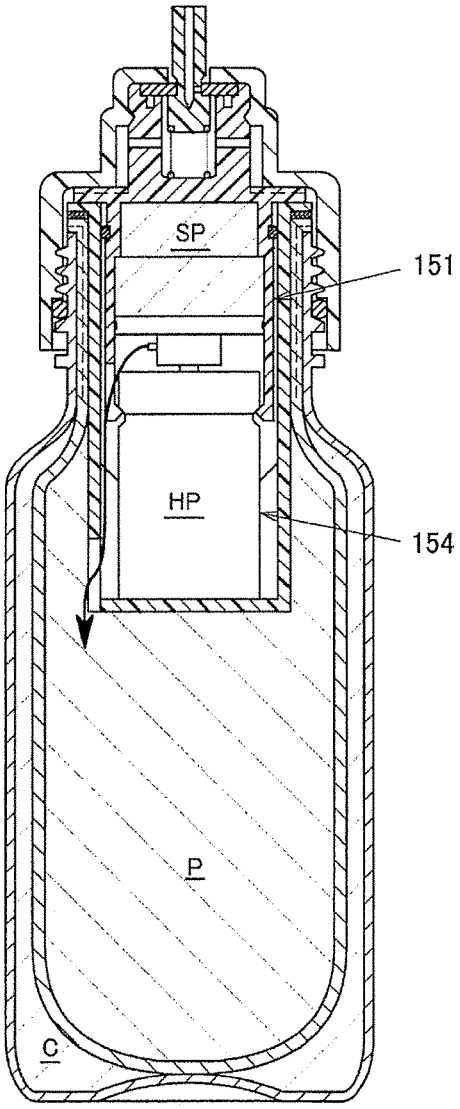

Next, the use method of the discharge container is shown. The use method is that, as shown in FIG. 36A, by the push button etc. (not shown in the figure), the stem 106 is pushed down to open the valve mechanism 103, the content C can be discharged by the pressure of the inner container 12. By the discharge of the content C, the inner container 12 expands, decreasing the inner pressure of the inner container 12, making the pressure adjusting mechanism 151 operate automatically as shown in FIG. 36B. The pressurizing agent P is supplied to the inside of the inner container 12 from the aerosol container 154, when the pressure inside the inner container comes into balance with that of the reference pressure chamber SP, the supply of the pressurizing agent P stops automatically. Every time the content C is discharged, since this supply process and supply stop process of the pressurizing agent P is carried out automatically, the content C can be discharged at the same momentum to the last.

After discharging the content C, as shown in FIG. 37A, the cap 18 is rotated to ascend the lid member (the pressure adjusting mechanism 151 excepting the container holder 155) to the double container (the outer container 11 and the inner container 12) and the container holder 155. In detail, while maintaining the seal structure of the outer seal material A1, the lid member is made to ascend so that the inner seal material A2 held by the inner seal holder 28*a* of the valve holder 17 comes off from the inner surface of the holder body 155*a* of the container holder 155. Thereby, the seal by the inner seal material A2 is released, the pressurizing chamber S2 and the inside of the housing 109 of the valve assembly 101*a* is communicated. Hence, it is possible to induce the pressurizing agent P of the pressurizing chamber S2 into the housing 109 without discharging to the exterior. After that, by pushing down the stem 106 by push button etc. the pressurizing agent P can be discharged to the exterior safely (refer to the thick arrow of FIG. 37A). In this moment, since the inner pressure of the pressurizing chamber S2 becomes lower than the inner pressure of the reference pressure chamber SP, the piston 153 descends, and the aerosol container 154 is also opened. Hence, the pressurizing agent P inside the gas container (the aerosol container 154) can be exhausted to the last. In addition, when the aerosol container 154 is not fixed to the holding claw 152*a* of the cylinder portion 152, as shown in FIG. 37B, the aerosol container 154 is supported to the bottom portion 155*c* of the container holder 155.

Moreover, the piston 153 descends and goes across the slit 152*a*. Hence, the reference pressure chamber SP and the pressurizing chamber S2 are communicated, the pressuring chamber S2 can be exhausted without exhausting the pressurizing agent P of the aerosol container 154 (refer to the thick arrow of FIG. 37B). In this case, the aerosol container 154 can be reused.

Figure 38:
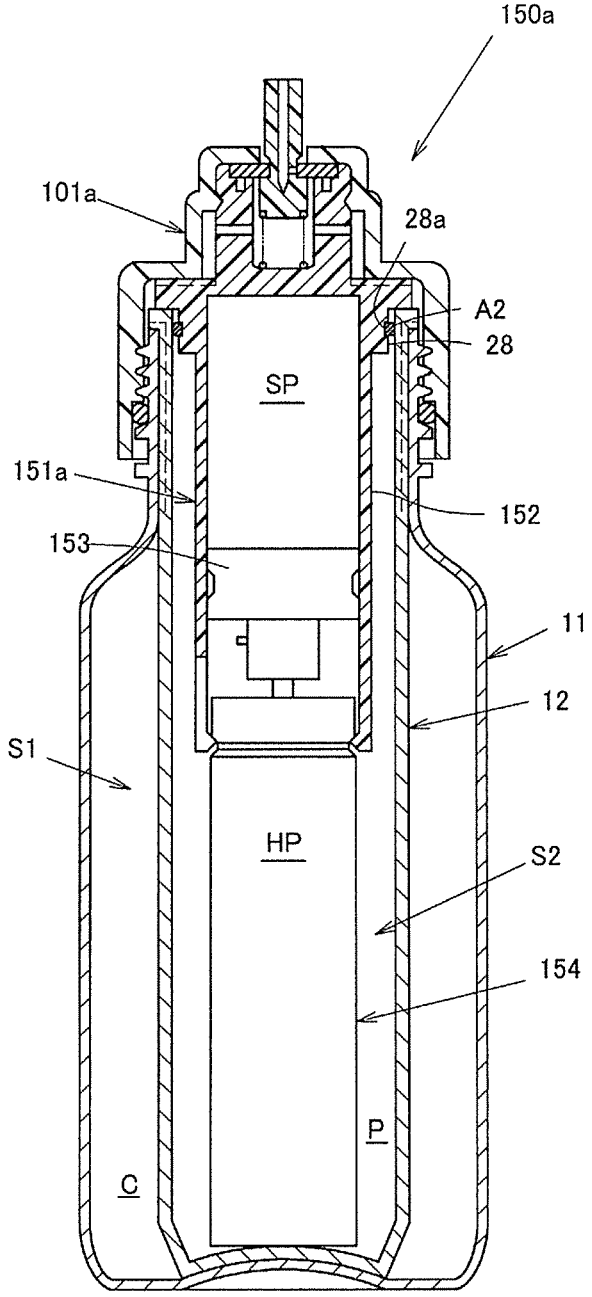
FIG. 38 A cross-sectional view showing the fifteenth embodiment of the discharge container of the present invention.

The discharge container 150*a* of FIG. 38 is different to the discharge container 150 of FIG. 32 in the point that the container holder is omitted, and the aerosol container 154 is placed in the bottom portion of the inner container 12. In detail, it is provided with the outer container 11, the inner container 12 accommodated therein, the valve assembly 101*a* closing the outer container 11 and the inner container 12, and the pressure adjusting mechanism 151*a* to adjust the inner pressure of the inner container, being accommodated in the inner container. The pressure adjusting mechanism 151*a* is attached to the lower end of the valve assembly 13. The outer container 11 and the inner container 12 are substantially same as the discharge container 100 of FIG. 21, the content C is filled in the accommodating chamber S1 between the outer container 11 and the inner container 12, the pressurizing agent P is filled in the pressurizing chamber S2 inside the inner container. The valve assembly 101*a* is substantially same other than that the cylinder portion 152 is made to be longer than the cylinder portion 152 of the valve assembly 101*a* of the discharge container 150 of FIG. 32. In addition, the length of the cylinder portion 152 of FIG. 38 may be made to be same as that of the cylinder portion 152 of FIG. 32, the pressure resistant container of the aerosol container 154 may be lengthened. The inner seal material A2 held in the inner seal holding portion 28*a* of the plug portion 28 of the valve assembly 101*a* is compressed between the bottom portion of the inner seal holding portion 28*a* and the inner cylindrical portion 12*a* of the inner container 12, and seals between the pressurizing chamber S2 and the valve assembly 101*a*.

The pressure adjusting mechanism 151*a* is provided with the above described cylinder portion 152, the piston 153 accommodated inside the cylinder portion 34, and the aerosol container (gas container) 154 in which a high pressure gas is filled, being inserted into the lower end of the cylinder portion 153, the aerosol container 154 being placed in the bottom portion of the inner container 12. The piston 153 and the aerosol container (gas container) 154 are substantially same as the pressure adjusting mechanism 151 of FIG. 32. And, in the pressure adjusting mechanism 151*a*, the space inside the cylinder portion 152 serves as the reference pressure chamber SP, the inside of the aerosol container 154 serves as the high pressure chamber HP, the valve of the aerosol valve 154 serves as a valve. This pressure adjusting mechanism 151*a* also, same as the pressure adjusting mechanism 151 of the discharge container of FIG. 32, operates according to the pressure difference of the pressure of the reference pressure chamber SP and the pressure of the inner container 12 (the pressurizing chamber S2). In order to place the aerosol container 154 in the inner container 12, as later described, the aerosol container 154 is placed in the inner container 12, and after that, by attaching the valve assembly 101*a*, it can be assembled. In this occasion, the cylinder portion 152 and the aerosol container 154 are easy to be connected.

The assembling method of the discharge container 150*a* is shown below.

Figure 39A:
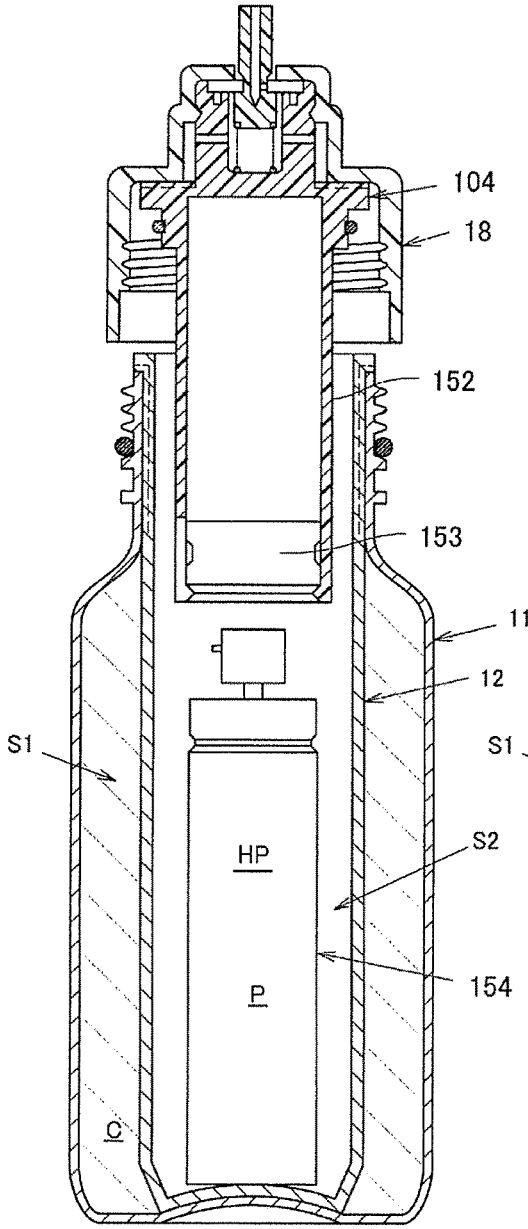
FIG. 39A, 39B are outline drawings of the assembling process of the discharge container of FIG. 38.

First, a double container consisting of the outer container 11 and the inner container 12 is molded. Then, the aerosol container 154 is housed inside the inner container 12. Meanwhile, the cap 18 is fixed to the valve holder 17, and a lid member in which the piston 153 is inserted into the cylinder portion 152 of the valve holder 17 is prepared (refer to FIG. 39A).

Figure 39B:
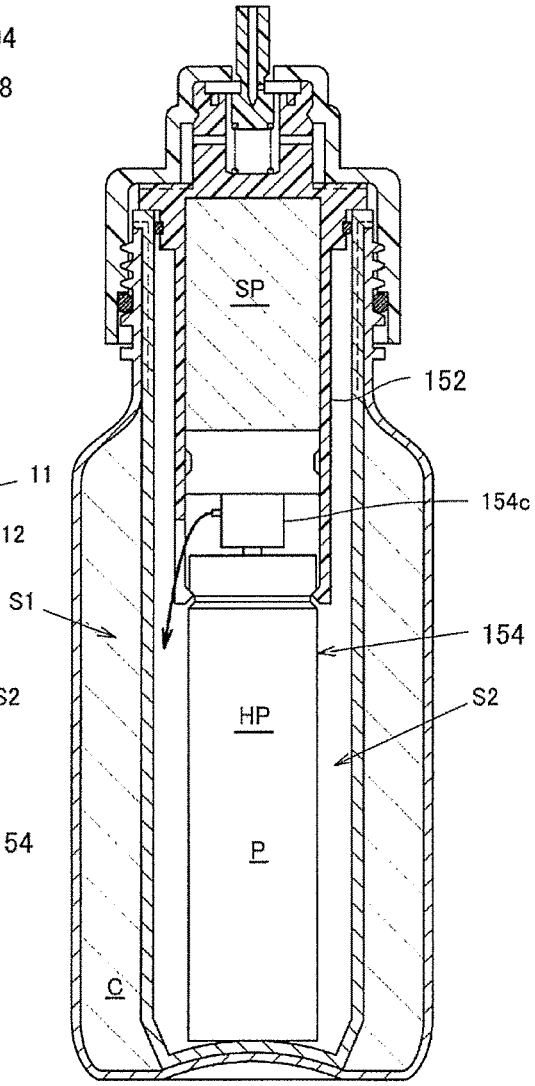

This lid member is fixed to the double container. In this moment, the aerosol container 154 is connected to the cylinder portion 152, and at the same time, the push button 154*c* of the aerosol container 154 pushes up the piston 153, the reference pressure chamber SP is sealed and compressed (refer to FIG. 39B). Same as the discharge container 150 of FIG. 32, the aerosol valve 154*b* of the aerosol container 154 opens at the same time, the pressurizing agent P is supplied to the inside of the inner container 12 from the push button 154*c* of the aerosol container 154. When the inside of the inner container 12 reaches a predetermined pressure, the piston 153 is pushed up to the height where the aerosol valve 154*b* closes, the pressure of the reference pressure chamber SP and the pressure in the inner container 12 substantially balance, the spray of the aerosol container 154 stops.

In this discharge container 150*a* also, as described above, same as the discharge container 150 of FIG. 1, the pressurizing agent P can be filled inside the inner container 12 by only assembling, making a special filling facility unnecessary. Moreover, after assembling the discharge container 150*a*, as later described, the inner pressure of the inner container 12 can be controlled to be constant. In addition, the filling of the content C in the concentrate chamber S1 may be carried out either before and after the fixing of the valve assembly 101*a* to the double container. In this discharge container 150*a* also, the outer container 11, the inner container 12, the aerosol container 154, and the content C filled in the concentrate chamber S1 can be made to be a refill product. In the case that it is made to be refill product, same as the discharge container 150 of FIG. 32, it is preferable to seal with the lid member 156 as shown in FIG. 36.

In addition, in the discharge container 150*a* of FIG. 38, the aerosol container 154 is placed in the bottom portion of the inner container 12, but it may be hanged in the inner container 12 without being supported by the bottom portion of the aerosol container 154.

Figure 40:
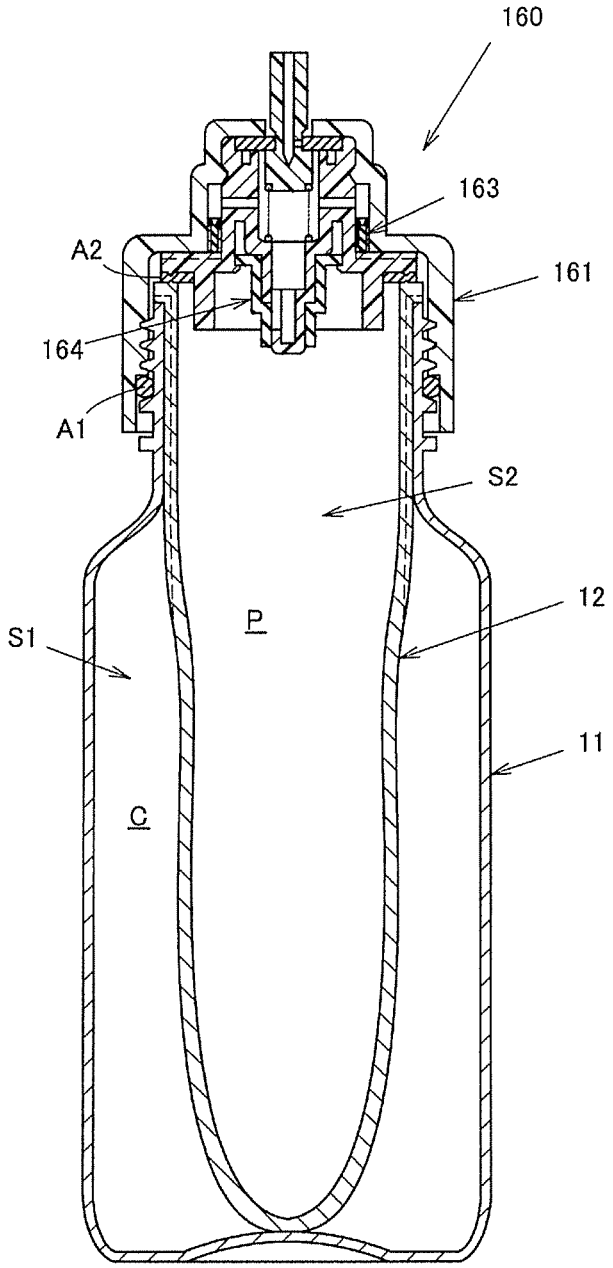
FIG. 40 A cross-sectional view showing the sixteenth embodiment of the discharge container of the present invention.

The discharge container 160 of FIG. 40 is that in which a check valve for concentrate which shuts off a fluid going to the accommodating chamber S1 from the exterior and let through the fluid going to the exterior is provided in the discharge passage between the accommodating chamber S1 and atmospheric air. In detail, it is provided with the outer container 11, the inner container 12 accommodated in the outer container 11, and a valve assembly 161 closing the outer container 11 and the inner container 12, in which the above described check valve for concentrate is provided. The outer container 11 and the inner container 12 are substantially same as those of the discharge container 100 of FIG. 21, the content C is filled in the accommodating chamber S1 between the outer container 11 and the inner container 12, the pressurizing agent P is filled in the pressurizing chamber S2 inside the inner container. The valve assembly 161 has the concentrate passage Z1 (refer to FIG. 42A) which communicates the accommodating chamber S1 and the exterior, and the gas passage Z2 (refer to FIG. 42B) which communicates the pressurizing chamber S2 and the exterior. And, in the concentrate passage Z1, a check valve 163 for concentrate which shuts off the fluid going to the accommodating chamber S1 from the exterior, and let through the fluid going to the exterior from the accommodating chamber S1 is provided. In the gas passage Z2, a check valve 164 for gas which shuts off the gas going to the exterior from the pressurizing chamber S2, and let through the gas going to the pressurizing chamber S2 from the exterior is provided.

The valve assembly 161 is, as shown in FIG. 41A, has a valve holder 165 arranged so as to close the opening of the outer container 11 and the inner container 12, having a first communicating hole 165*a* (the concentrate passage Z1) communicating the exterior and the accommodating chamber S1, and a second communicating hole 165*b* communicating the exterior and the pressurizing chamber S2, the valve mechanism 103 accommodated in the valve holder 17, an annular moving valve 166 (the check valve 163 for concentrate) opening/closing the concentrate passage Z1, an elastic valve 167 (the check valve 164 for gas) opening/closing the gas passage Z2 (the son communicating hole 165*b*), and a cap 168 which holds the valve mechanism 106 in the valve holder 165, and fixes the valve holder 165 to the outer container 11. The valve mechanism 106 is substantially same as the discharge container 100 of FIG. 21.

The valve holder 165 is, as shown in FIG. 41B, is provided with a cylindrical valve housing 171 in which a first communicating hole 165*a* is formed in the side surface, a second communicating hole 165*b* is formed in the side surface lower than the first communicating hole 165*a*, and an annular support flange 172 provided in the outer periphery of the valve housing 171 so as to protrude outward radially.

The valve holder 165 is molded by injection molding etc. from synthetic resin such as polypropylene, polyacetal, polyethylene terephthalate.

The valve housing 171 comprises a cylindrical housing body 173 in which the valve mechanism 106 is accommodated, and a cylindrical gas supply portion 174 protruding downward so as to communicate with the housing body 173.

The housing body 173 has a rubber holding portion 173*a* supporting the stem rubber 107 of the valve mechanism 106 provided in the upper end thereof, a plurality of the first communicating holes 165*a* provided radially in the side surface at an equal interval, an annular bottom portion 173*b* provided beneath the first communicating hole 165*a*. Moreover, in the upper outer periphery spaced upper than the first communicating hole 165*a*, an annular engaging groove 173*c* engaging with the cap 168 is formed. The first communicating hole 165*a* is provided more than two, for example, 2-8. The gas supply portion 174 is a cylindrical body in which the second communicating hole 165*b* is provided, and is a portion to which the elastic valve 167 is attached, and communicates with the annular bottom portion 173*b* of the valve holding portion 174. In detail, the outer shape is that in which a large diameter portion 174*a*, a medium diameter portion 174*b*, a small diameter portion 174*c* are provided coaxially beginning at the top. The lower portion of the small diameter portion 174*c* is closed, and the second communicating hole 165*b* is formed in the side surface thereof. By forming the outer shape with a plurality of step portions as the large diameter portion 174*a*, the medium diameter portion 174*b*, the small diameter portion 174*c*, the falling off of the elastic body 167 is prevented. The outer surface of the gas supply portion 174 (for example, the outer surface of the medium diameter portion 174*b* and the lower surface of the large diameter portion 174*a*) and the inner surface of the elastic valve 167 (for example, the medium diameter portion 167*b* and flange portion 167*c*) may be adhered by an adhesive etc. so that the second communicating hole 165*b* opens to the fluid going to the pressurizing chamber S2 from the gas supply portion 174.

The support flange 172 is provided with a cylindrical valve guide portion 172*a* extending downward from the first communicating hole 165*a* of the valve housing, and an annular flange portion 172*b* extending outward radially from the lower end thereof, and a cylindrical seal material holding portion 172*c* extending downward from the central lower surface of the flange portion 172*b*.

The moving valve 166 is arranged in the outer periphery of the valve guide portion 172*a*. The moving valve 166 moves vertically in the outer periphery of the valve guide portion 172*a*. Moreover, in the lower end inner surface of the valve guide portion 172*a*, an annular engaging protrusion 172*a*1 engaging with the tip of the flange portion 167*c* of the later described elastic valve 167 is provided.

In the upper surface of the flange portion 172*b*, a plurality of the lateral passage grooves 27*a* is provided radially at an equal interval. The number of this lateral passage grooves 27*a* is made to be the same as that of the longitudinal passage groove 12*c* of the inner container 12, and it is positioned at the same angle with the longitudinal passage groove 12*c* at planar view. Thereby, the lateral passage grooves 27*a* and the outer end side of the flange portion 172*b* compose a part of the above described concentrate passage Z1, and are communicated with the longitudinal passage groove 12*c* of the inner container 12 (refer to FIG. 42).

Moreover, the flange portion 172*b* is composed so that the outer diameter is made to be somewhat smaller than the outer diameter of the flange portion 12*b* of the inner container 12 (refer to FIG. 40). Thereby, the gap G2 is made to be formed in the outer periphery of the flange portion 172*b*, and is easy to be communicated with the lateral passage grooves 27*a*.

However, it may be substantially same as the outer diameter of the flange portion 12*b* of the inner container 12. In this case, the inner surface diameter of the cap 168 is adjusted so that the gap G2 is formed in the outer periphery of the flange portion 12*b*.

And, a seal locking portion 172*d* protruding downward is formed in the outside of the seal material support portion 172*c*, being the lower surface of the flange portion 172*b*.

A ring like seal material A2 is arranged in the outer periphery of the seal support portion 172*c* (refer to FIG. 40, 42). This seal material A2 is a member to seal between the inner container 12 and the exterior by being compressed vertically. In this embodiment, the outer surface of the valve guide portion 172*a* and the outer surface of the valve housing 171 (gas supply portion 174) is made to be inside and outside surfaces provided coaxially, but it may be made to be an identical surface, for example, as shown in FIG. 46. As this embodiment, by making the gas supply portion 174 of the valve housing 171 to be reduced in diameter than the valve guide portion 172*a* and to be provided inside, it becomes possible to miniaturize the valve holder 165 wholly.

The moving valve 166 is, as shown in FIG. 41C, a ring like cylindrical body. In the inside and outside surface of the upper portion, an annular skirt portion 166*a* formed to be taper like so as to expanded in diameter upward is formed. The cross section thereof presents an approximate Y character. Moreover, in the lower end inner surface, an annular notched portion 166*b* formed taper like so as to be reduced in diameter upward is formed. Further, in the center of the upper end surface, an annular groove 166*c* is formed.

In the moving valve 166, the skirt portion 166*a* slightly bends so as to close the annular groove 166*c* against a fluid flowing from underneath, the skirt portion 166*a* slightly bends so as to open the annular groove 166*c* against the fluid flowing from above. Since being composed as described above, the fluid from above is stopped and the fluid from underneath is let through. The moving valve 166 like this is molded from, for example, synthetic resin such as low molecular mass poly ethylene, and silicone rubber etc.

The elastic valve 167 is that which covers the outer periphery of the above described gas supply portion 174. In detail, as shown in FIG. 41D, it is provided with a small diameter portion 167*a* covering the small diameter portion 174*c* of the gas supply portion 174, a medium diameter portion 167*b* covering the medium diameter portion 174*b* of the gas supply portion 174, being continuous with the small diameter portion 167*a*, and a flange portion 167*c* arranged along the lower surface of the large diameter portion 174*a* of the gas supply portion 174. The tip of the flange portion 167*c* engages with the engaging protrusion 172*a*1 of the support flange 172 of the valve holder 165. In addition, the shape of the elastic valve 167 may be selected according to the shape of the gas supply portion 174 taking into consideration the attaching state to the gas supply portion 174.

Being composed as described above, against the fluid going to the exterior (inside the inner container 12) of the gas supply portion 174 from the second communicating hole 165*b* of the gas supply portion 174, the small diameter portion 167*a* deforms so as to expand, letting through the fluid to the exterior of the gas supply portion 174, against the fluid going to the second communicating hole 165*b* from the exterior of the gas supply portion 174, the gas supply portion 174 disturbs the deformation of the elastic valve 167 to stop the fluid. The elastic valve 167 is molded from, for example, the rubber such as nytril rubber, butyl rubber, silicone rubber.

The cap 168 is, as shown in FIG. 41A, comprises a cylindrical cover portion 176 covering the valve holder 165, and a fixing portion 177 attached to the outer container 11. The cover cap 168 forms the gap G1 with the inside surface thereof and the outer surface of the valve holder.

The cover cap 168 is molded by the injection molding of synthetic resin, for example, such as polyacetal, polybutylene terephthalate.

The cover portion 176 comprises a circular plate like top surface 181, a cylindrical valve fitting portion 182 extending downward from the edge portion thereof, and a cylindrical diameter-expanded portion 183 extending downward, being expanded in diameter than the valve fitting portion 182. In the top surface 181, a center hole 181*a* to let through the stem 109 is formed. In the lower portion of the valve fitting portion 182, an annular engaging protrusion 182*a* protruding inward radially is formed. This engaging protrusion 182*a* engages with, as described above, the annular engaging groove 173*c* of the valve holder. Thereby, the valve holder 165 is fixed to the cover cap 168.

The diameter-expanded portion 183 is a portion, the inner surface of which is expanded in diameter than the inner surface of the valve fitting portion 182. Stated differently, between the inner surface of the diameter-expanded portion 183 and the valve guide portion 172*a* (the outer periphery of the valve housing 171) of the valve holder 165, the cylindrical gap G1 extending vertically is formed. Moreover, a first step portion 183*a* between the valve fitting portion 182 and the diameter-expanded portion 183 becomes upper than the first communicating hole 165*a* at intervals. The space G1 consists of an evacuation passage space G1*a* upper side than the first communicating hole 165*a*, and a passage space G1*b* lower side than the first communicating hole 165*a*. And, the evacuation passage space G1*a* serves as an evacuation passage, the passage space G1*b* serves as a part of the concentrate passage Z1 (refer to FIG. 42A, 42B).

The fixing portion 177 is, as shown in FIG. 41A, presents a shape expanded in diameter from the cover portion 176 thereof. In detail, it comprises a ring like medium top face 186 extending outward radially from the lower end of the diameter-expanded portion 183 and a cylindrical locking cylinder portion 187 extending downward from the edge portion thereof. The diameter of the inner surface of the locking cylinder portion 187 is made to be larger than the diameter of the outer end of the flange portion 172*b* of the valve holder 165. The lower surface of the medium top face 186 is arranged so as to contact the upper surface of the flange portion 172*b* of the valve holder 165. However, as described above, a plurality of passages is formed radially at an equal interval by the lateral passage groove 27*a* formed in the flange portion 172*b*. In addition, this lateral passage groove may be formed in the lower surface of the medium top face 186. This lateral passage groove 27*a* is, as described above, arranged so as to communicate with the longitudinal passage groove 12*a*. Moreover, in the inner surface of the locking cylinder portion 187, a screw 187*a* engaging with the screw 11*a* of the outer container 11 is formed. Further, beneath the screw 187*a*, an inner cylindrical portion 187*b* expanded in diameter is formed so as to cover the seal holding portion 11*b*, and it compresses radially the outer seal material (O ring) A1 held by the outer seal material holding portion 11*b* of the outer container 11 between the outer surface of the neck portion of the outer container and the inner cylinder portion 187*b*, and seals between the outer container 11 and the exterior (refer to FIG. 40).

Figure 42A:
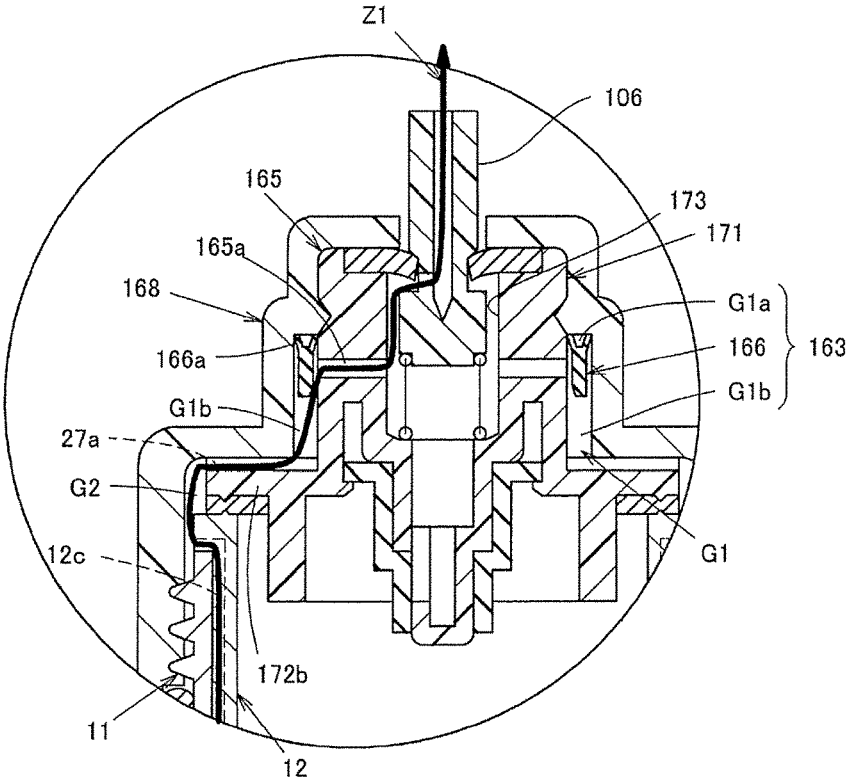
FIG. 42A, 42B is respectively an outline drawing showing the concentrate passage and the gas passage of FIG. 40.

The concentrate passage Z1 of the valve assembly 161 is, as shown in FIG. 42A, passes through the inside of the housing body 173 from the stem 106 communicating with the exterior, goes out to the exterior of the valve housing 171 from the first communicating hole 165*a*, and reaches to the passage space G1*b* (lower side than the first communicating hole 165*a* between the valve holder 165 and the cap 168), the lateral passage groove 27*a*, and the gap G2 of the outside of the flange portion 172*b* of the valve holder.

Stated differently, the concentrate passage Z1 consists of the stem 106 of the valve mechanism, the inside of the valve housing 171 of the valve holder 165, the first communicating hole 165*a*, the passage space between the outer periphery of the valve housing 171 and the cover cap 168, and the passage (the gap G2 of the lateral passage groove 27*a* and the outside of the support flange) between the support flange 172 of the valve holder and the cover cap 168. And, this concentrate passage Z1 communicates with the accommodating chamber S1 between the outer container 11 and the inner container 12 through the longitudinal passage groove 12*c*.

The check valve for concentrate 163 of the concentrate passage Z1 consists of the passage space G1*b* which is a part of the concentrate passage Z1 (lower side than the first communicating hole 165*a* between the valve holder 165 and the cover cap 168), the evacuation passage space G1*a* being the evacuation passage (upper side than the first communicating hole 165*a* of the gap G1*a* between the valve holder 165 and the cap 168) and the moving valve 166 accommodated in the gap G1. Stated differently, when the fluid going to the accommodating chamber S1 from the exterior is supplied to the concentrate passage Z1, the skirt portion 166*a* of the moving valve 166 slides inside the space G1, and moves to the passage space G1*b* side (refer to FIG. 42B). After that, the fluid presses the annular groove 166*c* of the moving valve 166 supported to the flange 172*b*, the skirt portion 166*a* bends slightly so as to open the annular groove 166*c*, and seals the concentrate passage Z1. Meanwhile, when the fluid going to the exterior from the accommodating chamber S1 is supplied to the concentrate passage Z1, since the skirt portion 166*a* receives pressure from below, the annular groove 166*c* bends slightly to so as to close, the seal across the space G1 is released, or becomes to be slidable, and it slides in the space G1 and moves to the evacuation passage G1*a* side. Thereby, the concentrate passage Z1 becomes communicated.

Figure 42B:
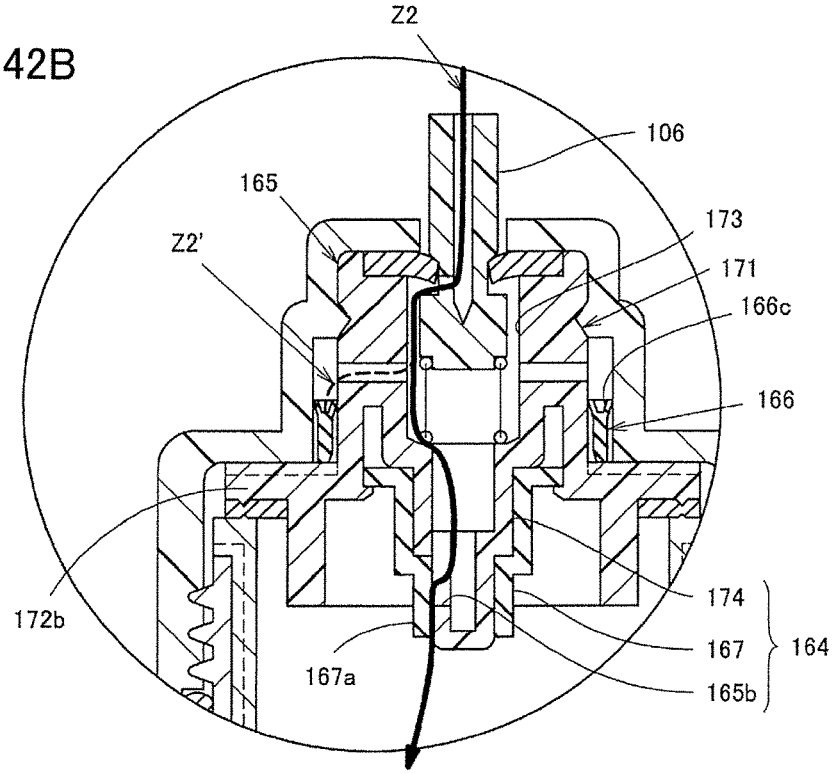

Meanwhile, the gas passage Z2 of the valve assembly 161 is, as shown in FIG. 42B, reaches to the second communicating hole 165*b* from the gas supply portion 174, passing through inside the housing body 173 from the stem 106 communicated with the exterior.

In other words, this gas passage Z2 consists of the stem 106, the inside of the valve housing 171 of the valve holder 65 of the valve assembly 161, and the second communicating hole 165*b*.

And, this gas passage Z2 is communicated with the pressurizing chamber S2 directly.

The check valve 164 for gas of the gas passage Z2 consists of the gas supply portion 174, the second communicating hole 165*b* thereof, and the elastic valve 167. Stated differently, the fluid going to the pressurizing chamber S2 from the exterior is supplied to the gas passage Z2, the small diameter portion 167*a* of the elastic valve 167 deforms to open the second communicating hole 165*b*. Meanwhile, the fluid going to the exterior from the pressurizing chamber S2 is supplied to the gas passage Z2, the outer periphery surface of the gas supply portion 174 disturbs the deformation of the elastic body 167, the second communicating hole 165*b* is maintained to be in the state being closed by the elastic valve 167.

Next, the filling process of the concentrate and the pressurizing agent into the two-layer discharge container 160 is shown in FIG. 43.

Figure 43A:
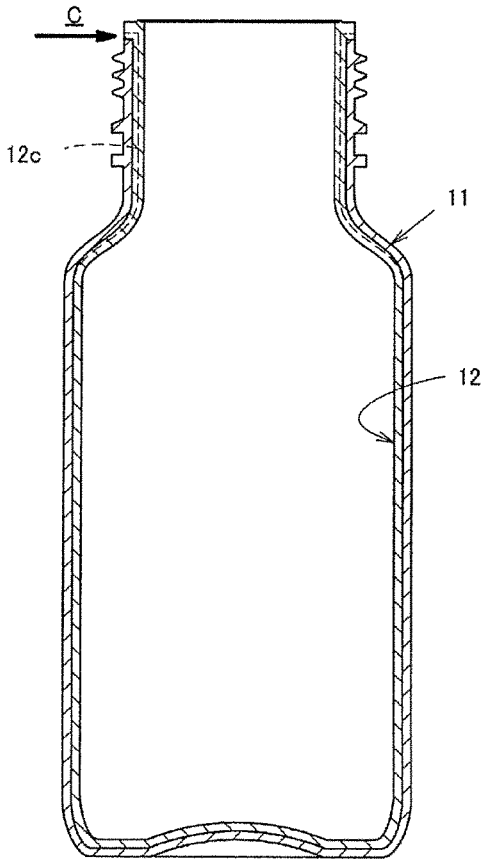
FIG. 43A, 43B is respectively an outline drawing showing the filling process of the discharge container of FIG. 40.

As shown in FIG. 43A, the outer container 11 and the inner container 12 are molded, and the concentrate C is filled between the outer container 11 and the inner container 12 (the accommodating chamber S1). Thereby, the inner container 12 is crushed (refer to FIG. 43B). In this moment, as described above, it is preferable to carry out the filling after contracting the inner container 12 previously using the guide member.

Next, the valve assembly 161 is fixed to the outer container 11 and the inner container 12.

Figure 43B:
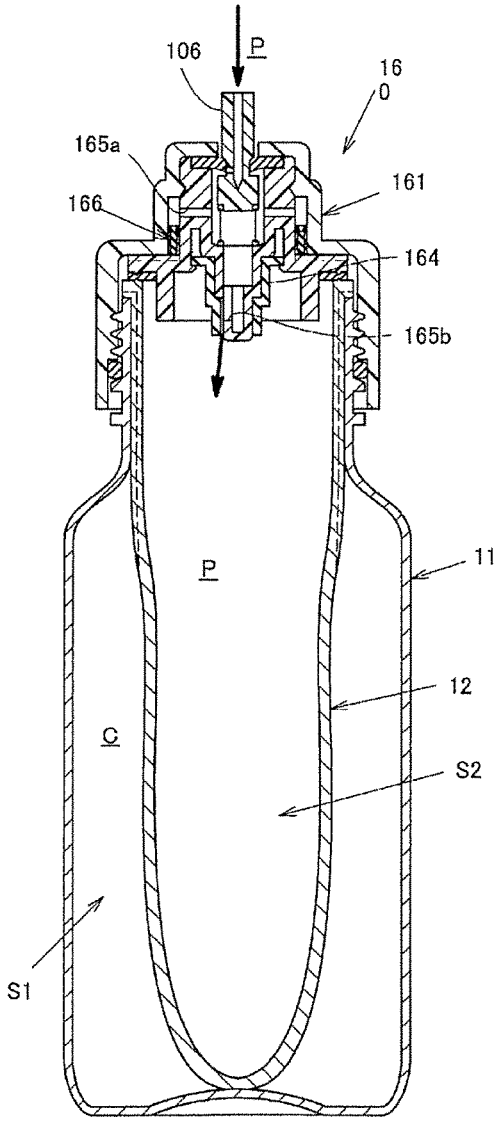

After that, as shown in FIG. 43B, it is manufactured so that at the same time with the pushing down of the stem 106, the pressurizing agent P is filled in the pressuring chamber S2 from the stem 106 through the gas passage Z2. In this moment, the pressurizing agent P is also supplied to the first communicating hole 165*a*, but as described above, since the moving valve 166 of the check valve 163 for concentrate shuts off the concentrate passage Z1, the pressurizing agent P is not filled in the accommodating chamber S1 (refer to Z2' of FIG. 42B). Once, the pressurizing agent P is filled in the pressurizing chamber S2, the inside of the pressurizing chamber S2 becomes higher pressure than the exterior. Hence the pressurizing agent P tends to go to the exterior. But, the check valve for gas 164 shuts off the passage Z2 for gas (the second communicating hole 165*b*), the flowing back of the pressurizing agent P is prevented.

Figure 44A:
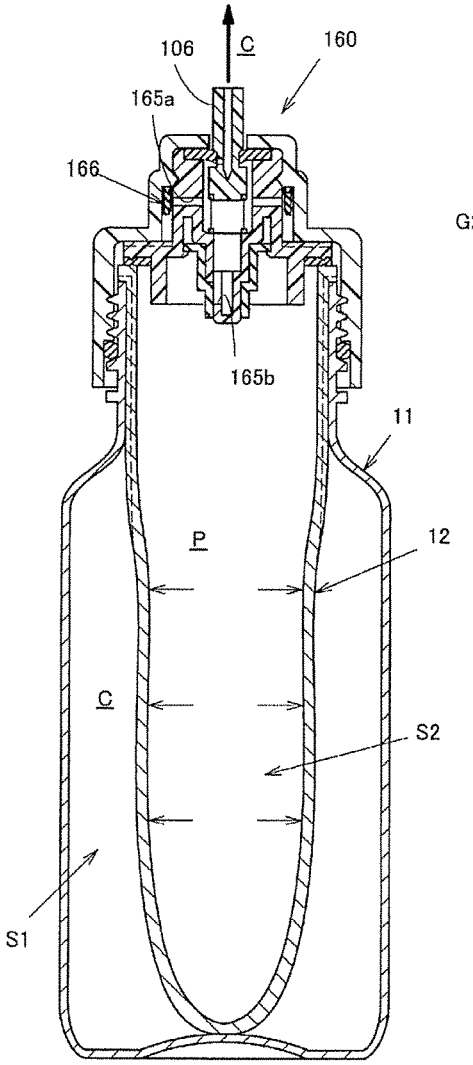
FIG. 44A, 44B is respectively an outline drawing showing the use state and the discarded state of the discharge container of FIG. 40.
Figure 44B:
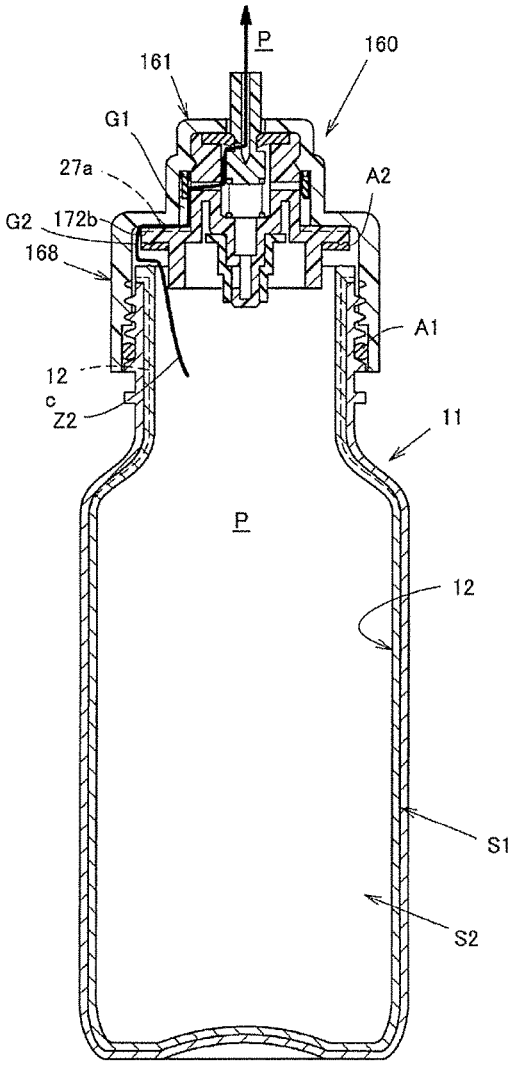

The use state of this two-layer discharge container 160 is shown in FIG. 44A, 44B.

As shown in FIG. 44A, by the operation of pushing down the stem 106, the concentrate C is discharged to the exterior through the concentrate passage Z1. Meanwhile, when the concentrate C of the accommodating chamber S1 is discharged wholly, as shown in FIG. 44B, the inner container 12 expands, to contact tightly the inner surface of the outer container 11. Particularly, in this two-layer discharge container 160, in the case that the outer container 11 and the inner container 12 are made to be transparent or translucent, since the inner container 12 has substantially the identical shape with the inner surface of the outer container 11, and the space between the outer container 11 and the inner container 12 serves as the accommodating chamber S1, when using that which is opaque, particularly cream as the concentrate C, the appearance of the outer container varies suddenly in the conditions between the state that the concentrate C remains and the state the concentrate C does not remain. Stated differently, when the concentrate C remains in the accommodating chamber S1, in the outer container 11, the presence of the concentrate C can be identified, when the concentrate C disappears from the inside of the accommodating chamber S1, the outer container 11 becomes transparent suddenly. Hence, the run out of the concentrate C can be visually identified.

Moreover, after discharging the concentrate C wholly, by turning the cap 168, it can be separated into each part. Particularly, since it is provided with the inner seal material A2 which seals by compressing between the inner container 12 and the valve assembly 13 vertically, and the outer seal material A1 (O ring) which seals by compressing between the outer container and the valve assembly right and left (horizontally), and since the cap 168 is made to be screw type, when the cap 168 is loosened by turning in the direction of unsealing, the seal of the inner seal material A2 can be released while maintaining the seal of the outer seal material A1 (temporary fixing).

Stated differently, the pressurizing agent P in the inner container 12 opens the check valve for concentrate 163, passing through a part (the outer periphery of the flange portion 172*b* of the valve holder 165, the lateral passage groove 27*a*, the space G1) of the concentrate passage Z1, the pressurizing agent P can be discharged to the exterior from the stem 106 by operating the valve assembly 161.

Moreover, even in the case that consumers loosen the cap 168 accidently in a state that the concentrate C remains in the accommodating chamber S1, since the seal between the outer container 11 and the cap 168 is maintained by the outer seal material A1, the concentrate C does not spout from the lower end of the cap 168.

What is claimed is:

1. A discharge container comprising an outer container;

an inner container accommodated in the outer container; and a valve assembly fixed by engaging with an outer periphery of the outer container, closing the outer container and the inner container, wherein a content is accommodated in an accommodating chamber between the outer container and the inner container, and a pressurizing agent is filled in a pressurizing chamber in the inner container, wherein the valve assembly is provided with a valve mechanism communicating/shutting off a discharge passage of the content which communicates the accommodating chamber and atmospheric air, a valve holder which accommodates the valve mechanism, and a cap which fixes the valve holder to the outer container so as to cover the valve holder and the outer container, wherein the valve holder has a housing to accommodate the valve mechanism and an annular flange arranged above the outer container, wherein an upper surface of the annular flange is covered by the cap, wherein the accommodating chamber and atmospheric air are communicated through inside the housing and between the cap and the annular flange, and wherein the valve assembly performs a switching operation to communicate the pressurizing chamber and atmospheric air with each other.

2. The discharge container according to claim 1, wherein the valve assembly performs the switching operation to communicate the pressurizing chamber and atmospheric air communicated with each other through the valve mechanism.

3. A discharge container comprising, an outer container;

an inner container accommodated in the outer container; and a valve assembly fixed by engaging with an outer periphery of the outer container, closing the outer container and the inner container, wherein a content is accommodated in an accommodating chamber between the outer container and the inner container, and a pressurizing agent is filled in a pressurizing chamber in the inner container, wherein the valve assembly is provided with a valve mechanism communicating/shutting off a discharge passage of the content which communicates the accommodating chamber and atmospheric air, a valve holder which accommodates the valve mechanism, and a cap which fixes the valve holder to the outer container so as to cover the valve holder and the outer container, wherein the valve holder has a housing to accommodate the valve mechanism and an annular flange arranged above the outer container, wherein the accommodating chamber and atmospheric air are communicated through the housing and the annular flange, wherein the valve assembly performs a switching operation to communicate the pressurizing chamber and atmospheric air with each other, wherein the valve mechanism is provided with a stem having two independent intra-stem passages, wherein the valve holder has an intra-holder discharge passage which communicates the accommodating chamber and atmospheric air, and an intra-holder gas passage which communicates the pressurizing chamber and atmospheric air, wherein the one intra-stem passage communicates with the intra-holder discharge passage, the other intra-stem passage communicates with the intra-holder gas passage, and the other intra-stem passage is closed to discharge the content, and wherein the switching operation is the operation to make the other intra-stem passage open and to make the valve mechanism open.

4. The discharge container according to claim 3, wherein a push button is attached to the stem detachably, the push button having a stem engaging portion to engage with the stem, a discharge hole to discharge the content, and an intra-button passage to connect the stem engaging portion and the discharge hole, wherein the stem engaging portion communicates the one intra-stem passage with the discharge hole, and shuts off the other intra-stem passage from atmospheric air, and wherein the switching operation is the operation to detach the push button and to open the valve mechanism.

5. A discharge container comprising, an outer container;

an inner container accommodated in the outer container; and a valve assembly fixed by engaging with an outer periphery of the outer container, closing the outer container and the inner container, wherein a content is accommodated in an accommodating chamber between the outer container and the inner container, and a pressurizing agent is filled in a pressurizing chamber in the inner container, wherein the valve assembly is provided with a valve mechanism communicating/shutting off a discharge passage of the content which communicates the accommodating chamber and atmospheric air, a valve holder which accommodates the valve mechanism, and a cap which fixes the valve holder to the outer container so as to cover the valve holder and the outer container, wherein the valve holder has a housing to accommodate the valve mechanism and an annular flange arranged above the outer container, wherein the accommodating chamber and atmospheric air are communicated through the housing and the annular flange, wherein the valve assembly performs a switching operation to communicate the pressurizing chamber and atmospheric air with each other, wherein the cap is made so as to be movable vertically to the outer container, an inner seal material being provided between the valve holder and the inner container, an outer seal material of circular cross section being provided between the outer cylindrical surface of the outer container and the inner cylindrical surface of the cap, the cap being fixed to the fixed position of the outer container, a seal structure being made to be formed by the outer seal material and the inner seal material respectively to discharge the content, and wherein the switching operation includes to release the seal structure of the inner seal material, while the cap is moved to the temporary position upper than the fixed position to make the seal structure of the outer seal material maintained.

6. The discharge container according to claim 5, wherein the valve holder and the cap are connected integrally.

7. The discharge container according to claim 5, wherein when the cap is moved to the temporary position and the seal structure of the inner seal material is released, the pressurizing chamber and the discharge passage of the content are communicated, and wherein the switching operation is the operation to move the cap to the temporary position and to release the valve mechanism.

8. The discharge container according to claim 5, wherein the inner seal material is compressed vertically.

9. The discharge container according to claim 5, wherein the inner seal material is compressed horizontally.

10. The discharge container according to claim 1, wherein the valve assembly is further provided with a valve cover covering the valve holder so as to fix the valve mechanism to the inside of the valve holder, wherein the upper surface of the annular flange is covered by the valve cover, and wherein the accommodating chamber and atmospheric air are communicated through inside the housing and between the valve cover and the annular flange.

11. The discharge container according to claim 1, wherein the upper surface of the annular flange or the lower surface of the cap is provided with a lateral passage groove.

12. The discharge container according to claim 1, wherein the upper surface of the annular flange is provided with an elongated protrusion.

* * * * *